US007376371B2

(12) United States Patent
Mori

(10) Patent No.: US 7,376,371 B2
(45) Date of Patent: May 20, 2008

(54) PROCESS CARTRIDGE WITH COMPONENT GEOMETRY SUITABLE FOR RECYCLE OF SAME

(75) Inventor: Hiroki Mori, Nagoya (JP)

(73) Assignee: Brother Koygo Kabushiki Kaisha, Nagoya-shi, Aichi-ken ( * ) Notice: Subject to any disclaimer, the term of this patent is extended or adjusted under 35 U.S.C. 154(b) by 274 days.

(21) Appl. No.: 11/148,416

(22) Filed: Jun. 9, 2005

(65) Prior Publication Data

US 2005/0276631 A1 Dec. 15, 2005

(30) Foreign Application Priority Data

Jun. 11, 2004 (JP) ..... 2004-174315
Sep. 30, 2004 (JP) ..... 2004-289136

(51) Int. Cl.
*G03G 21/16* (2006.01)
*G03G 21/00* (2006.01)
*G03G 15/04* (2006.01)

(52) U.S. Cl. ..... 399/111; 399/119; 399/98; 399/99

(58) Field of Classification Search ..... 399/24, 399/25, 29, 109, 111, 119, 257, 98, 99
See application file for complete search history.

(56) References Cited

U.S. PATENT DOCUMENTS

| | | | | |
|---|---|---|---|---|
| 6,041,203 | A | 3/2000 | Suzuki et al. | |
| 6,330,410 | B1 | 12/2001 | Okabe et al. | |
| 6,353,722 | B1 * | 3/2002 | Klimley et al. | 399/257 |
| 6,411,789 | B1 | 6/2002 | Okabe et al. | |
| 6,546,217 | B2 | 4/2003 | Okabe et al. | |
| 6,690,903 | B2 | 2/2004 | Okabe et al. | |
| 2004/0126132 | A1 | 7/2004 | Okabe et al. | |

FOREIGN PATENT DOCUMENTS

JP 2000-267547 9/2000

* cited by examiner

*Primary Examiner*—Hoang Ngo
(74) *Attorney, Agent, or Firm*—Banner & Witcoff, Ltd

(57) ABSTRACT

A process cartridge is disclosed which is detachably mounted on an apparatus for forming an image using toner, and which has a process cartridge housing. The process cartridge housing includes: a smoothed surface portion including an inner face and an outer face; at least one protruding portion formed on the smoothed surface portion so as to protrude therefrom; and a structure having a surface configured for physically facilitating removal of the toner from the process cartridge housing, once attached thereto.

14 Claims, 41 Drawing Sheets

| RADIAL DISTANCE FROM TUBULAR PORTION 21 (mm) | VERIFICATION OF STATE IN WHICH TONER WAS SCATTERED |
|---|---|
| 0~1 | ×× |
| 1~3 | ×× |
| 3~5 | ×× |
| 5~10 | × |
| 10~15 | × |
| 15~20 | × |
| 20~25 | △ |
| 25~30 | △ |
| 30~ | ○ |

FIG.32

PROCESS CARTRIDGE WITH COMPONENT GEOMETRY SUITABLE FOR RECYCLE OF SAME

This application is based on Japanese Patent Applications No. 2004-174315 filed Jun. 11, 2004, and No. 2004-289136 filed Sep. 30, 2004, the contents of which are incorporated hereinto by reference.

CROSS-REFERENCE TO RELATED APPLICATIONS

Not Applicable.

BACKGROUND OF THE INVENTION

1. Field of the Invention

The invention relates to a replaceable cartridge for use in image forming apparatuses of an electro-photography type such as copiers, facsimile machines, or laser printers, and more particularly to technologies of facilitating recycle of such a cartridge.

2. Description of the Related Art

Apparatuses are known that each form an image such as characters or graphics in a manner that an electrostatic latent image is formed on a photosensitive member (a photosensitive drum, a photosensitive belt, etc.), that a developer material is delivered to the photosensitive member for formation of a visible image, and that the visible image is transferred onto a recording medium.

An example of such a type of an image forming apparatus is disclosed in Japanese Patent Publication No. 2000-267547. This conventional apparatus includes a process cartridge detachable to a body (housing) of the apparatus. This process cartridge is configured to include a photosensitive cartridge at least contains a photosensitive member, and a developer cartridge containing a toner storage chamber and a developing roller.

BRIEF SUMMARY OF THE INVENTION

Lately, in view of environmental problems, it has been conducted that a used process cartridge is collected, and the same process cartridge is refilled with toner for reuse. Such reuse of a cartridge requires removal of dirt from the cartridge.

However, a conventional process cartridge is designed so carelessly as to pay no attention to an easiness to remove dirt from the surface of the process cartridge, such that a plurality of protrusions such as ribs for enhancement in strength of the process cartridge are formed on the surface of the process cartridge. For this reason, difficulties are encountered in removing dirt once entered into recesses between adjacent protrusions formed on the surface of the process cartridge.

In addition, a recyclable developer cartridge includes a toner supply port for allowing supply of toner into a toner storage chamber of the developer cartridge. For recycling a process cartridge on which such a developer cartridge has been mounted, residual toner is removed from the toner storage chamber through the toner supply port of the developer cartridge, and further, the toner storage chamber is refilled with fresh toner through the same toner supply port.

However, if the residual toner is attempted to be removed from the developer cartridge with the toner supply port facing down, then the toner is scattered and undesirably attached to a gear cover disposed close to the toner supply port and a side wall of the developer cartridge, resulting in visual deterioration of the developer cartridge. For this reason, a worker is required to remove the toner from the developer cartridge, once undesirably attached thereto, resulting in increase in troublesomeness of the worker's job.

It is therefore an object of the present invention to provide a recyclable cartridge which is so easily restored at least visually as completely as possible as to be suitable for recycle.

According to a first aspect of the present invention, a process cartridge detachably mounted on an apparatus for forming an image using toner, having a process cartridge housing is provided. The process cartridge comprises:

a smoothed surface portion including an inner face and an outer face;

at least one protruding portion formed on the smoothed surface portion so as to protrude therefrom; and a structure having a surface configured for physically facilitating removal of dirt from the process cartridge housing, once attached thereto.

The process cartridge includes the process cartridge housing, the surface of which is configured to have a geometry (shape, dimensions, etc.) physically facilitating removal of dirt such as toner from the surface, once attached thereto. That is to say, the process cartridge has a surface geometry optimized for improvement in the easiness to remove dirt from the process cartridge.

Therefore, the process cartridge makes it easier to remove dirt such as toner from the process cartridge housing, once attached thereto.

According to a second aspect of the present invention, a developer cartridge for use in an apparatus for forming an image using toner in an electro-photographic manner is provided. The developer cartridge comprises:

a developer cartridge housing;

a toner storage chamber formed within the developer cartridge housing for storage of the toner;

a tubular portion protruding outwardly from the developer cartridge housing for communication between the toner storage chamber and an external space; and at least one neighboring component disposed at an outer face of the developer cartridge housing in the proximity of the tubular portion, wherein the tubular portion is higher than the at least one neighboring component in terms of a height measured from the developer cartridge housing.

In the developer cartridge, the tubular portion and the at least one neighboring component are disposed at the outer face of the developer cartridge housing. The tubular portion is higher than the at least one neighboring component with respect to a protrusion height measured from the developer cartridge housing.

Therefore, the developer cartridge reduces the possibility that toner once discharged through the tubular portion is scattered and undesirably attached to an area around the tubular portion.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 32 is a table representing results from an experiment conducted for verifying the effects provided by the process cartridge indicated in FIG. 23;

DETAILED DESCRIPTION OF THE INVENTION

Figure 1:
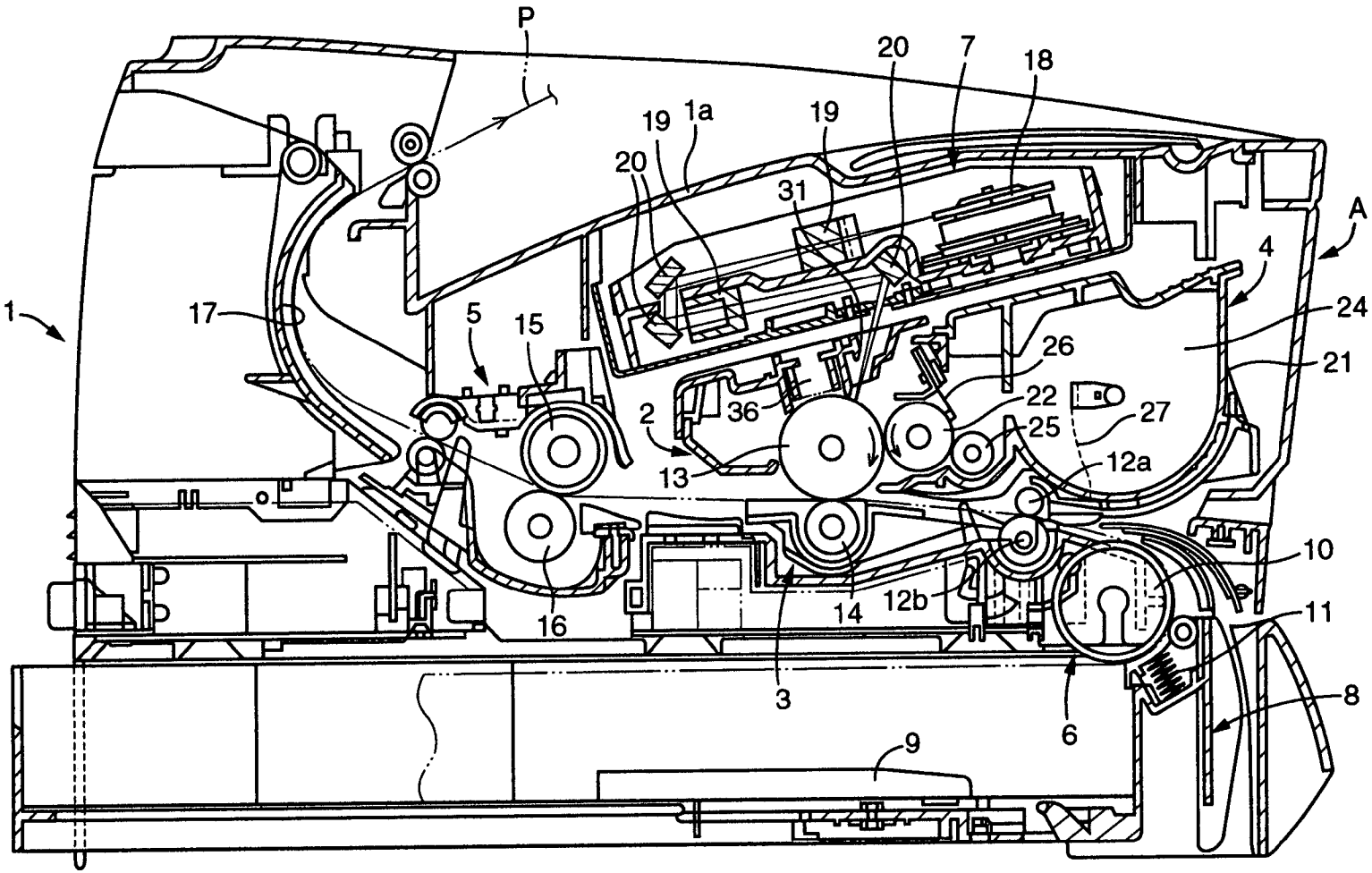
FIG. 1 is a sectional side view illustrating a printer as an image forming apparatus incorporating a process cartridge constructed according to a first embodiment of the present invention.

The object mentioned above may be achieved according to any one of the following modes of this invention.

These modes will be stated below such that these modes are sectioned and numbered, and such that these modes depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the selected modes of the invention in such a dependent form as to depend from the other mode or modes does not exclude a possibility of the technological features in a dependent-form mode to become independent of those in the corresponding depended mode or modes and to be removed therefrom. It should be interpreted that the technological features in a dependent-form mode is allowed to become independent according to the nature of the corresponding technological features, where appropriate.

(1) A process cartridge detachably mounted on an apparatus for forming an image using toner, having a process cartridge housing comprising:

a smoothed surface portion including an inner face and an outer face;

at least one protruding portion formed on the smoothed surface portion so as to protrude therefrom; and a structure having a surface configured for physically facilitating removal of dirt from the process cartridge housing, once attached thereto.

The process cartridge according to the above mode (1) includes the process cartridge housing, the surface of which is configured to have a geometry (shape, dimensions, etc.) physically facilitating removal of dirt such as toner from the surface, once attached thereto. That is to say, the process cartridge has a surface geometry optimized for improvement in the easiness to remove dirt from the process cartridge.

Therefore, the process cartridge according to the above mode (1) makes it easier to remove dirt such as toner from the process cartridge housing, once attached thereto.

(2) The process cartridge according to mode (1), wherein the structure comprises a fillet portion connecting the smoothed surface portion and the protruding portion with each other, and wherein the fillet portion extends from the smoothed surface portion up to a position higher than the smoothed surface portion by a distance not shorter than one-third times a total height of the protruding portion measured from the smoothed surface portion.

The process cartridge according to the above mode (2) is configured such that the protruding portion and the smoothed surface portion are connected via the fillet portion which extends from the smoothed surface portion up to a position higher than the smoothed surface portion by a distance not shorter than one-third times the total height of the protruding portion measured from the smoothed surface portion.

Thus, the process cartridge according to the above mode (2) has a ratio of the height of the fillet portion to that of the protruding portion optimized for improvement in the easiness to remove dirt such as toner from the fillet portion and the protruding portion, once attached thereto.

Therefore, the process cartridge according to the above mode (2) makes it easier to remove dirt such as toner, even if the dirt has been attached to the base end (proximal end) of the protruding portion. This allows the process cartridge to be more easily cleaned for recycle of the process cartridge.

The term "fillet portion" used in the above mode (2) and the following modes may be defined, for example, to mean a concavely curved surface portion (e.g., a curved surface portion having a surface shape in cross section formed with a single true circle and therefore having a single radius of curvature) having a surface shape in cross section formed with at least one true circle, or a concavely curved surface portion having a surface shape in cross section formed with at least one ellipse.

(3) The process cartridge according to mode (1) or (2), wherein the structure comprises a fillet portion connecting the smoothed surface portion and the protruding portion with each other, and wherein the fillet portion has a radius of curvature of not smaller than 2 mm.

The process cartridge according to the above mode (3) is configured such that the protruding portion and the smoothed surface portion are connected via the fillet portion, the radius of curvature of which is not smaller than 2 mm. Thus, the process cartridge according to the above mode (3) has the radius of curvature of the fillet portion optimized for improvement in the easiness to remove dirt such as toner from the fillet portion and the protruding portion, once attached thereto.

Therefore, the process cartridge according to the above mode (3) makes it easier to remove dirt such as toner, even if the dirt has been attached to the base end (proximal end) of the protruding portion. This allows the process cartridge to be more easily cleaned for recycle of the process cartridge.

(4) The process cartridge according to any one of modes (1)-(3), wherein the at least one protruding portion comprises a plurality of ridges each extending along the smoothed surface portion, and wherein the structure is adapted to locate the plurality of ridges on the smoothed surface portion so as not to intersect each other.

The process cartridge according to the above mode (4) prevents the plurality of ridges from intersecting each other, resulting in an easier removal of dirt such as toner from a space between the ridges, once attached thereto.

(5) The process cartridge according to mode (4), wherein the structure is adapted to locate the plurality of ridges on the smoothed surface portion such that the plurality of ridges do not cooperatively form a closed area on the smoothed surface portion.

The process cartridge according to the above mode (5) prevents the plurality of ridges from forming a closed area on the smoothed surface portion, resulting in an easier removal of dirt such as toner from a space between the ridges, once attached thereto.

(6) The process cartridge according to mode (4) or (5), wherein the structure is adapted to locate the plurality of ridges on the smoothed surface portion so as to coextend generally in parallel to each other.

The process cartridge according to the above mode (6), because of the plurality of ridges being in parallel to each other, allows an easier removal of toner from a space between the ridges, for example, by a method such as brushing the process cartridge along the ridges.

(7) The process cartridge according to any one of modes (1)-(6), further comprising a rotating member disposed within the process cartridge housing, wherein the process cartridge housing further comprises opposite side walls supporting the rotating member at opposite ends thereof, respectively, at least one of the opposite side walls including the smoothed surface portion, and wherein the protruding portion is formed on the smoothed surface portion of the at least one side wall.

The process cartridge according to the above mode (7), even though the protruding portion is formed on at least one of the opposite side walls of the process cartridge housing, in the form of a rib for reinforcement, allows an easier removal of dirt such as toner from the base end of the rib, once attached thereto.

The "rotating member" set forth in the above mode (7) may be embodied as a photosensitive roller, a transfer roller, etc., for example.

(8) The process cartridge according to any one of modes (1)-(7), further comprising a rotating member disposed within the process cartridge housing, wherein the process cartridge housing further comprises opposite side walls supporting the rotating member at opposite ends thereof, respectively, wherein the process cartridge housing is constructed by combining a plurality of members including two adjacent members cooperatively forming at least one of the opposite side walls, and wherein the structure is adapted to locate the two adjacent members on the at least one side wall, such that a substantially straight seam is formed on the at least one side wall between the two adjacent members, so as to cross edge-to-edge the at least one side wall along a surface thereof, and such that respective surfaces of the two adjacent members are substantially flush with each other at the formed seam.

The process cartridge according to the above mode (8) is configured to have a seam formed between the two adjacent members which are flush with each other at the seam. Therefore, the process cartridge according to the above mode (8) allows an easier removal of dirt such as toner from the seam, for example, by a method such as brushing the process cartridge along the seam.

(9) The process cartridge according to any one of modes (1)-(8), further comprising a rotating member disposed within the process cartridge housing, wherein the process cartridge housing further comprises opposite side walls supporting the rotating member at opposite ends thereof, respectively, wherein the process cartridge housing is constructed by combining a plurality of members including members A and B adjacent to each other on at least one of the opposite side walls, and wherein the structure comprises a cover member externally covering at least one of opposite ends of the member A, one of ends of the cover member being located on or above an outwardly-facing flat plane portion of the member B.

The process cartridge according to the above mode (9), because of one of the opposite ends of the member B being externally covered with the cover member, prevents dirt such as toner from being entered into the one end of the member B.

Further, the process cartridge according to the above mode (9), allows one of the plurality of ends of the cover member which is in the vicinity of the member B, to be disposed on or above the flat plane portion of the member B which faces outwardly.

Therefore, the process cartridge according to the above mode (9) prevents a narrow clearance gap from being formed between the one end of the cover member and otherwise components. This results in suppression of entry of dirt such as toner into a narrow clearance gap, allowing an easier cleaning of the process cartridge.

(10) The process cartridge according to any one of modes (1)-(9), further comprising a rotating member disposed within the process cartridge housing, wherein the process cartridge housing further comprises opposite side walls supporting the rotating member at opposite ends thereof, respectively, at least one of the opposite side walls including the smoothed surface portion, wherein the at least one protruding portion comprises at least one ridge extending along the smoothed surface portion of the at least one side wall, and wherein the structure is adapted to locate the at least one ridge on an inner face of the at least one side wall.

The process cartridge according to the above mode (10) is configured to include the protruding portion in the at least one side wall, not on an outer face (visible from a user) of the at least one side wall, but on the inner face (invisible from the user). Because of the process cartridge, there is no need of forming a protrusion, for example, for reinforcement, on the outer face of the at least one side wall, or if any, it is enough that a small-sized protrusion is formed.

Therefore, the process cartridge according to the above mode (10) makes it easier to remove dirt such as toner from the outer face of the at least one side wall, once attached thereto.

(11) The process cartridge according to any one of modes (1)-(10), further comprising a photosensitive roller and a transfer roller both disposed within the process cartridge housing, wherein the process cartridge housing further comprises opposite side walls supporting the photosensitive roller and the transfer roller at opposite ends thereof, respectively, at least one of the opposite side walls including the smoothed surface portion, wherein the at least one protruding portion comprises at least one ridge extending along the smoothed surface portion of the at least one side wall, and wherein the structure is adapted to locate the at least one ridge on an inner face of the at least one side wall within an area with which the photosensitive roller and the transfer roller are overlapped when projected in axial directions thereof onto the inner face, the structure including a smoothed surface formed on an outer face of the at least one side wall.

The process cartridge according to the above mode (11) allows the outer face of an area (hereinafter, referred to as "overlapped area") of the at least one side wall which is overlapped with the photosensitive roller and the transfer roller when projected in their axial directions, to be formed as a smoothed surface. Therefore, the process cartridge makes it easier to remove dirt such as toner from the outer face of the overlapped area, once attached thereto.

Although, in the process cartridge according to the above mode (11), stresses are loaded on the area from the photosensitive roller and the transfer roller, the process cartridge more easily suppress a deformation of the at least one side wall due to the stresses, because of the formation of the protruding portion on the inner face of the overlapped area.

(12) The process cartridge according to any one of modes (1)-(11), further comprising a photosensitive roller and a transfer roller both disposed within the process cartridge housing, wherein the process cartridge housing further comprises opposite side walls supporting the photosensitive roller and the transfer roller at opposite ends thereof, respectively, and wherein the structure comprises a cover member displaced on an outer face of at least one of the opposite side walls, within an area with which the photosensitive roller and the transfer roller are overlapped when projected in axial directions thereof onto the outer face, the structure including a smoothed surface formed on an outer face of the at least one side wall, the cover member being separable from the outer face.

The process cartridge according to the above mode (12) allows the outer face of an area (hereinafter, referred to as "overlapped area") of the at least one side wall which is overlapped with the photosensitive roller and the transfer roller when projected in their axial directions, to have a separable cover member formed on the outer face. Therefore, for example, for recycling the process cartridge, a mere separation of the cover member from the outer face allows removal of dirt such as toner from the outer face.

(13) The process cartridge according to mode (2), wherein the process cartridge housing comprises a transport path section, wherein the transport path section forms a transport path in which a recording medium for recording the image is transported, with the process cartridge being mounted on the apparatus, in cooperation with the apparatus, and wherein the transport path section comprises the smoothed surface portion, the protruding portion, and the fillet portion, each formed in the transport path section.

The process cartridge according to the above mode (13) includes the transport path section which forms the transport path of the recording medium, with the process cartridge being mounted on the apparatus for forming an image, in cooperation with the apparatus, wherein the transport path section has the protruding portion. In the process cartridge, to the protruding portion, the fillet portion according to the above mode (2) is added.

Therefore, the process cartridge according to the above mode (13), owing to the functions explained in conjunction with the above mode (2), allows an easier removal of dirt such as toner, even though the dirt is attached to the base end of the protruding portion of the transport path section. This results in an easier cleaning of the process cartridge for recycle.

(14) The process cartridge according to mode (3), wherein the process cartridge housing comprises a transport path section, wherein the transport path section forms a transport path in which a recording medium for recording the image is transported, with the process cartridge being mounted on the apparatus, in cooperation with the apparatus, and wherein the transport path section comprises the smoothed surface portion, the protruding portion, and the fillet portion, each formed in the transport path section.

The process cartridge according to the above mode (14) includes the transport path section which forms the transport path of the recording medium, with the process cartridge being mounted on the apparatus for forming an image, in cooperation with the apparatus, wherein the transport path section has the protruding portion. In the process cartridge, to the protruding portion, the fillet portion according to the above mode (3) is added.

Therefore, the process cartridge according to the above mode (14), owing to the functions explained in conjunction with the above mode (3), allows an easier removal of dirt such as toner, even though the dirt is attached to the base end of the protruding portion of the transport path section. This results in an easier cleaning of the process cartridge for recycle.

(15) An apparatus for forming an image on a recording medium using toner, on which the process cartridge according to any one of modes (1)-(14) is detachably mounted.

In the process cartridge according to any one of the above modes (1)-(14), attachment of dirt to the surface of the process cartridge is suppressed, allowing an easier cleaning of the process cartridge. For this reason, there is less dirt remaining on the process cartridge still after cleaning for recycle.

The apparatus according to the above mode (15), owing to the employment of the process cartridge thus explained to be less-dirty, eliminates the possibility that contamination is caused due to a dirty process cartridge.

The term "apparatus" may be a printer of a laser beam type, for example.

(16) The process cartridge according to any one of modes (1)-(14), further comprising a developer cartridge including:

a developer cartridge housing;

a toner storage chamber formed within the developer cartridge housing for storage of the toner;

a tubular portion protruding outwardly from the developer cartridge housing for communication between the toner storage chamber and an external space; and at least one neighboring component disposed at the developer cartridge housing in the proximity of the tubular portion, wherein the tubular portion is higher than the at least one neighboring component in terms of a height measured from the developer cartridge housing.

The process cartridge according to the above mode (16) includes a developer cartridge according to mode (17) appearing next, the functions of which will be described below.

(17) A developer cartridge for use in an apparatus for forming an image using toner in an electro-photographic manner, comprising:

a developer cartridge housing;

a toner storage chamber formed within the developer cartridge housing for storage of the toner;

a tubular portion protruding outwardly from the developer cartridge housing for communication between the toner storage chamber and an external space; and at least one neighboring component disposed at the developer cartridge housing in the proximity of the tubular portion, wherein the tubular portion is higher than the at least one neighboring component in terms of a height measured from the developer cartridge housing.

In the developer cartridge according to the above mode (17), the tubular portion and the at least one neighboring component are disposed at the outer face of the developer cartridge housing. The tubular portion is higher than the at least one neighboring component with respect to a protrusion height measured from the developer cartridge housing.

Therefore, the developer cartridge according to the above mode (17) reduces the possibility that toner once discharged through the tubular portion is scattered and undesirably attached to an area around the tubular portion.

Further, the developer cartridge according to the above mode (17) allows the tubular portion to be higher than the at least one neighboring component. Therefore, the developer cartridge facilitates fit of a cover for preventing scatter of toner, into the tubular portion, without interruption with the at least one neighboring component, for subsequent discharge of residual toner and fill (first fill or refill) with fresh toner. The developer cartridge also facilitates external fit of a suction pipe of a vacuum cleaner into the tubular portion so as to cover an outer face of the tubular portion, for subsequent discharge of residual toner using the vacuum cleaner.

Therefore, the developer cartridge according to the above mode (17), for the above reasons, also reduces the possibility that toner is attached to the outer face of the developer cartridge housing during discharge and fill of toner. As a result, the developer cartridge more easily prevents contamination of the developer cartridge with residual toner or fresh toner during operation for recycle.

(18) The developer cartridge according to mode (17), wherein the at least one neighboring component comprises a movable member in support of the developer cartridge housing, driven due to a driving force, and a gear member transferring the driving force to the movable member, and wherein the tubular portion is higher than the gear member in terms of the height measured from the developer cartridge housing.

In the developer cartridge according to the above mode (18), the tubular portion is higher than the gear member in the vicinity of the tubular portion, on the outer face of the developer cartridge housing. Therefore, the developer cartridge reduces the possibility that toner once discharged through the tubular portion is scattered and undesirably attached to the gear member.

Further, the developer cartridge according to the above mode (18) allows the tubular portion to be higher than the gear member. Therefore, the developer cartridge facilitates fit of a cover for preventing scatter of toner, into the tubular portion, without interruption with the gear member, for subsequent discharge of residual toner and fill with fresh toner. The developer cartridge also facilitates external fit of a suction pipe of a vacuum cleaner into the tubular portion so as to cover an outer face of the tubular portion, for subsequent discharge of residual toner using the vacuum cleaner.

Therefore, the developer cartridge according to the above mode (18), for the above reasons, also reduces the possibility that toner is attached to the gear member during discharge and fill of toner.

The terms "movable member" set forth in the above mode (18) may be, for example, a developing roller shaft for rotating a developing roller, a coupling shaft receiving a driving force via a coupling, a shaft supporting a gear member transferring the driving force to the developing roller shaft, a supply roller shaft supporting a supply roller for supply of toner to the developing roller, etc.

(19) The developer cartridge according to mode (18), wherein the movable member comprises a plurality of movable members, and the gear member comprises a plurality of gear members, and wherein the tubular portion is higher than any one of the plurality of gear members in terms of the height measured from the developer cartridge housing.

In the developer cartridge according to the above mode (19), the tubular portion is higher than any one of the plurality of gear members in the vicinity of the tubular portion, on the outer face of the developer cartridge housing. Therefore, the developer cartridge reduces the possibility that toner once discharged through the tubular portion is scattered and undesirably attached to each of the gear members.

Further, the developer cartridge according to the above mode (19) allows the tubular portion to be higher than any one of the plurality of gear members. Therefore, the developer cartridge facilitates fit of a cover for preventing scatter of toner, into the tubular portion, without interruption with any one of the plurality of gear members, for subsequent discharge of residual toner and fill with fresh toner. The developer cartridge also facilitates external fit of a suction pipe of a vacuum cleaner into the tubular portion so as to cover an outer face of the tubular portion, for subsequent discharge of residual toner using the vacuum cleaner.

Therefore, the developer cartridge according to the above mode (19), for the above reasons, also reduces the possibility that toner is attached to each of the gear members during discharge and fill of toner.

(20) The developer cartridge according to mode (19), wherein the plurality of movable members comprises a developing roller, wherein the plurality of gear members comprise a developing roller gear transferring a driving force to the developing roller, and a gear member mating directly or indirectly with the developing roller gear, and wherein the tubular portion is higher than the gear member mating directly or indirectly with the developing roller gear in terms of the height measured from the developer cartridge housing.

The developer cartridge according to the above mode (20) suppresses attachment of toner to the developing roller gear. Therefore, the developer cartridge eliminates the possibility that the rotation pitch (rate) of the developing roller is varied due to undesirable attachment of toner to the developing roller gear, resulting in uneven development such as a stripe.

(21) The developer cartridge according to any one of modes (18)-(20), wherein the at least one neighboring component comprises a gear cover covering the gear member, and wherein the tubular portion is higher than the gear cover in terms of the height measured from the developer cartridge housing.

In the developer cartridge according to the above mode (21), the tubular portion is higher than the gear cover the vicinity of the tubular portion, on the outer face of the developer cartridge housing. Therefore, the developer cartridge reduces the possibility that toner once discharged through the tubular portion is scattered and undesirably attached to the gear cover.

Further, the developer cartridge according to the above mode (21) allows the tubular portion to be higher than the gear cover. Therefore, the developer cartridge facilitates fit of a cover for preventing scatter of toner, into the tubular portion, without interruption with any one of the gear cover, for subsequent discharge of residual toner and fill with fresh toner. The developer cartridge also facilitates external fit of a suction pipe of a vacuum cleaner into the tubular portion so as to cover an outer face of the tubular portion, for subsequent discharge of residual toner using the vacuum cleaner.

Therefore, the developer cartridge according to the above mode (21), for the above reasons, also reduces the possibility that toner is attached to the gear cover during discharge and fill of toner. (22) The developer cartridge according to any one of modes (17)-(21), wherein the proximity of the tubular portion is defined as an area having distances of not longer than 5 mm away from an outer face of the tubular portion outside the developer cartridge housing.

In the developer cartridge according to the above mode (22), the tubular portion is higher than the at least one neighboring component within an area having distances of not longer than 5 mm away from an outer face of the tubular portion, on the outer face of the developer cartridge housing. Therefore, the developer cartridge reduces the possibility that toner once discharged through the tubular portion is scattered and undesirably attached to such a neighboring component.

Further, the developer cartridge according to the above mode (22) allows the tubular portion to be higher than such a neighboring component. Therefore, the developer cartridge facilitates fit of a cover for preventing scatter of toner, into the tubular portion, without interruption with such a neighboring component, for subsequent discharge of residual toner and fill with fresh toner. The developer cartridge also facilitates external fit of a suction pipe of a vacuum cleaner into the tubular portion so as to cover an outer face of the tubular portion, for subsequent discharge of residual toner using the vacuum cleaner.

Therefore, the developer cartridge according to the above mode (22), for the above reasons, also reduces the possibility that toner is attached to such a neighboring component.

(23) The developer cartridge according to any one of modes (17)-(21), wherein the proximity of the tubular portion is defined as an area having distances of not longer than 20 mm away from an outer face of the tubular portion outside the developer cartridge housing.

In the developer cartridge according to the above mode (23), the tubular portion is higher than the at least one neighboring component within an area having distances of not longer than 20 mm away from an outer face of the tubular portion. Therefore, the developer cartridge reduces the possibility that, once toner is shook off from the developer cartridge, for example, with the inclination for allowing the tubular portion to face down, the toner is scattered and undesirably attached to such a neighboring component.

(24) The developer cartridge according to any one of modes (17)-(21), wherein the proximity of the tubular portion is defined as an area having distances of not longer than 30 mm away from an outer face of the tubular portion outside the developer cartridge housing.

In the developer cartridge according to the above mode (24), the tubular portion is higher than the at least one neighboring component within an area having distances of not longer than 30 mm away from an outer face of the tubular portion. Therefore, the developer cartridge reduces the possibility that, once toner is shook off from the developer cartridge, for example, with the inclination for allowing the tubular portion to face down, the toner is scattered and undesirably attached to such a neighboring component.

(25) The developer cartridge according to any one of modes (17)-(24), wherein the tubular portion is generally in the form of a hollow cylinder.

The developer cartridge according to the above mode (25), because of the tubular portion being generally in the form of a follow cylinder, allows toner to smoothly pass through the tubular portion during replenishment and discharge of toner.

(26) The developer cartridge according to any one of modes (17)-(25), further comprising a cap externally inserted into the tubular portion for closing up the toner storage chamber, having a bottom portion facing the toner storage chamber, wherein the developer cartridge housing comprises a side wall from which the tubular portion protrudes, the side wall having an inner face facing the toner storage chamber, and an opening for communication between a space within the tubular portion and a space within the toner storage chamber, and wherein the bottom portion is substantially flush with a surface of a portion of the side wall which surrounds the opening, with the cap being inserted into the tubular portion at an ultimate position.

In the developer cartridge according to the above mode (26), once the cap is inserted into the tubular portion, the bottom portion of the cap becomes flush with an inner face of a portion of the developer cartridge housing which surrounds the opening.

Therefore, the developer cartridge according to the above mode (26) prevents a stepped portion to be formed between the bottom portion of the cap and the inner face of the developer cartridge housing. As a result, the developer cartridge reduces the possibility that toner remains in the neighborhood of the bottom portion of the cap.

(27) The developer cartridge according to any one of modes (17)-(26), further comprising a developing roller disposed within the developer cartridge housing, wherein the tubular portion is disposed at least one of opposite ends of the developer cartridge housing which are spaced apart from each other in a selected one of diameter directions of the developing roller.

In the developer cartridge according to the above mode (27), the tubular portion is disposed at least one of opposite ends of the developer cartridge housing which are spaced apart from each other in a selected one of diameter directions of the developing roller. Thus, the developer cartridge allows the tubular portion to be disposed at the periphery of the developer cartridge housing, facilitating toner within the toner storage chamber to be taken out collectively and thoroughly.

Further, the developer cartridge according to the above mode (27) facilitates the tubular portion and the developing roller to be spaced as much as possible apart from each other in one of the diameter directions of the developing roller. Such a disposition is more advantageous in reducing the possibility that toner is attached to the developing roller.

(28) The developer cartridge according to any one of modes (17)-(27), further comprising a developing roller, and a developing roller shaft supporting the developing roller, wherein the tubular portion is less than a corresponding one of opposite ends of the developing roller shaft in terms of the height measured from the developer cartridge housing.

The developer cartridge according to the above mode (28) allows the overall dimension of the developer cartridge in the axial direction of the developing roller shaft, to be smaller than when the size of the developer cartridge is determined such that the tubular portion is higher than the developing roller shaft in terms of the height measured from the developer cartridge housing.

Therefore, the developer cartridge according to the above mode (28) prevents the easiness to mount the developer cartridge on the apparatus for forming an image, from being sacrificed due to increase in the height of the tubular portion.

(29) A process cartridge constructed by attaching the developer cartridge according to any one of modes (17)-(28), with a photosensitive cartridge including a photosensitive member and a photosensitive cartridge housing for use in accommodating the photosensitive member within the photosensitive cartridge housing, wherein the photosensitive cartridge comprises a selectively-interfering member, operable such that, in an attempt of attachment of the developer cartridge with the photosensitive cartridge, if a length of the tubular portion of the developer cartridge is outside a predetermined range, then the selectively-interfering member interferes with the tubular portion thereby preventing attachment of the developer cartridge with the photosensitive cartridge, and if the length of the tubular portion is not outside the predetermined range, then the selectively-interfering member does not interfere with the tubular portion thereby allowing the attachment.

The developer cartridge according to the above mode (29) is allowed to be attached to the photosensitive cartridge, provided that the length of the tubular portion included in the developer cartridge is within the predetermined range.

Therefore, when the developer cartridge according to the above mode (29) is practiced such that the length of the tubular portion is varied on a type-by-type basis of the developer cartridge, a wrong type of the developer cartridge is prevented from being erroneously attached to the process cartridge. This avoids troubles due to mismatch of the type of the developer cartridge which has been attached to the process cartridge.

(30) A process cartridge constructed by attaching the developer cartridge according to any one of modes (17)-(28), with a photosensitive cartridge including a photosensitive member and a photosensitive cartridge housing for use in accommodating the photosensitive member within the photosensitive cartridge housing, wherein the photosensitive cartridge comprises an engaging portion, operable such that, in an attempt of attachment of the developer cartridge with the photosensitive cartridge, the engaging portion engages with the tubular portion of the developer cartridge, thereby guiding the developer cartridge in approaching the photosensitive cartridge, and thereby locating the developer cartridge relative to the photosensitive cartridge.

In the developer cartridge according to the above mode (30), the tubular portion included in the developer cartridge is utilized for the location and fixing of the developer cartridge relative to the photosensitive cartridge. Therefore, the developer cartridge does not require an additional member to the developer cartridge, exclusively used for these location and fixing. This facilitates structural simplification of the developer cartridge.

(31) An apparatus for forming an image on a recording medium using toner, on which the developer cartridge according to any one of modes (17)-(28) is detachably mounted.

The apparatus according to the above mode (31) provides the same functions and effects as those of the developer cartridge according to any one of the above modes (17)-(28).

(32) An apparatus for forming an image on a recording medium using toner, on which the process cartridge according to mode (29) is detachably mounted.

The apparatus according to the above mode (32) provides the same functions and effects as those of the process cartridge according to the above mode (29).

The term "apparatus" set forth in the above mode (32) may be a printer of an electro-photographic type, for example.

(33) An apparatus for forming an image on a recording medium using toner, on which the process cartridge according to mode (30) is detachably mounted.

The apparatus according to the above mode (33) provides the same functions and effects as those of the process cartridge according to the above mode (30).

The term "apparatus" set forth in the above mode (33) may be a printer of an electro-photographic type, for example.

Several presently preferred embodiments of the invention will be described in detail by reference to the drawings in which like numerals are used to indicate like elements throughout.

Referring now to FIG. 1, a printer of a laser beam type which is an example of an image forming apparatus including a process cartridge constructed according to a first embodiment of the present invention is illustrated in sectional side view.

Figure 2:
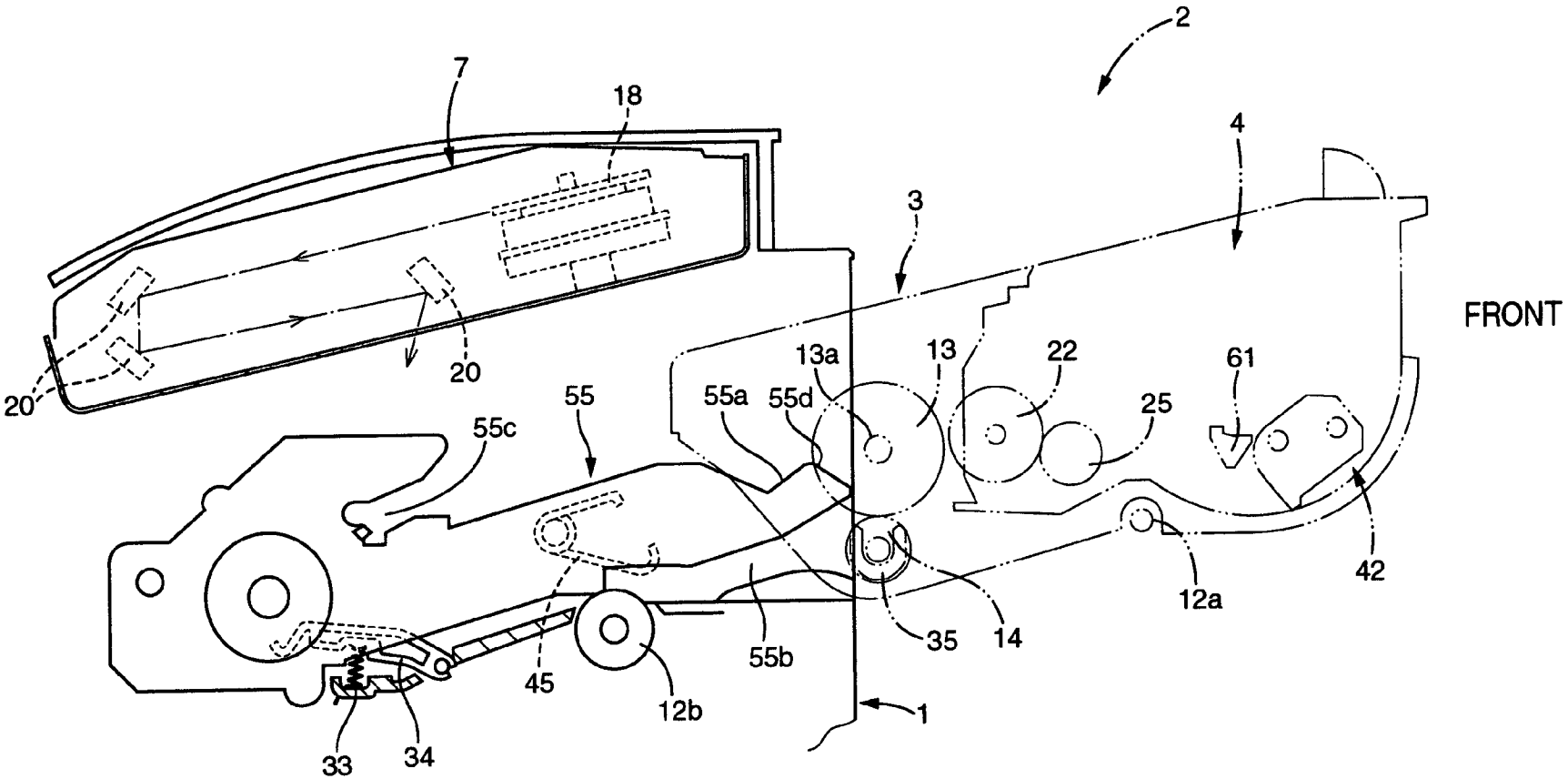
FIG. 2 is a side view illustrating the process cartridge indicated in FIG. 1 in a state in which the attachment of the process cartridge to a body housing indicated in FIG. 1 is initiated.

As illustrated in FIG. 1, the printer includes a body housing 1 and a process cartridge 2. The process cartridge 2 is constructed by assembling a photosensitive cartridge 3 and a developer cartridge 4. FIG. 2 illustrates the process cartridge 2 in an initial state allowing the attachment of the process cartridge 2 to the body housing 1 in side view in dash-dot-dot lines.

A similar printer to the present printer is disclosed in U.S. Pat. No. 6,041,203, the content of which is incorporated herein by reference.

Figure 3:
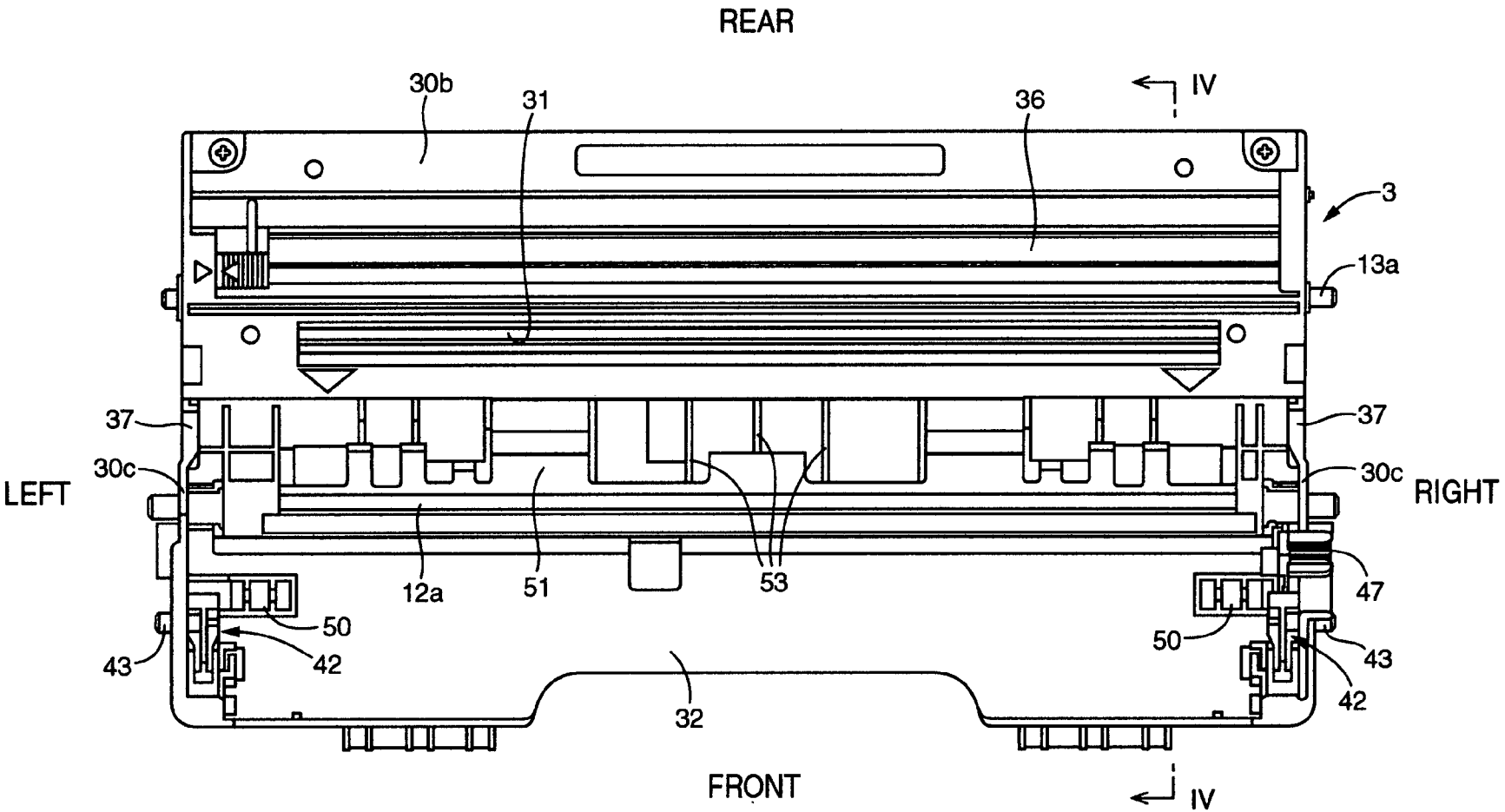
FIG. 3 is a top plan view illustrating a photosensitive cartridge indicated in FIG. 2.
Figure 4:
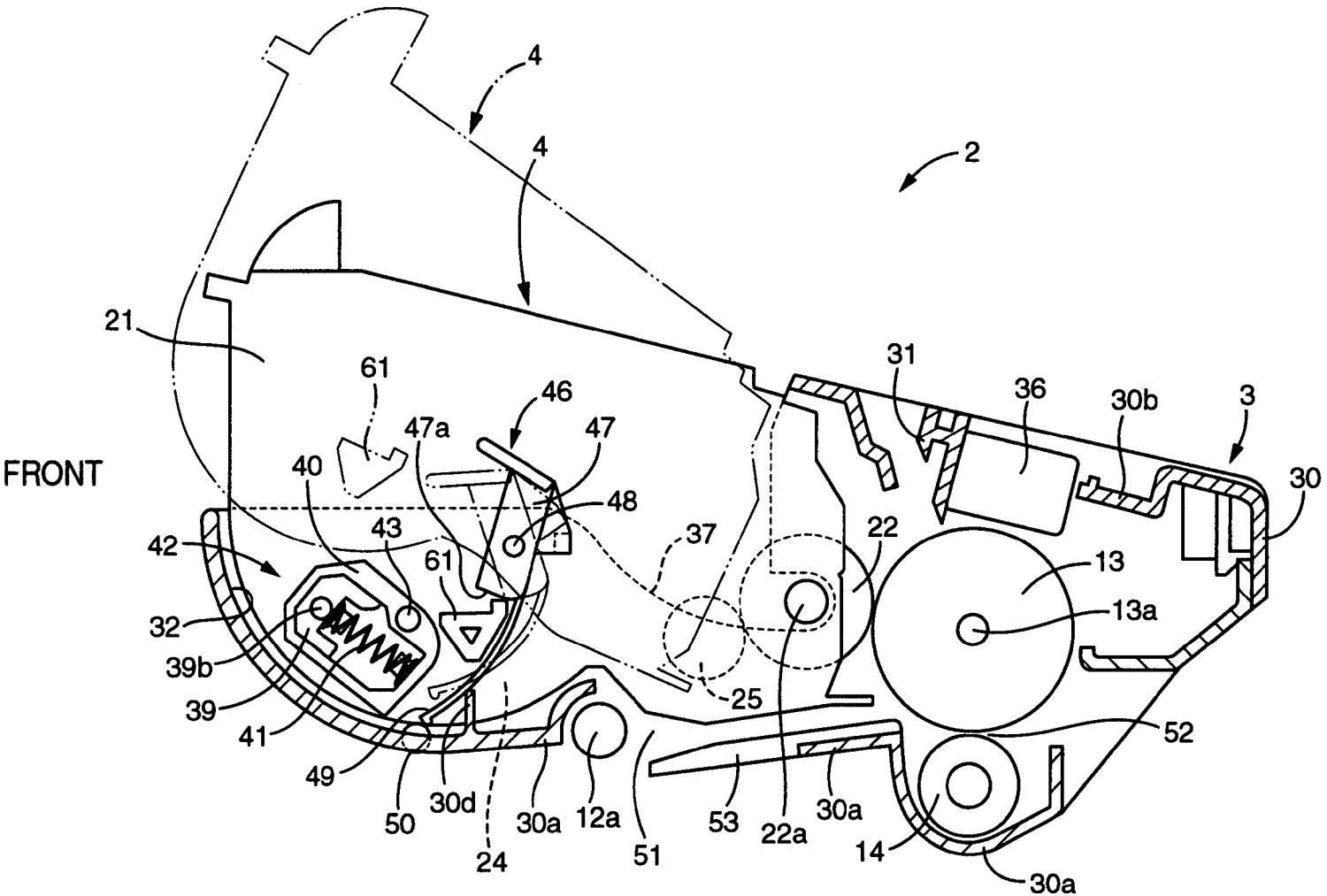
FIG. 4 is a cross section taken on line IV-IV in FIG. 3.

FIG. 3 illustrates exclusively the photosensitive cartridge 3 in top plan view, and FIG. 4 illustrates the process cartridge 2 in sectional view. As illustrated in FIG. 4, in the present embodiment, a case (process cartridge housing) of the process cartridge 2 is identical with a case (photosensitive cartridge housing) of the photosensitive cartridge 3.

As illustrated in FIG. 1, the process cartridge 2 is detachably disposed within the body housing 1 generally centrally. A fuser 5 is disposed within the body housing 1, on the left-hand side of FIG. 1, adjacent to the process cartridge 2. A sheet feeder 6 is disposed below the process cartridge 2. A sheet feeder cassette 8 is detachably disposed at a lower portion of the body housing 1. Attachment and detachment of the sheet feeder cassette 8 are allowed through a front face (indicated by arrow A in FIG. 1) of the body housing 1.

As illustrated in FIG. 1, the body housing 1 includes a sheet exit tray 1*a* made up of synthetic resin serving also as a cover. A laser scanner unit 7 is attached, via a frame, to and below the sheet exit tray 1*a*. The laser scanner unit 7 is constructed to include a laser light emitter (not shown), a polygon mirror 18, a lens 19, a plurality of reflective mirrors 20, etc.

Briefly describing, the printer is operated as follows:

Once print data is delivered, in response to a print command, from an external device (not shown), e.g., a personal computer, a plurality of sheets P in the form of cut sheets (as recording media) stacked on a support plate 9 of the sheet feeder cassette 8 are separated one by one, owing to a separation pad 11, with rotation of a sheet feeder roller 10 of the sheet feeder 6. The separated sheet P is subsequently transported, via paired registration rollers 12*a*, 12*b*, into between a photosensitive drum 13 as a photosensitive material of the process cartridge 2, and a transfer roller 14 as a transfer device which is pressed against the underside of the photosensitive drum 13.

In a lower plate of the aforementioned frame, a light exit hole is formed which allows exit of a laser beam emitted from the laser scanner unit 7. The laser beam leaving the exit hole is entered from a light entrance 31 located in the top of the case (process cartridge housing) of the process cartridge 2, or the case (photosensitive cartridge housing) 30 of the photosensitive cartridge 3, into the photosensitive drum 13 at the top of a circumferential area thereof, resulting in illumination of the photosensitive drum 13. Because of the illumination, the circumferential area of the photosensitive drum 13 is exposed according to the aforementioned print data, thereby to form on the photosensitive drum 13 an electrostatic latent image so as to reflect the print data.

As described later, a developer material (toner) is delivered from a developing roller 22 of the developer cartridge 4 to the photosensitive drum 13, and the developer material is attached to the aforementioned electrostatic latent image, resulting in development or visualization thereof. Accordingly, a visible image is formed on the photosensitive drum 13 via the developer material (toner), and the visible image is transferred onto a sheet P. The sheet P, after transfer, is fed into between a heat roller 15 of the fuser 5, and a pressure contact roller 16, whereby the sheet P is heat-fused. The sheet P is then outputted from a sheet exit path to the sheet exit tray 1*a*.

In the present embodiment, the process cartridge 2 is configured to include the photosensitive cartridge 3 at least incorporating the photosensitive drum 13, and the developer cartridge 4 at least incorporating the developing roller 22 as a developer device within a case 21 of the developer cartridge 4. The developer cartridge 4 is constructed so as to allow attachment to and detachment from the photosensitive cartridge 3, and such that the developing roller 22 is prevented because of the function of a locking mechanism 46 as described later, from an undesired disengagement from the case 21.

As illustrated in FIG. 4, the photosensitive drum 13 is rotatably supported within the case 30 made up of synthetic resin of the photosensitive cartridge 3, so as to be biased in position to one of opposite ends spaced apart from each other in a left and right direction in FIG. 4. The transfer roller 14 as a transfer device is disposed below the photosensitive drum 13. The transfer roller 14 is pressed at its top against the photosensitive drum 13, while the transfer roller 14 is covered at its underside with a bottom wall 30*a* of the case 30.

Figure 5:
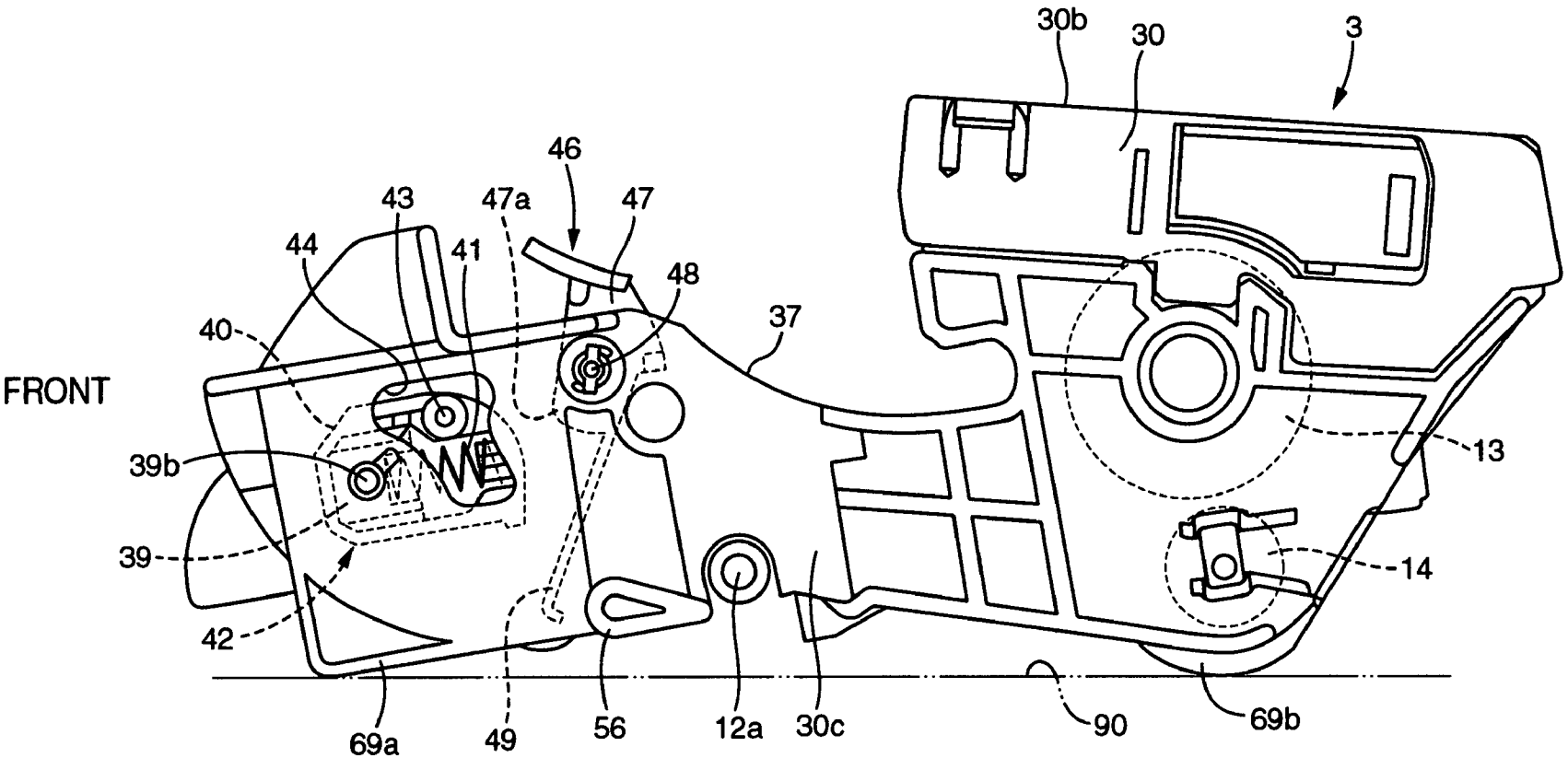
FIG. 5 is a right-hand side view illustrating the photosensitive cartridge indicated in FIG. 3.
Figure 6:
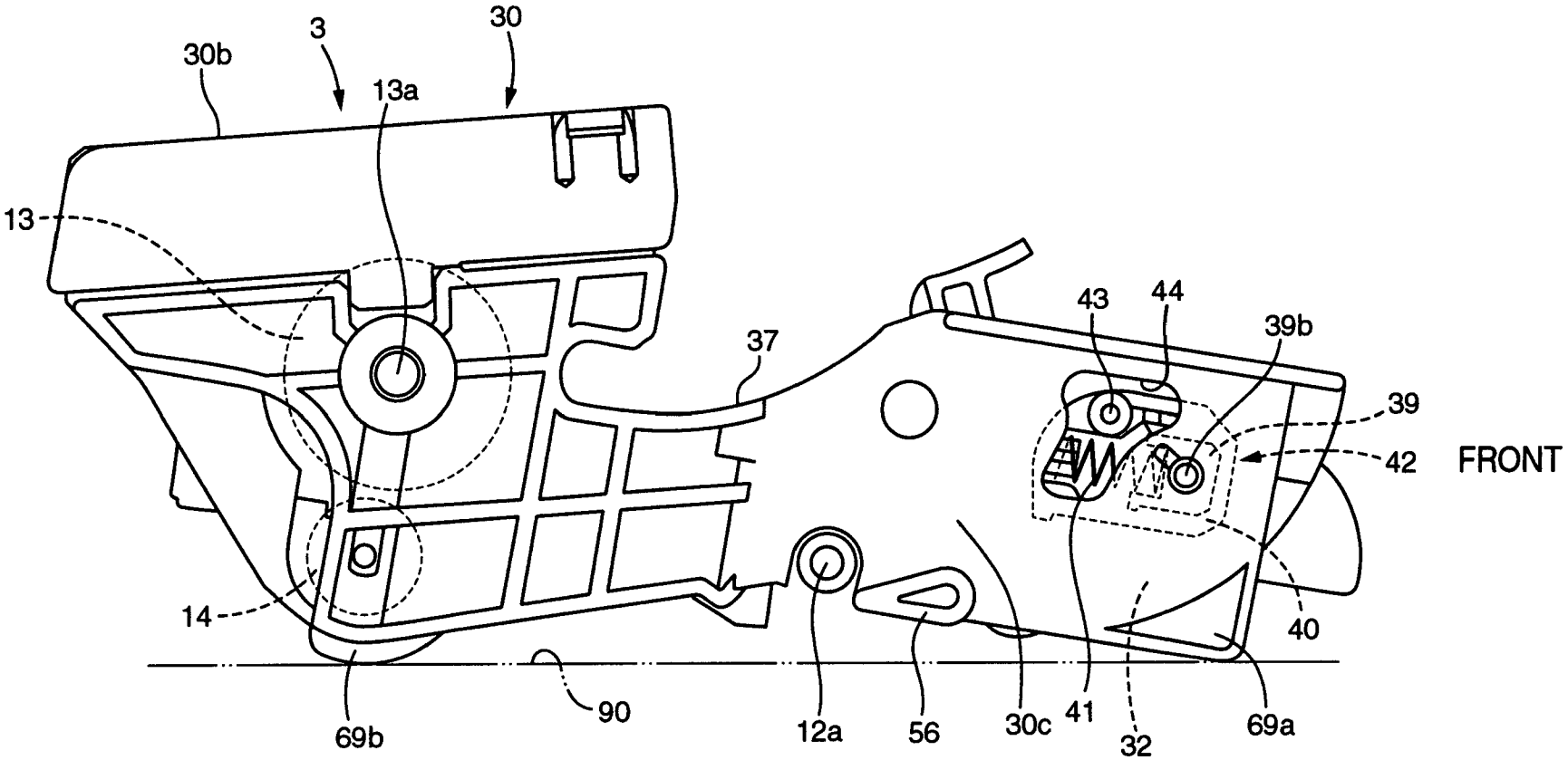
FIG. 6 is a left-hand side view illustrating the photosensitive cartridge indicated in FIG. 3.
Figure 7:
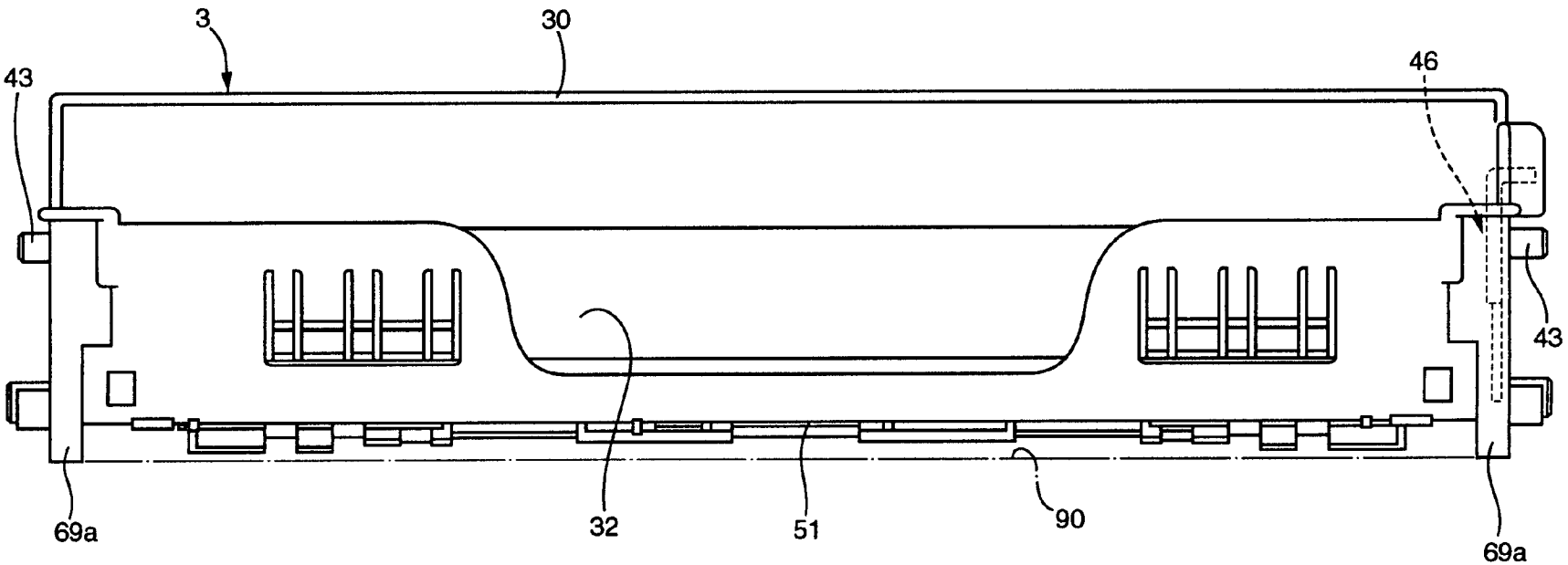
FIG. 7 is a front view illustrating the photosensitive cartridge indicated in FIG. 3.
Figure 8:
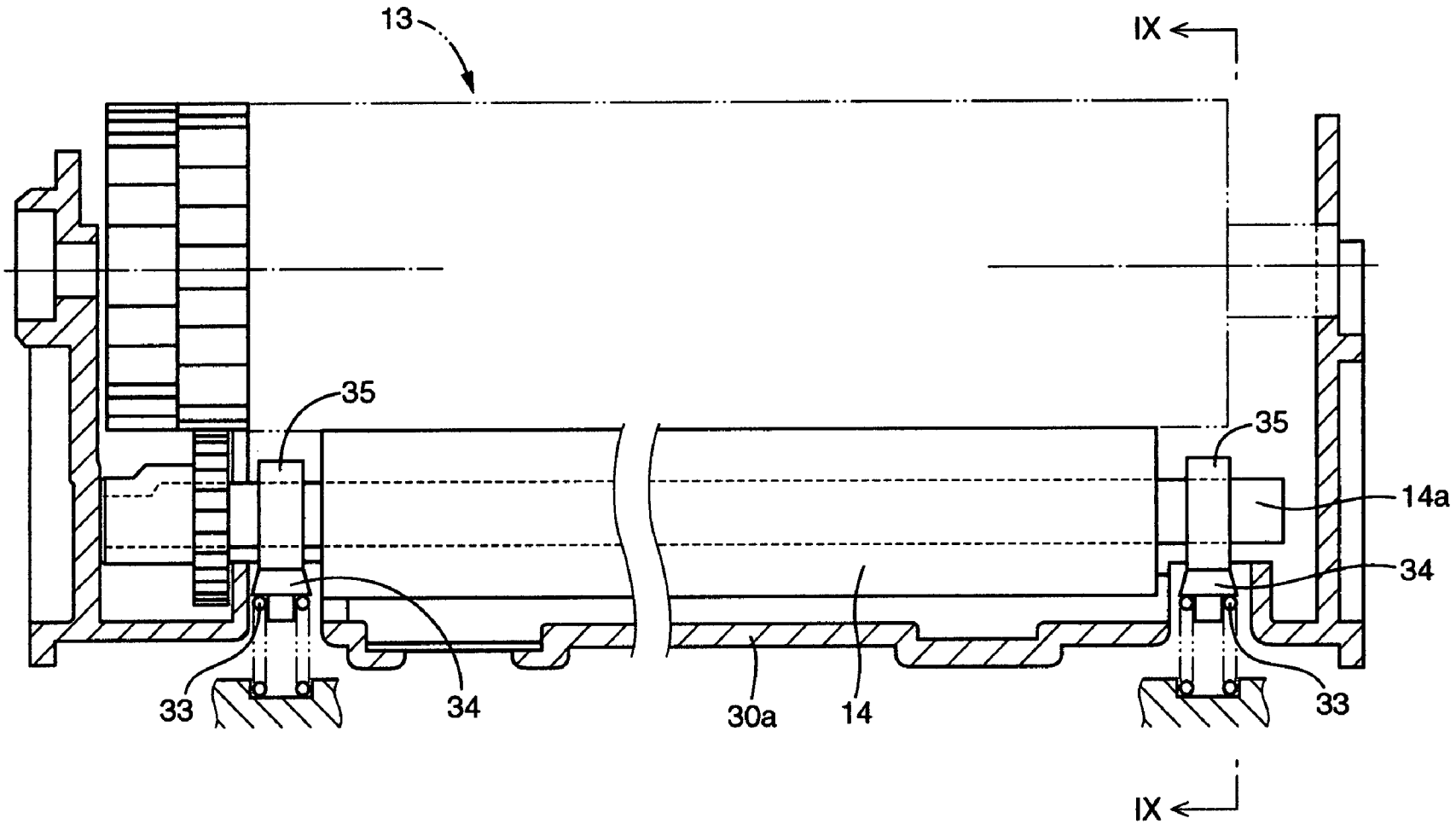
FIG. 8 is a partially sectional front view illustrating a photosensitive drum and a transfer roller both indicated in FIG. 4 in pressure contact.

FIG. 5 illustrates exclusively the photosensitive cartridge 3 in right-hand side view, while FIG. 6 illustrates exclusively the photosensitive cartridge 3 in left-hand side view. FIG. 7 illustrates exclusively the photosensitive cartridge 3 in front view. FIG. 8 illustrates the photosensitive drum 13 and the transfer roller 14 in pressure contact in front view.

The transfer roller 14 is supported movably up and down for allowing removal thereof from the underside of the photosensitive drum 13 because of the weight of the transfer roller 14.

More specifically, as illustrated in FIG. 8, two springs 33, 33 are disposed within the body housing 1, on the left- and right-hand sides of FIG. 8, respectively, and these springs 33, 33 bias two bearing raisers 34, 34 upwardly, respectively.

Upon attachment of the process cartridge 2 to the body housing 1, the two bearing raisers 34, 34 raise respective two bearings 35, 35 which are each upward-U-shaped and which are fitted with axially opposite ends of a transfer roller shaft 14*a* coaxial to the transfer roller 14. As a result, the transfer roller 14 is disposed movably up and down for allowing press against the photosensitive drum 13 in its underside (transfer area).

As illustrated in FIGS. 1, 3, and 4, the light entrance 31 allowing the laser beam from the laser scanner unit 7 to illuminate the photosensitive drum 13 at its top is formed in an upper wall 30*b* of the case 30 of the photosensitive cartridge 3 which covers the photosensitive drum 13 at its top, so as to be elongated in the axial direction of the photosensitive drum 13.

As illustrated in FIG. 4, a charger 36 such as of a scorotron type for charging a photosensitive surface such as an organic photoreceptor of the photosensitive drum 13 is attached to the case 30 so as to be located adjacent to the light entrance 31. In operation, once the surface of the photosensitive drum 13 which has been uniformly charged via the charger 36 is scanned with the laser beam, an electrostatic latent image is formed on the surface of the photosensitive drum 13. The electrostatic latent image, upon attachment thereto of the toner in the form of a thin layer supplied because of the developing roller 22, is changed to be a visible image (is developed). The visible image is subsequently transferred onto a sheet P, in a zone for transfer operation under pressure with the transfer roller 14.

As illustrated in FIGS. 3, 4, and 7, a portion of the case 30 exclusive of the upper wall 30*b* is open at its top, so as to be enclosed with left- and right-hand side walls 30*c*, 30*c* of the case 30 and the bottom wall 30*a* generally in the form of a quarter tube (one of four sections into which a single tube is sectioned circumferentially). Through the open top, the developer cartridge 4 is allowed to be inserted into the case 30 downwardly when going forward. Within the case 30, there is formed an accommodating area 32 for accommodating the developer cartridge 4 when inserted.

Figure 9A:
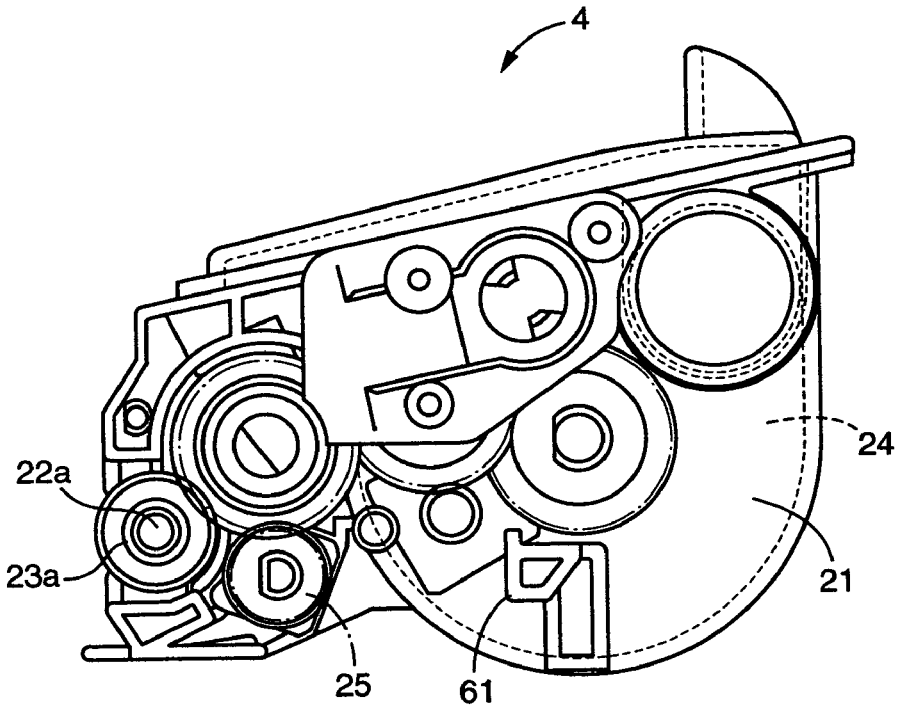
FIG. 9A is a left-hand side view illustrating a developer cartridge indicated in FIG. 2.
Figure 9B:
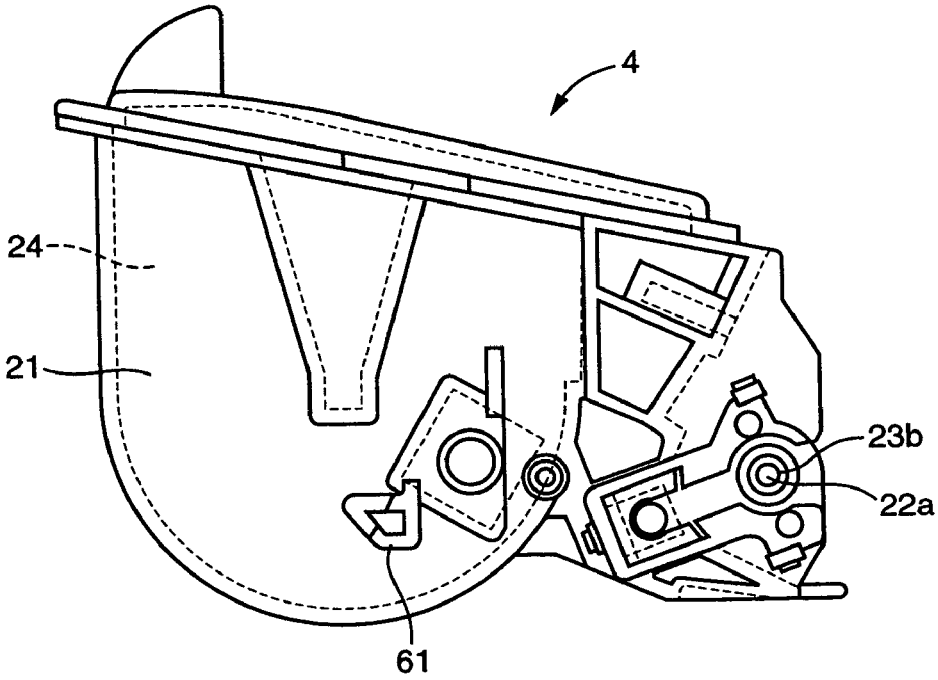
FIG. 9B is a right-hand side view illustrating the developer cartridge indicated in FIG. 2.
Figure 10:
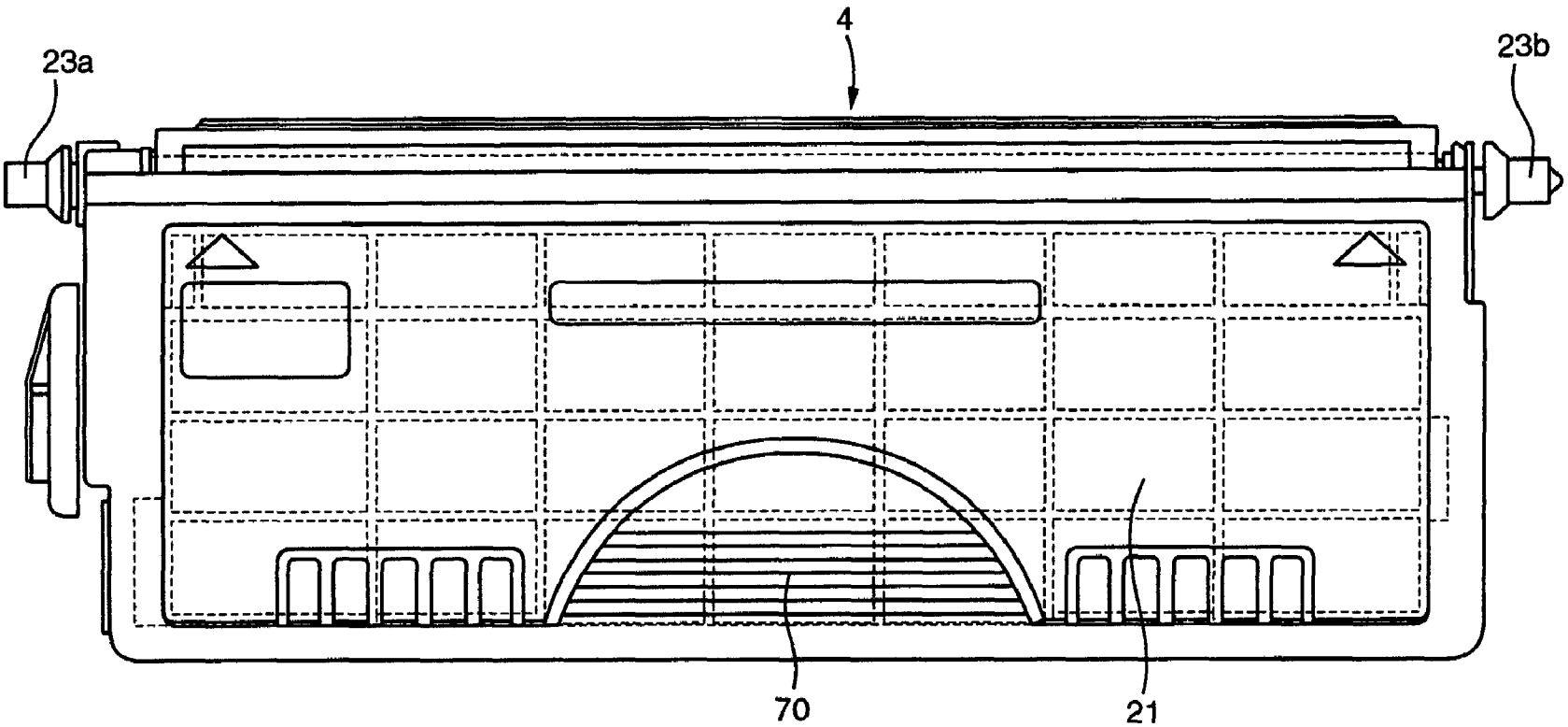
FIG. 10 is a top plan view illustrating the developer cartridge indicated in FIG. 2.
Figure 11:
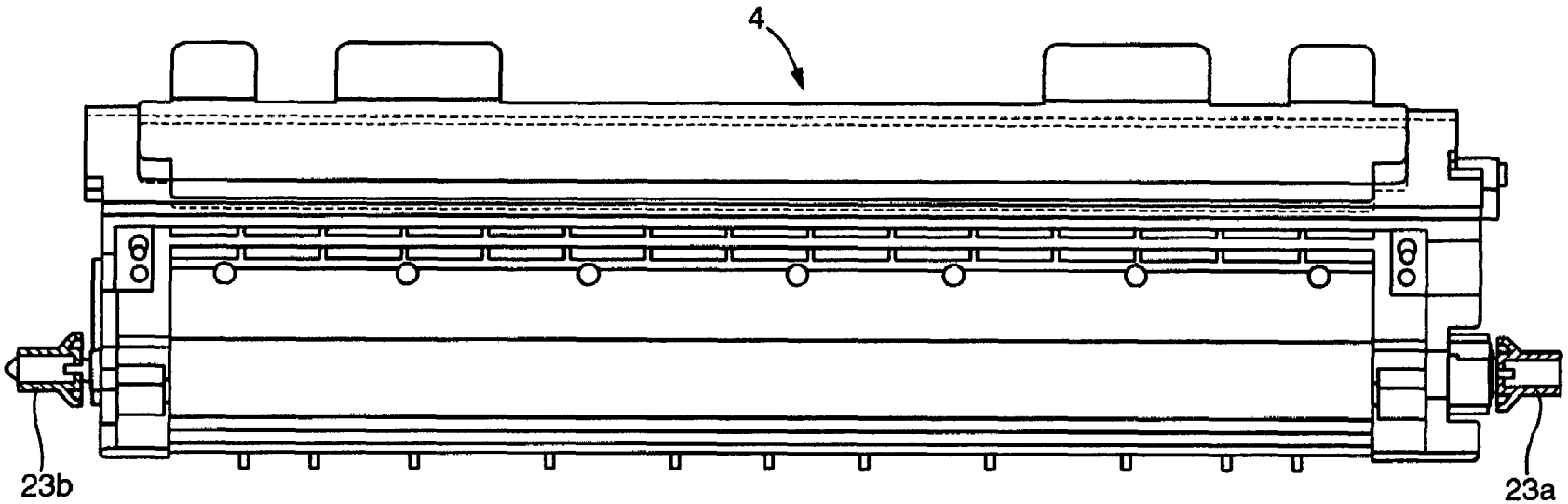
FIG. 11 is a rear view illustrating the developer cartridge indicated in FIG. 2.

FIG. 9A illustrates the developer cartridge 4 in left-hand side view, while FIG. 9B illustrates the developer cartridge 4 in right-hand side view. FIG. 10 illustrates the developer cartridge 4 in top plane view, while FIG. 11 illustrates the developer cartridge 4 in rear view. FIGS. 12-15 illustrate the process cartridge 2 when assembled in top plane view, right-hand side view, left-hand side view, and front view, respectively.

Figure 13:
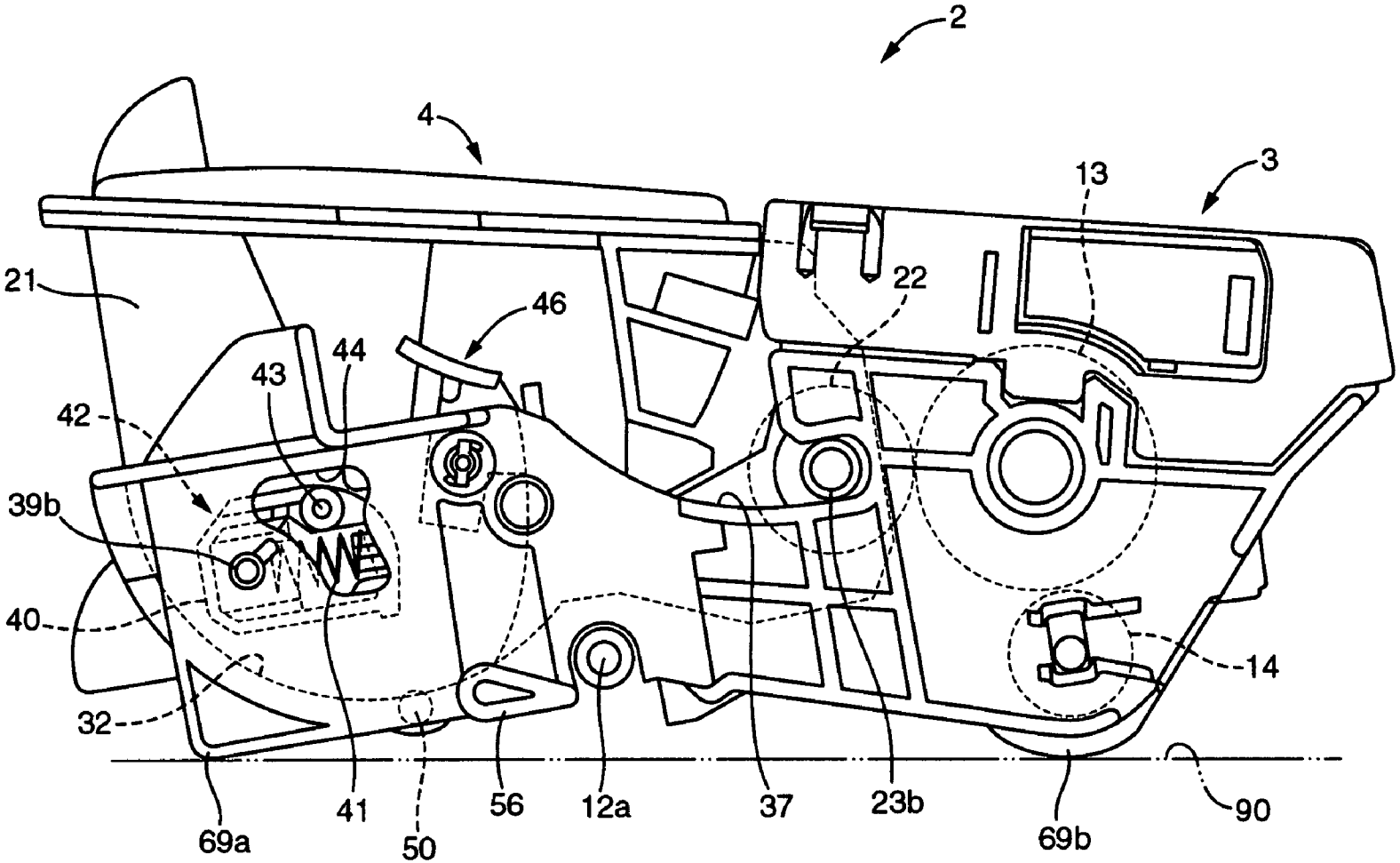
FIG. 13 is a right-hand side view illustrating the process cartridge indicated in FIG. 2.
Figure 14:
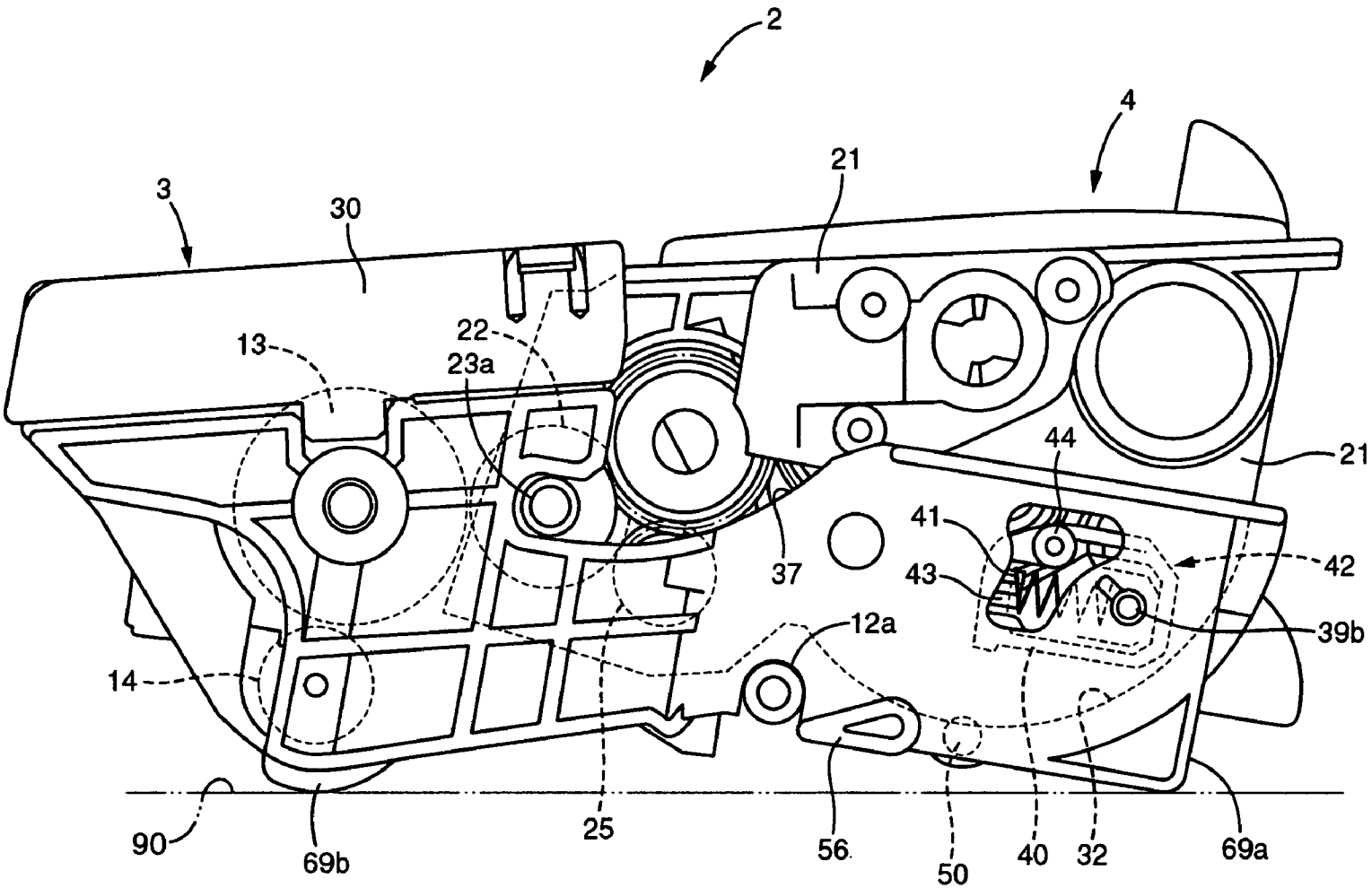
FIG. 14 is a left-hand side view illustrating the process cartridge indicated in FIG. 2.

As illustrated in FIGS. 10 and 11, two bearings 23*a* and 23*b* are rotatably supported at axially opposite ends of a developing roller shaft 22*a* coaxial with the developing roller 22, respectively. As illustrated in FIGS. 3, 13, and 14, a guide groove 37 is formed respectively at the top end faces of the laterally opposite side walls 30*c* and 30*c* of the case 30. Each guide groove 37, in the form of a downwardly-convex arc extending in the lateral direction of FIG. 13, is provided for guiding a corresponding one of the two bearings 23*a* and 23*b* while slidably supporting them.

Each guide groove 37 extends so as to approach a photosensitive drum shaft 13*a* coaxial with the photosensitive drum 13. Once the developer cartridge 4 is attached to the photosensitive cartridge 3, each guide groove 37 allows the developing roller 22 to move toward the photosensitive drum 13 in parallel thereto.

Figure 16A:
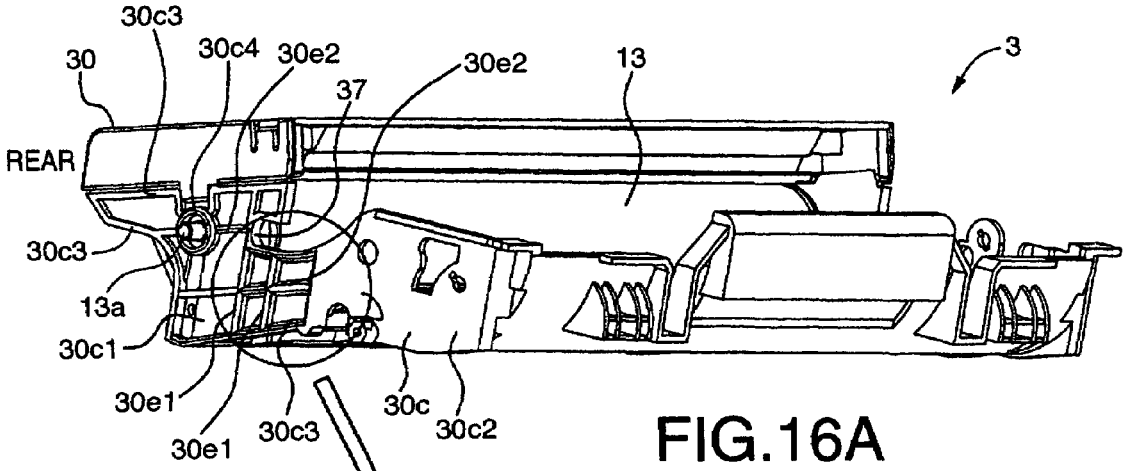
FIG. 16A is a perspective view illustrating the photosensitive cartridge indicated in FIG. 2.
Figure 16B:
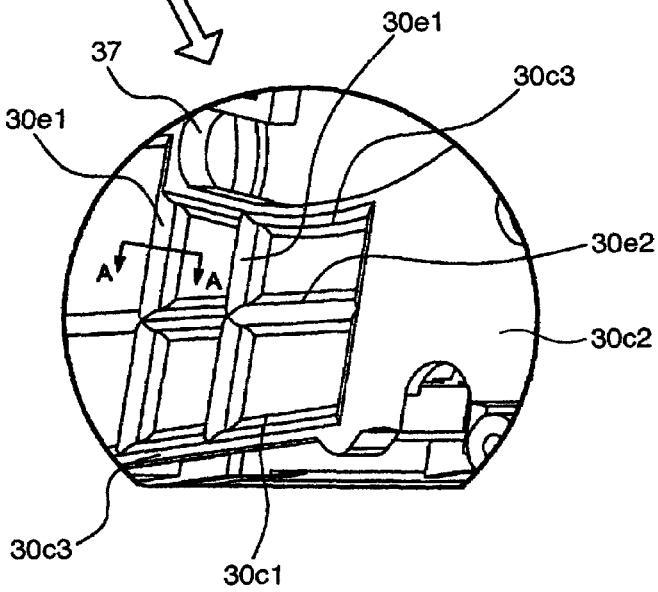
FIG. 16B is a partially enlarged view of FIG. 16A.
Figure 16C:
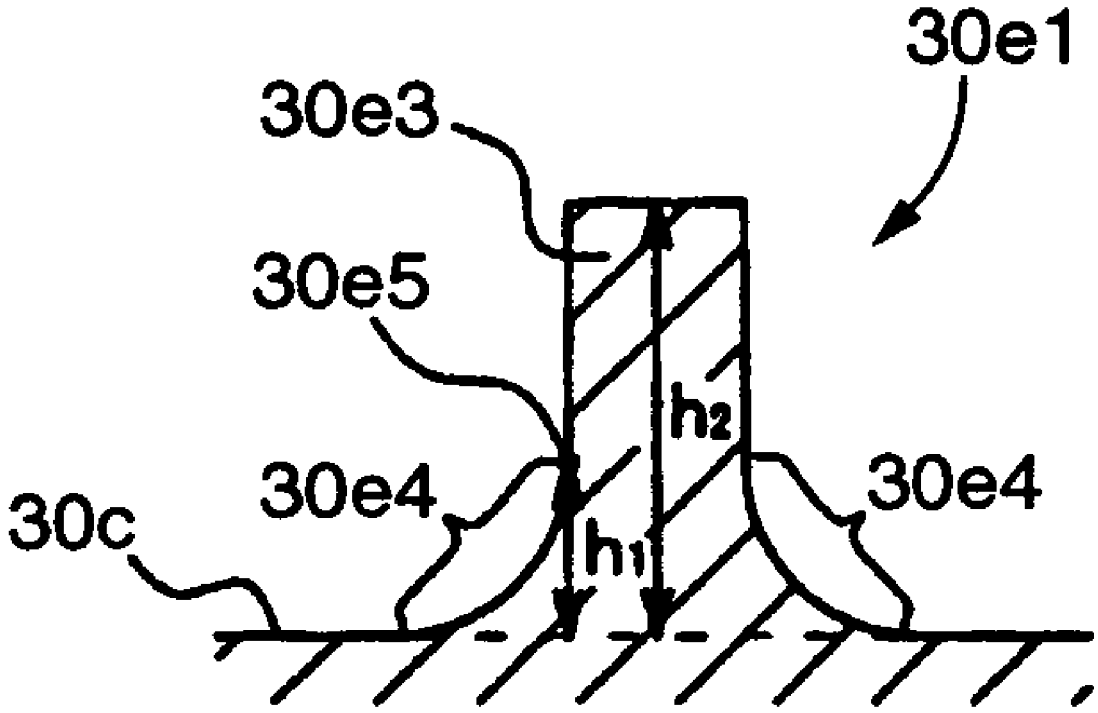
FIG. 16C is a cross section taken on line A-A in FIG. 16B.

FIG. 16A illustrates the photosensitive cartridge 3 in perspective view, FIG. 16B illustrates the circled area in FIG. 16B in enlargement, and FIG. 16C illustrates a cross section taken on line A-A in FIG. 16B.

As illustrated in FIG. 16A, each side wall 30*c* of the case (photosensitive cartridge housing) 30 is partitioned into a rear portion 30*c*1 of each side wall 30*c* located rearward from the guide groove 37 (leftward from the guide groove 37 in FIG. 16A), and a front portion 30*c*2 of each side wall 30*c* located forward from the guide groove 37 (rightward from the guide groove 37 in FIG. 16A). Each side wall 30*c* is stepped such that the surface of the rear portion 30*c*1 is lower in level than the surface of the front portion 30*c*2.

The rear portion 30*c*1 is surrounded at its peripheral circumference (exclusive of an area of the rear portion 30*c*1 which is connected with the front portion 30*c*2) with a ridge 30*c*3 protruded from the surface of the rear portion 30*c*1. In addition, the photosensitive drum shaft 13*a* is surrounded circumferentially with an annular ridge 30*c*4. The top faces of these ridges 30*c*3 and 30*c*4 are flush with the surface of the front portion 30*c*2.

As illustrated in FIGS. 16A and 16B, the rear portion 30*c*1 is provided with a rib set (protruding portions) 30*e* for reinforcement of the case 30. The rib set 30*e* is comprised of two ribs 30*e*1 and 30*e*1 each crossing vertically the rear portion 30*c*1, and two ribs 30*e*2 and 30*e*2 each crossing horizontally the rear portion 30*c*1. These ribs 30*e*1, 30*e*1, 30*e*2, and 30*e*2 are disposed in a latticed formation. The upper one of the two ribs 30*e*2 and 30*e*2 is divided into two with the ridge 30*c*4.

As illustrated in FIG. 16C, the cross sectional profile of each rib 30*e*1 is generally in the form of a plate having at least one fillet portion. More specifically, the cross sectional profile of each rib 30*e*1 is comprised of a flat-plate-like protruding portion 30*e*3 protruding from the side wall 30*c* at a right angle thereto, and fillet portions 30*e*4 and 30*e*4 each connecting the protruding portion 30*e*3 and the side wall 30*c* which servers as a smoothed surface portion.

It is added that the cross sectional profile of each rib 30*e*1 can be considered to be comprised of a straight portion 30*e*3 extending perpendicularly to the side wall 30*c*, and connecting portions 30*e*4 and 30*e*4 each connecting the straight portion 30*e*3 and the side wall 30*c* which serves as a smoothed surface portion, using continuous concave surfaces.

The ratio of a height h1 of an upper end point 30*e*5 of each fillet portion 30*e*4 (the termination point of each fillet portion 30*e*4) from the surface of the side wall 30*c*, to a total height h2 of the rib 30*e*1 (the height of the protruding portion 30*e*3 from the surface of the side wall 30*c*) is 1 to 3. The radius of curvature of each fillet portion 30*e*4 is 2 mm. Each rib 30*e*2 is equivalent in the cross sectional profile to each rib 30*e*1.

An area of the case 30 to which the rib set 30*e* is assigned is equal to an area of the case 30 on which stresses are easily loaded from the photosensitive drum 13 and the transfer roller 14. An example of such an area is identical with or near an area of an outer surface of each side wall 30*c*, 30*c* which is overlapped with the photosensitive drum 13 and the transfer roller 14 when they are projected in their axial directions onto the outer surface.

As illustrated in FIG. 4, there is mounted on an inner surface of each side wall 30*c* of the case 30 of the photosensitive cartridge 30, a pressing mechanism 42 for allowing the developing roller 22 to be pressed against the photosensitive drum 13 via the developer cartridge 4. The pressing mechanism 42 is reciprocally rotatable and expandable.

As illustrated in FIG. 4, the pressing mechanism 42 includes a pivot support member 39. The pivot support member 39 is equipped with pivot shafts 39*a* and 39*b* (in FIG. 4, only the pivot shaft 39*b* is visible, while the opposite pivot shaft 39*a* is hidden and invisible), which are disposed on the left- and right-hand sides, respectively, and are protruded from the pivot support member 42 oppositely coaxially and integrally.

The pressing mechanism 42 further includes a hollow frame-like slidably-supporting member 40. The slidably-supporting member 40 supports slidably the pivot support member 39 within the slidably-supporting member 40. The pressing mechanism 42 further includes a coil-like biasing spring 41 disposed within the slidably-supporting member 40 for biasing the pivot support member 39 in a unidirectional pressing fashion.

As illustrated in FIGS. 3, 5, and 6, the slidably-supporting member 40 is provided with a movable portion 43 in the form of a laterally-extending cylinder. The movable portion 43 is disposed in the slidably-supporting member 40 so as to be protruded outwardly through a guide hole 44 piercing through each side wall 30*c*.

As illustrated in FIGS. 4, 5, and 7, a locking mechanism 46 is disposed inside one of the opposite side walls 30*c* and 30*c* of the photosensitive cartridge 3 (the one side wall 30*c* located on the right-hand side of FIG. 7, for the present embodiment), for preventing an undesired upward removal of the developer cartridge 4 from the accommodating area 32 after inserted thereinto.

As illustrated in FIGS. 4 and 5, the locking mechanism 46 includes a lock lever 47 which is reciprocally rotatably supported at its lateral area by a rotating shaft 48 penetrating through the sidewall 30*c*. The locking mechanism 46 further includes a resin-made spring 49 extending downwardly from the bottom of the lock lever 47. The resin-made spring 49 is disposed for allowing its bottom end or near to abut a regulator piece 30*d* upwardly protruding from the bottom wall 30*a* of the case 30.

As illustrated in FIG. 4, the locking mechanism 46 further includes an arc-shaped abutment portion 47*a* formed on the underside of the lock lever 47. As described later, engaging portions 61 and 61 each generally shaped as an inverted triangular as viewed laterally are protruded outwardly from left- and right-hand side walls of the case 21 of the developer cartridge 4, respectively. Once a selected one of these engaging portions 61 and 61 (the one engaging portion 61 located on the right-hand side of the printer, for the present embodiment) attempts to move upwardly in FIG. 4, the selected engaging portion 61 is brought into abutment with the abutment portion 47*a*, whereby the abutment portion 47*a* prevents advancement in movement of the selected engaging portion 61.

The selected engaging portion 61 is employed not only in an application in which, the selected engaging portion 61 plays a role of a component of the locking mechanism 46, and therefore prevents the developer cartridge 4 once inserted into the accommodating area 32 from being upwardly removed, but also in an application in which the selected engaging portion 61 biases the developing roller 22 against the photosensitive drum 13 in a pressing fashion.

As illustrated in FIGS. 3 and 4, the accommodating area 32 of the photosensitive cartridge 3 is provided with rotatable rollers 50, which each function as a receiver member, which are upwardly protruded from the bottom wall 30*a* of the case 30, and which are located at a plurality of sites (two sites on each of the left- and right-hand lateral ends, for the present embodiment).

Once the developer cartridge 4 has been inserted downwardly into the accommodating area 32 for storage of the developer cartridge 4, these rollers 50 bear partially the weight of the developer cartridge 4, with these rollers 50 being located on the opposite side to that of the photosensitive drum 13, and supporting the developing roller shaft 22*a* at its axially opposite ends.

More specifically, as illustrated in FIGS. 4, 9A, and 9B, each roller 50 receives a portion of the case 21 of the developer cartridge 4 at its underside, which forms a toner storage chamber 24 and which has a downwardly convex curved area, and each roller 50 eliminates a rattle of the case 21 in an attachment or detachment event.

As illustrated in FIG. 4, the upper registration roller 12*a* is mounted in an anti-drop manner on the bottom wall 30*a* of the case 30 of the photosensitive cartridge 3. Adjacent to the registration roller 12*a*, a laterally elongated introduction hole 51 is formed in the bottom wall 30*a*, which allows a sheet P upon a delivery to and a pass through the paired registration rollers 12*a* and 12*b* to enter a transfer area 52 between the photosensitive drum 13 and the transfer roller 14.

An area on an upper surface of the bottom wall 30*a*, which is adjacent to the introduction hole 51, and which extends up to the transfer area 52 functions as a portion of a path along which a sheet P (recording medium) is transported, with the process cartridge 2 attached to the body housing 1.

Figure 17A:
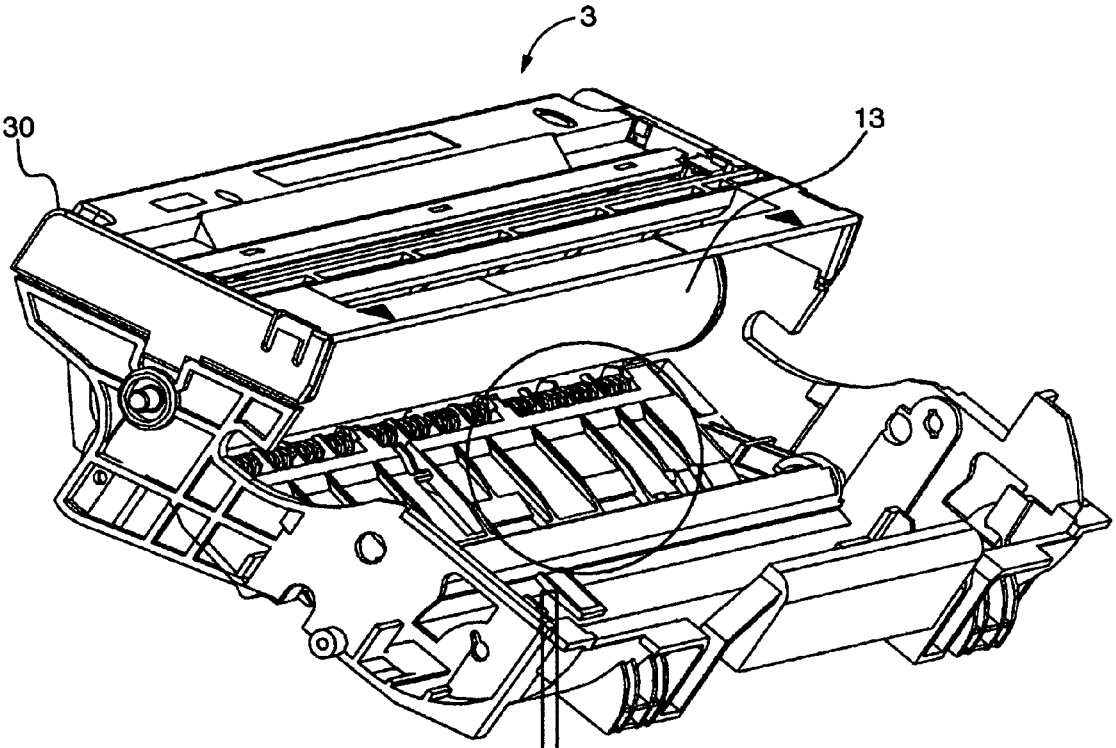
FIG. 17A is a perspective view illustrating the photosensitive cartridge indicated in FIG. 2.
Figure 17B:
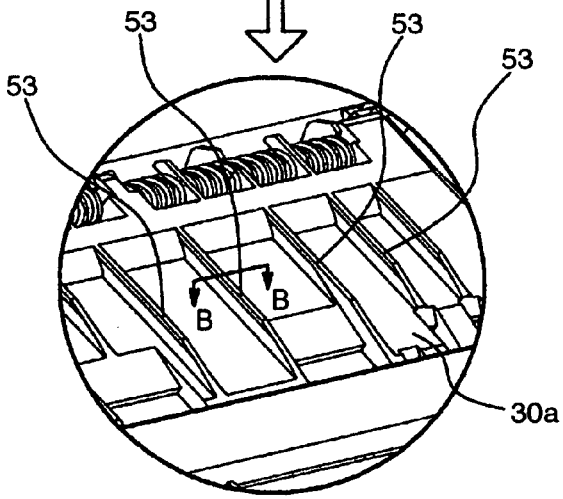
FIG. 17B is a partially enlarged view of FIG. 17A.

As illustrated in FIGS. 4, 17A, and 17B, a multiplicity of protruded ribs (protruding portions) 53 are formed on the upper surface of the bottom wall 30*a*, so as to coextend from the introduction hole 51 toward the transfer area 52, for allowing a smoothed transport of a sheet P because of a reduction in resistance of the upper surface of the bottom wall 30*a* in contact with the underside of the sheet P.

Figure 17C:
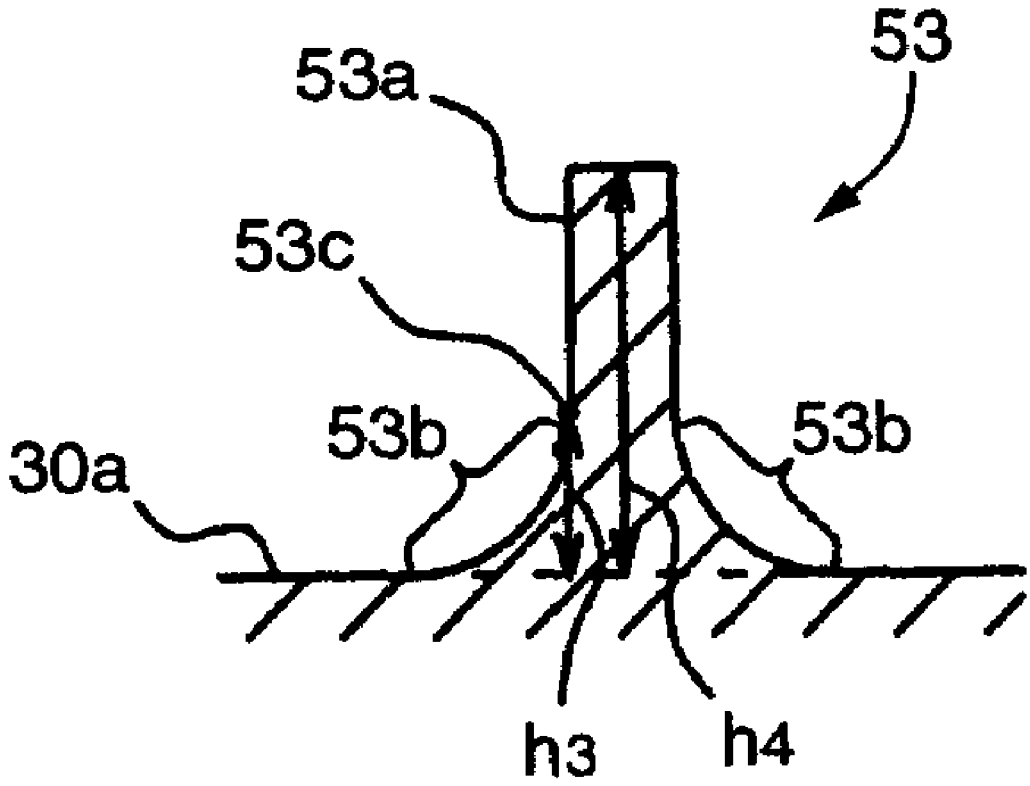
FIG. 17C is a cross section taken on line B-B in FIG. 17B.

As illustrated in cross section in FIG. 17C, the cross sectional profile of each rib 53 is generally in the form of a plate having at least one fillet portion. More specifically, the cross sectional profile of each rib 53 is comprised of a flat-plate-like protruding portion 53*a* protruding from the bottom wall 30*a* at a right angle thereto, and fillet portions 53*b* and 53*b* each connecting the protruding portion 53*a* and the bottom wall 30*a* which servers as a smoothed surface portion.

It is added that the cross sectional profile of each rib 53 can be considered to be comprised of a straight portion 53*a* extending perpendicularly to the bottom wall 30*a*, and connecting portions 53*b* and 53*b* each connecting the straight portion 53*a* and the bottom wall 30*a* which serves as a smoothed surface portion, using continuous concave surfaces.

The ratio of a height h3 of an upper end point 53*c* of each fillet portion 53*b* (the termination point of each fillet portion 53*b*) from the surface of the bottom wall 30*a*, to a total height h4 of the rib 53 (the height of the protruding portion 53*a* from the surface of the bottom wall 30*a*) is 1 to 3 or 1 to 2 (variable dependent upon the lateral position of each rib 53). The radius of curvature of each fillet portion 53*b* is 2 mm.

Next, the construction of the developer cartridge 4 will be described in greater detail with reference to FIGS. 1, 9A, 9B, 10, and 11.

As illustrated in FIG. 1, an agitator 27 is disposed within the toner storage chamber 24, which is formed within the case 21 of the developer cartridge 4 and which has a downwardly convex curved area. The agitator 27, because of its rotational motion, agitates the toner in the toner storage chamber 24 and delivers it.

As illustrated in FIG. 1, the delivered toner is subsequently supplied via a supply roller 25 to an outer circumference of the developing roller 22 and is carried thereon. The thickness of the toner carried on the outer circumference of the developing roller 22 is regulated with a blade 26. As illustrated in FIGS. 9A and 9B, the engaging portions 61 and 61 are formed on a portion of the case 21 forming the toner storage chamber 24 at its lateral opposite outsides, respectively, such that each engaging portion 61 is integral with and is protruded from the portion of the case 21.

Figure 12:
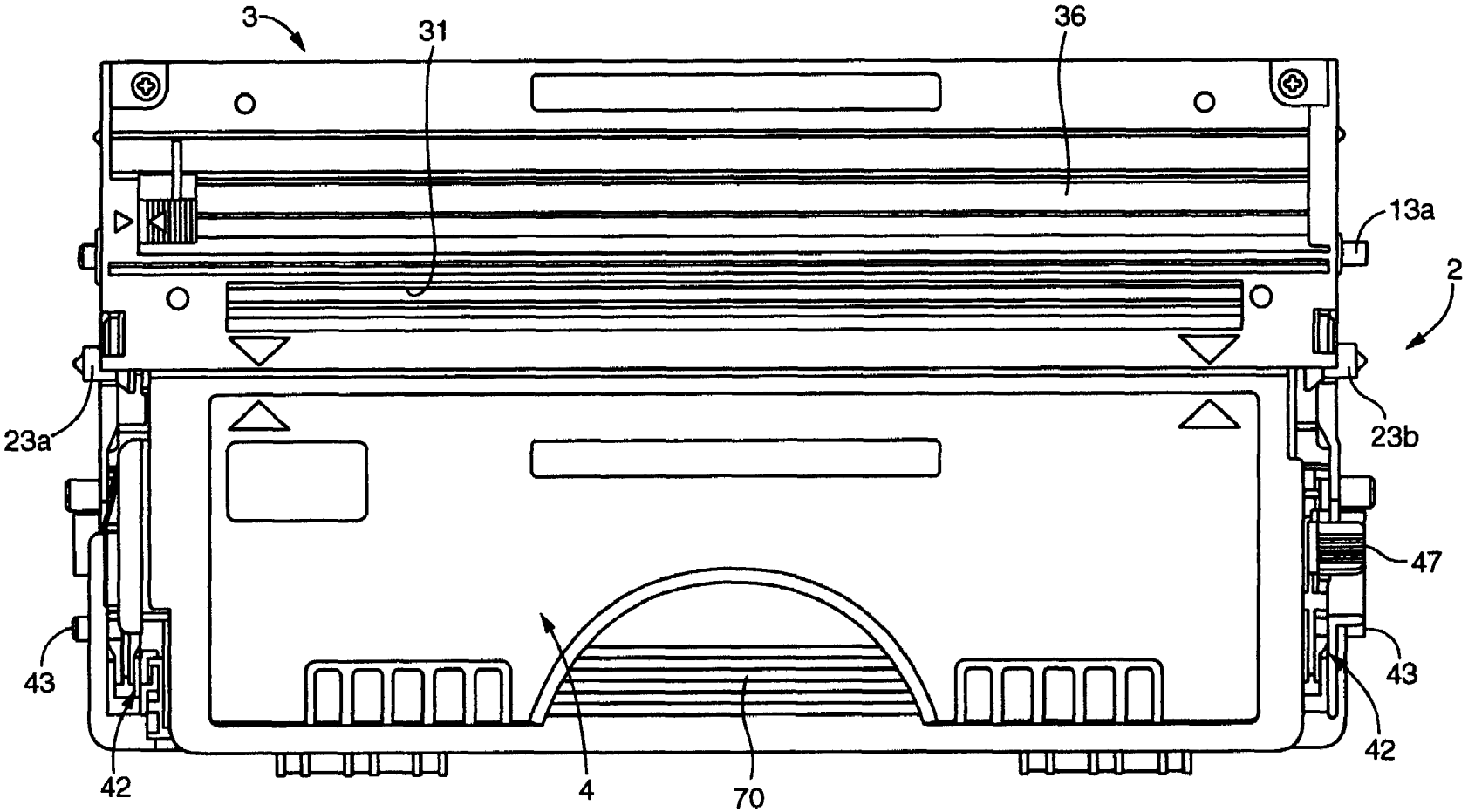
FIG. 12 is a top plan view illustrating the process cartridge indicated in FIG. 2.
Figure 15:
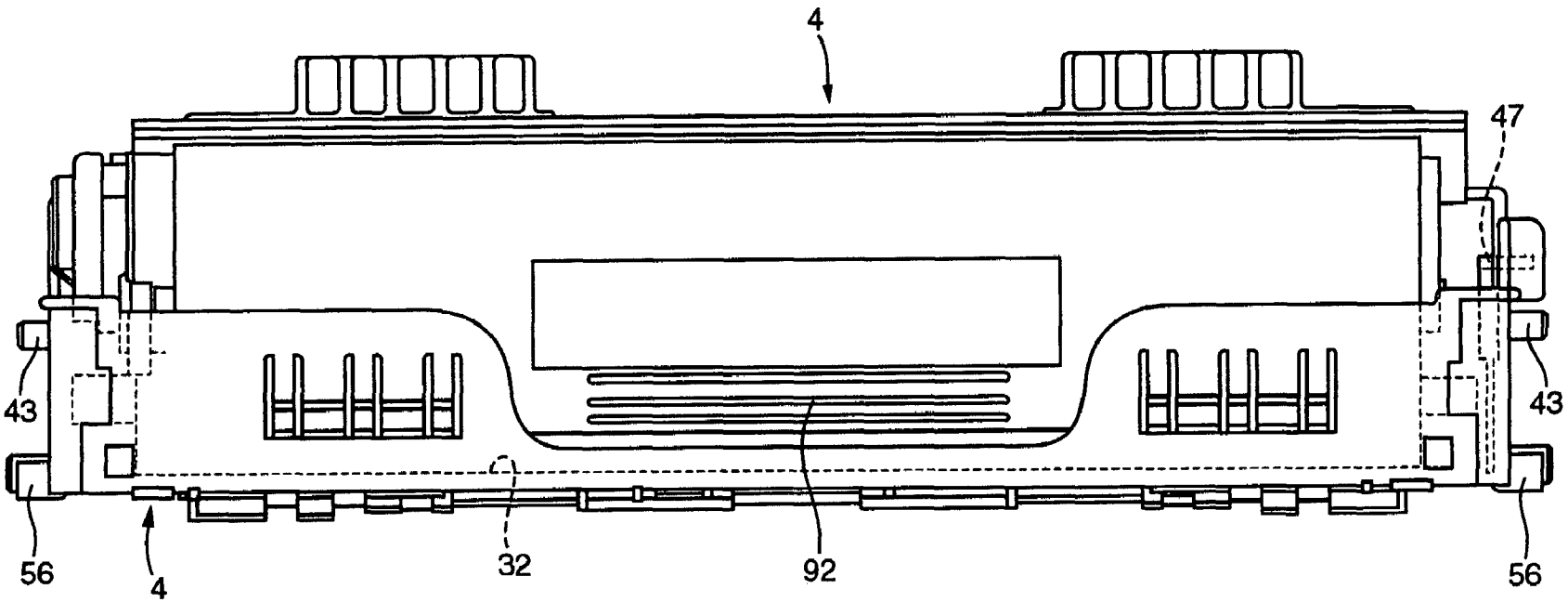
FIG. 15 is a front view illustrating the process cartridge indicated in FIG. 2.

As illustrated in FIGS. 10, 12, and 15, grips 70 and 92 are provided on the top and the underside of the case 21 of the developer cartridge 4, respectively, both for the convenience of the handling of the developer cartridge 4 such as a carrying action. Each grip 70, 92 has an irregular surface in which a plurality of laterally coextending crests and a plurality of laterally coextending valleys are aligned alternately.

As illustrated in FIGS. 5-7, 13, and 14, for allowing the photosensitive cartridge 3 to be stably placed on a table 90, with the accommodating area 32 of the photosensitive cartridge 3 accommodating or not accommodating the developer cartridge 4, a plurality of contacts 69*a* and 69*b* are provided on the underside of the case 30 of the photosensitive cartridge 3, at different positions (at least two positions, and preferably four positions).

The process cartridge 2 according to the present embodiment provides the following effects:

As illustrated in FIG. 16C, the rib set 30*e* included in the process cartridge 2 is connected to the side wall 30*c* via the fillet portions 30*e*4 and 30*e*4. The height h1 of each fillet portion 30*e*4 is equal to one-third times the total height h2 of the rib set 30*e*, meaning that each fillet portion 30*e*4 extends over a larger area in the height direction of the protruding portion 30*e*3, and the radius of curvature of each fillet portion 30*e*4 is as large as 2 mm.

Further, as illustrated in FIG. 17C, each rib 53 included in the process cartridge 2 is also connected to the bottom wall 30*a* via the fillet portions 53*b* and 53*b*. The height h3 of each fillet portion 53*b* is equal to one-half times or one-third times (variable dependent upon the lateral position of each rib 53*b*) the total height h4 of each rib 53, meaning that each fillet portion 53*b* extends over a larger area in the height direction of the protruding portion 53*a*, and the radius of curvature of each fillet portion 53*b* is as large as 2 mm.

For the above reasons, the present embodiment allows both the rib set 30*e* and the plurality of ribs 53 to incorporate neither a site which is easily filled with dirt such as toner nor a site having an excessively bent surface. Therefore, the present embodiment, even though dirt such as toner is attached to the process cartridge 2, allows the operator to easily remove such dirt from the process cartridge 2.

As a result, the present embodiment achieves a more accurate and easier cleaning of the process cartridge 2 required for recycling the process cartridge 2.

As will be evident from the above explanation, in the present embodiment, the rib set 30*e* and the rib 53 each constitute an example of the "structure" set forth in the above mode (1).

Next, a second embodiment of the present invention will be described with reference to FIGS. 18A and 18B.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

Figure 18A:
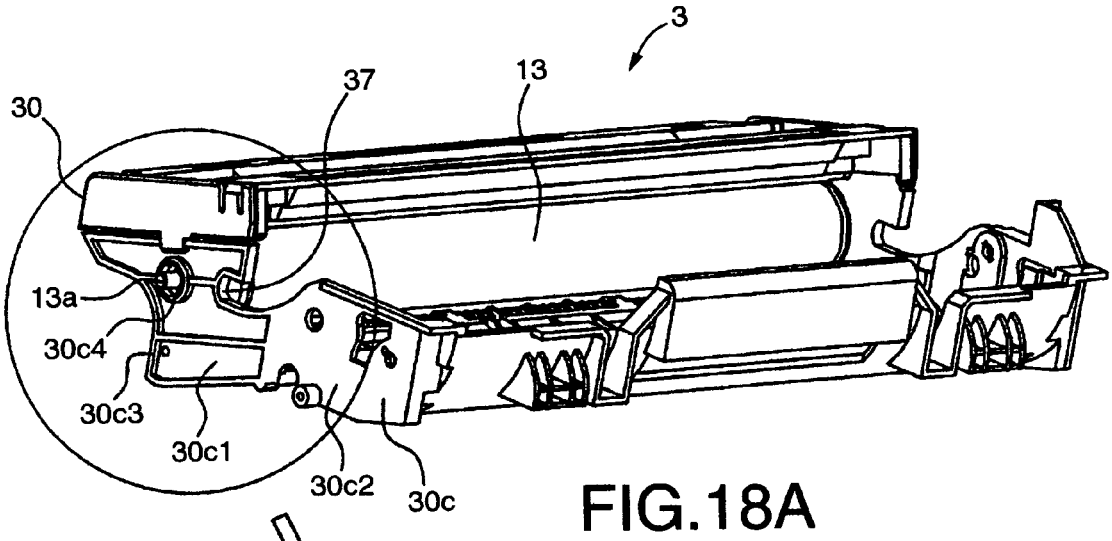
FIG. 18A is a perspective view illustrating a process cartridge constructed according to a second embodiment of the present invention.
Figure 18B:
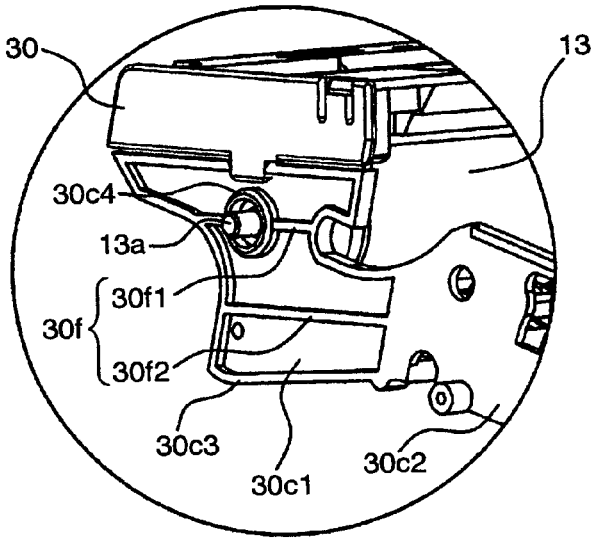
FIG. 18B is a partially enlarged view of FIG. 18A.

As illustrated in perspective view in FIG. 18A and in partially enlarged view in FIG. 18B, in the photosensitive cartridge 3 according to the present embodiment, a rib set 30*f* provided in the side wall 30*c* of the case 30 is comprised of two ribs 30*f*1 and 30*f*2 each crossing horizontally the rear portion 30*c*1 of the side wall 30*c*.

The rib 30*f*1 is located approximately one-third times the entire vertical length of the rear portion 30*c*1 downwardly away from the top of the rear portion 30*c*1, and is partitioned in two by means of the ridge 30*c*4 surrounding the developing roller shaft 13*a*. On the other hand, the rib 30*f*2 is located approximately two-third times the entire vertical length of the rear portion 30*c*1 downwardly away from the top of the rear portion 30*c*1.

An area of the case 30 to which the rib set 30*f* is assigned is equal to an area of the case 30 on which stresses are easily loaded from the photosensitive drum 13 and the transfer roller 14. An example of such an area is identical with or near an area of an outer surface of each side wall 30*c*, 30*c* which is overlapped with the photosensitive drum 13 and the transfer roller 14 when they are projected in their axial directions onto the outer surface.

The ribs 30*f*1 and 30*f*2 are disposed to coextend in parallel (such that the distance therebetween is kept unchanged), resulting in no formation of a closed area on the side wall 30*c* by these two ribs 30*f*1 and 30*f*2.

The process cartridge 2 according to the present embodiment, because of no intersection in the rib set 30*f* on the side wall 30*c*, creates no site having a surface shape making it more difficult to remove dirt such as toner therefrom, resulting in an easier removal of dirt.

More specifically, if the rib set 30*f* has an intersection between the two ribs 30*f*1 and 30*f*2, then a narrow clearance gap or an angular corner or nook is created at the intersection. Dirt, once attached to the narrow clearance gap or the angular corner or nook, is difficult to be removed, for the reason that a physical access to the dirt is difficult, and that the ribs 30*f*1 and 30*f*2 prevent the dirt from being swept out, for example.

On the other hand, the process cartridge 2 according to the present embodiment, because of no intersection between the ribs 30*f*1 and 30*f*2, makes it easier to remove dirt from the side wall 30*c*.

In particular, the present embodiment, owing to the parallelism between the ribs 30*f*1 and 30*f*2, makes it far easier to remove dirt from the side wall 30*c* by an approach such as brushing the dirt away from the side wall 30*c* along these ribs 30*f*1 and 30*f*2.

Additionally, the process cartridge 2 according to the present embodiment, because of the rib set 30*f* not being formed endless (e.g., in circle) on the side wall 30*c*, creates no area surrounded with the rib set 30*f* on the side wall 30*c*. Therefore, the process cartridge 2 facilitates a removal of dirt such as toner from the side wall 30*c*.

More specifically, if an area surrounded with the rib set 30*f* on the side wall 30*c*, then dirt, once attached to such an area, is difficult to be removed, for the reason that the rib set 30*f* prevents the dirt from being swept out, for example.

On the other hand, the process cartridge 2 according to the present embodiment, because of no area surrounded with the rib set 30*f* on the side wall 30*c*, makes it easier to remove dirt from the side wall 30*c*.

As will be evident from the above explanation, in the present embodiment, the rib set 30*f* and the rib 53 each constitute an example of the "structure" set forth in the above mode (1), and the ribs 30*f*1 and 30*f*2 constitute an example of the "plurality of ridges" set forth in the above mode (4).

It is added that, in the present embodiment, the cross sectional profile of each rib 30*f*1, 30*f*2, although may be such that a plate-like protrusion is simply protruded from the rear portion 30*c*1 of the side wall 30*c* without any fillet portion, is preferably such that, similarly with the first embodiment, a plate-like protrusion is smoothly connected with the rear portion 30*c*1 using a fillet portion.

Next, a third embodiment of the present invention will be described with reference to FIGS. 19A and 19B.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

Figure 19A:
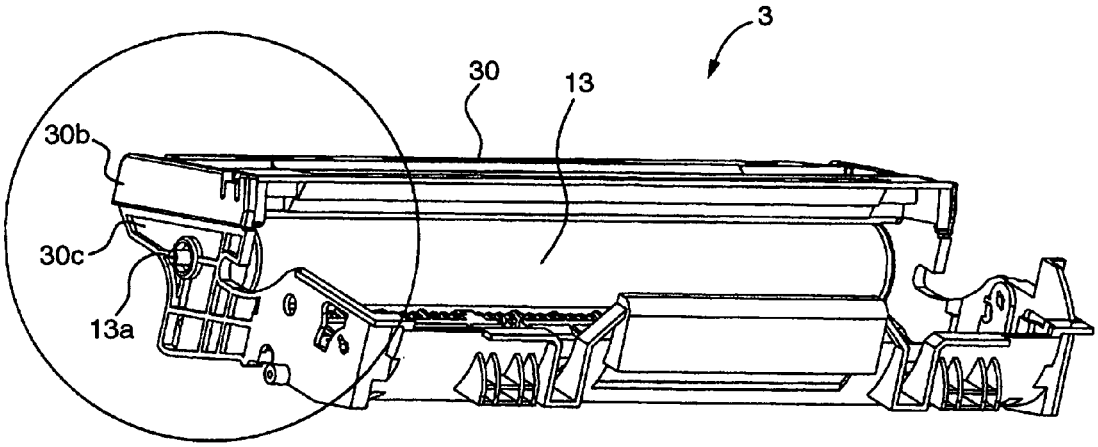
FIG. 19A is a perspective view illustrating a process cartridge constructed according to a third embodiment of the present invention.

As illustrated in perspective view in FIG. 19A, in the photosensitive cartridge 3 according to the present embodiment, the case 30 is constructed, similarly with the first embodiment, to include a plurality of members such as the bottom wall 30*a* (see FIG. 4), the upper wall 30*b*, and the left- and right-hand side walls 30*c* and 30*c*.

More specifically, each side of the case 30 (which supports the photosensitive drum shaft 13*a*) has vertically adjacent two sections, i.e., an upper section generally occupying the uppermost one of three equally-sized vertical divisions of the aforementioned each side of the case 30 and a remaining section. Each side of the case 30 is constructed, such that the upper section is formed with the upper wall 30*b*, while the remaining section is formed with a corresponding one of the opposite side walls 30*c* and 30*c* (hereinafter, referred to simply as "side wall 30*c*").

Figure 19B:
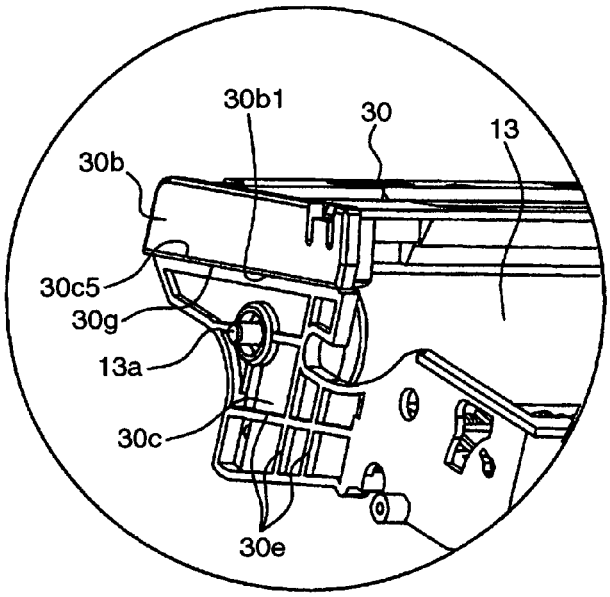
FIG. 19B is a partially enlarged view of FIG. 19A.

Therefore, as illustrated in partially enlarged view in FIG. 19B, in each side of the case 30, a lower end of the upper wall 30*b* and an upper end 30*c*5 of the side wall 30*c* abut each other, resulting in the formation of a seam 30*g*.

In the present embodiment, the seam 30*g* is formed on each side of the case 30 so as to pass therethrough edge-to-edge along a horizontal straight line. Further, in the present embodiment, the upper wall 30*b* and the side wall 30*c* are disposed to be flush with each other, with the seam 30*g* being interposed between the upper wall 30*b* and the side wall 30*c*.

In the process cartridge 2 according to the present embodiment, the seam 30*g* formed with and between the upper wall 30*b* and the side wall 30*c* is straight, and the upper wall 30*b* and the side wall 30*c* are flush with each other so as to together interpose the seam 30*g*.

Therefore, the present embodiment allows each side of the case 30 to be cleaned such that brushing each side of the case 30 along the seam 30*g* easily removes dirt such as toner from the seam 30*g*.

As will be evident from the above explanation, in the present embodiment, the upper wall 30*b*, the side wall 30*c*, and the seam 30*g* together constitute an example of the "structure" set forth in the above mode (1), and the upper wall 30*b* and the side wall 30*c* together constitute an example of the "two adjacent members" set forth in the above mode (8).

It is added that, in the present embodiment, the cross sectional profile of the rib set 30*e*, although may be such that a plate-like protrusion is simply protruded from the side wall 30*c* without any fillet portion, is preferably such that, similarly with the first embodiment, a plate-like protrusion is smoothly connected with the side wall 30*c* using a fillet portion.

Next, a fourth embodiment of the present invention will be described with reference to FIGS. 20A and 20B.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

Figure 20A:
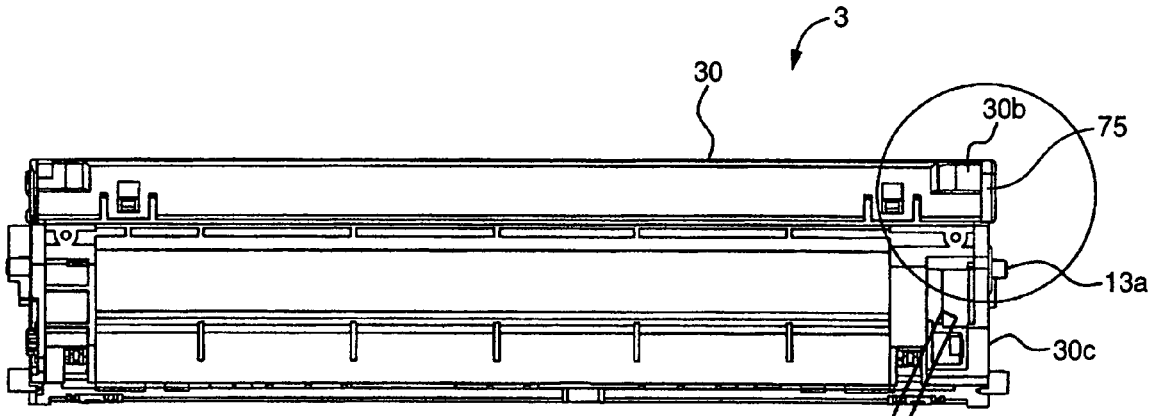
FIG. 20A is a rear view illustrating a process cartridge constructed according to a fourth embodiment of the present invention.

FIG. 20A is a rear view illustrating the photosensitive cartridge 3 of the process cartridge 2 according to the present embodiment (where the photosensitive cartridge 3 is viewed from a direction opposite to that of FIG. 7), and a right-hand side end depicted in FIG. 20A indicates one of the opposite outer side faces of the case 30. FIG. 20B is a partially enlarged view of FIG. 20A.

As illustrated in FIG. 20A, the case 30 is constructed, similarly with the first embodiment, by assembling the bottom wall 30*a* (see FIG. 4), the upper wall (member A) 30*b*, and the side walls (members B) 30*c* and 30*c*. The upper wall 30*b* of the case 30 is made so as to include a body 30*b*2 of the upper wall 30*b*, and a box-like member (cover member) 75 attached outside of the body 30*b*2.

Figure 20B:
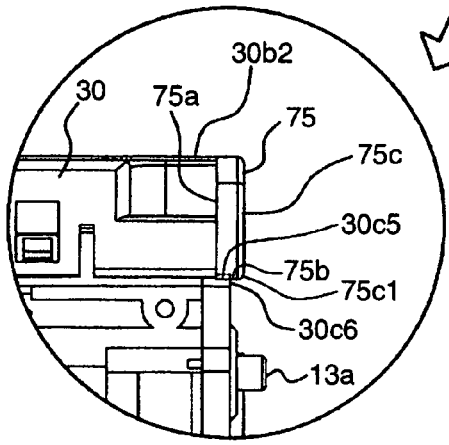
FIG. 20B is a partially enlarged view of FIG. 20A.

As illustrated in FIG. 20B, the box-like member 75 is a member generally in the shape of a box which is open at an inner side face 75*a* and a bottom face 75*b*, and which is closed at an outer side face 75*c* with a plate-like member. The box-like member 75 is mounted at its inner side face 75*a* on the body 30*b*2.

As illustrated in FIG. 20B, the outer side face 75*c* of the box-like member 75 overhangs outwardly from the side wall 30*c*, and an upper end 30*c*5 of the side wall 30*c* is inserted through the bottom face 75*b* at which the box-like member 75 is open, into the inside of the box-like member 75.

Therefore, the upper end 30*c*5 of the side wall 30*c* is covered externally with the outer side face 75*c*. In addition, a lower end 75*c*1 of the outer side face 75*c* of the box-like member 75 is located on or above a flat plane portion 30*c*6 of an outer side face of the side wall 30*c*.

In the present embodiment, the upper end 30*c*5 of the side wall 30*c* is covered externally with the outer side face 75*c* of the box-like member 75, and therefore, attachment of dirt such as toner to the upper end 30*c*5 is prevented.

Further, in the present embodiment, the outer side face 75*c* of the box-like member 75 is located outside the side wall 30*c*, and the lower end 75*c*1 of the outer side face 75*c* is on or above the flat plane portion 30*c*6 of the side wall 30*c*. Such a positional arrangement allows no otherwise element below and near the lower end 75*c*1 to be present, as illustrated in FIG. 20B.

Therefore, the present embodiment prevents an event in which a narrow clearance gap is formed between the lower end 75*c*1 of the outer side face 75*c*, and an otherwise element below the lower end 75*c*1, and which the narrow clearance gap is filled with dirt such has toner, from occurring.

As will be evident from the above explanation, in the present embodiment, the box-like member 75 constitutes an example of the "structure" set forth in the above mode (1), the upper wall 30*b* constitutes an example of the "member A" set forth in the above mode (9), the side wall 30*c* constitutes an example of the "member B" set forth in the same mode, and the box-like member 75 constitutes an example of the "cover member" set forth in the same mode.

It is added that, in the present embodiment, the cross sectional profile of the rib set 30*e*, although may be such that a plate-like protrusion is simply protruded from the side wall 30*c* without any fillet portion, is preferably such that, similarly with the first embodiment, a plate-like protrusion is smoothly connected with the side wall 30*c* using a fillet portion.

Next, a fifth embodiment of the present invention will be described with reference to FIGS. 21A and 21B.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

Figure 21A:
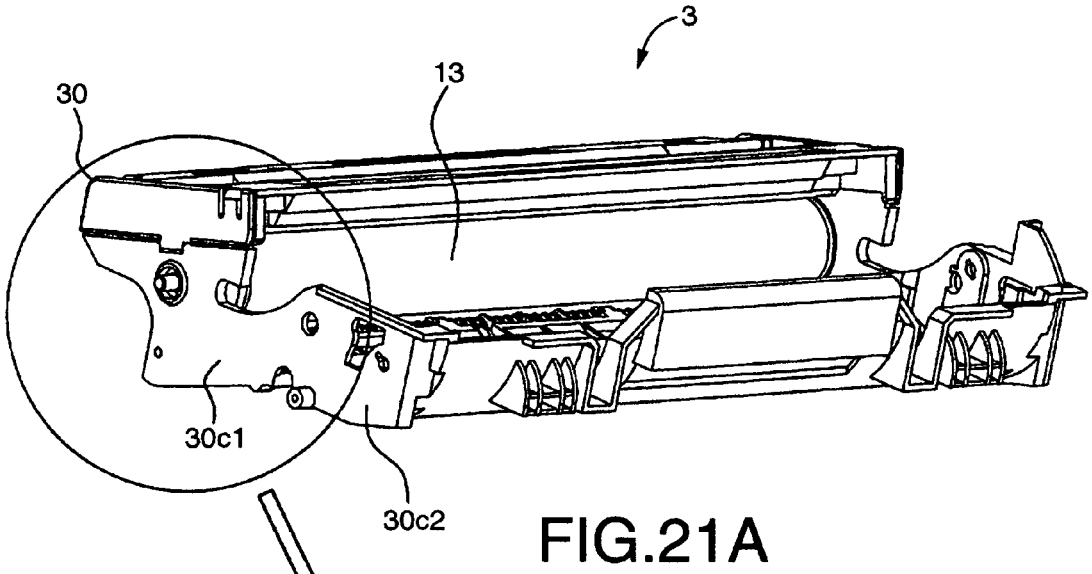
FIG. 21A is a perspective view illustrating a process cartridge constructed according to a fifth embodiment of the present invention.

As illustrated in FIG. 21A, differently from the first embodiment, in the present embodiment, the rear portion 30*c*1 of the side wall 30*c* of the photosensitive cartridge 3 has an outer side face not including a rib, but including a smoothed surface excluding the ridge 30*c*4 surrounding the developing roller shaft 13*a*.

Therefore, if an area is considered which is overlapped with the photosensitive drum 13 and the transfer roller 14 when projected in their axial directions onto the outer side face of the rear portion 30*c*1 of the side wall 30*c*, then it is found that the area has no rib and is smoothed.

Because of the above construction, the process cartridge 2 according to the present embodiment accomplishes an easier removal of dirt such as toner from the case 30 (in particular, the side wall 30*c*). On the other hand, since dirt is easily perceivable on the outside of the case 30, recycling the process cartridge 2 requires a more complete cleaning thereof.

In this regard, the present embodiment, owing to the absence of a rib on the outside of the case 30 (in particular, the outside of the rear portion 30*c*1 of the side wall 30*c*), makes it easier to remove dirt from the outside of the case 30.

Figure 21B:
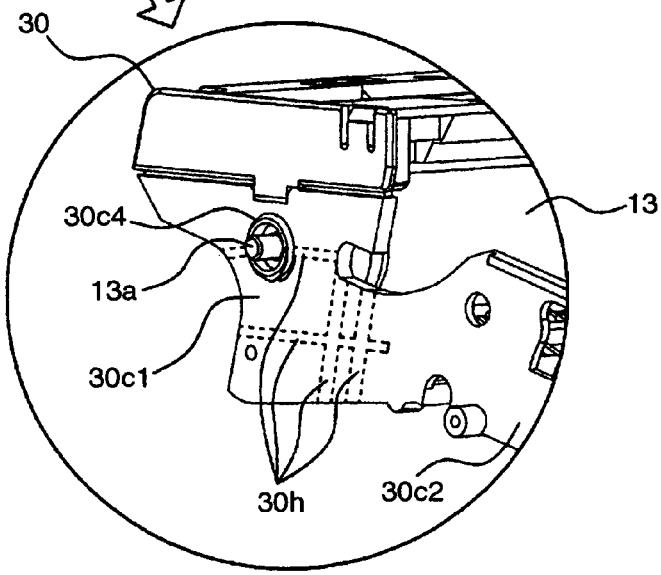
FIG. 21B is a partially enlarged view of FIG. 21A.

As illustrated in FIG. 21B, in the present embodiment, a rib set 30*h* is formed on the inside of the rear portion 30*c*1 of the side wall 30*c* so as to extend along the surface of the inside of the rear portion 30*c*1. A position of the rib set 30*h* formed on the rear portion 30*c*1 is equal to a position to which the position of the ribs 30*e*1 and 30*e*2 in the first embodiment is opposed such that the rear portion 30*c*1 is located between these two positions. That is to say, the position of the rib set 30*h* is coincident with that of the ribs 30*e*1 and 30*e*2 when viewed parallel to the developing roller shaft 13*a*.

In the first embodiment, the position of the ribs 30*e*1 and 30*e*2 formed on the rear portion 30*c*1 of the side wall 30*c* is coincident with the position of an area of the outer side face of the rear portion 30*c*1 with which the photosensitive drum 13 and the transfer roller 14 are overlapped when projected in their axial directions.

Therefore, in the present embodiment, the position of the rib set 30*h* formed on the rear portion 30*c*1 of the side wall 30*c* is within an overlapped area of the inner side face of the rear portion 30*c*1 with which the photosensitive drum 13 and the transfer roller 14 are overlapped when projected in their axial directions. On the overlapped area, stresses are easily loaded from the photosensitive drum 13 and the transfer roller 14, and in the overlapped area, it is important to ensure the accuracy in the positions of the photosensitive drum 13 and the transfer roller 14.

The process cartridge 2 according to the present embodiment, because of the arrangement of the rib set 30*h* in such an overlapped area, prevents the overlapped area from being deformed due to stress, even though the overlapped area is loaded with the photosensitive drum 13 and the transfer roller 14, allowing the accuracy in the positions of the photosensitive drum 13 and the transfer roller 14 to be ensured.

As will be evident from the above explanation, in the present embodiment, the rib set 30*h* constitutes an example of the "structure" set forth in the above mode (1), and an example of the "structure" set forth in the above mode (10).

It is added that, in the present embodiment, the cross sectional profile of the rib set 30*h*, although may be such that a plate-like protrusion is simply protruded from the side wall 30*c* without any fillet portion, is preferably such that, similarly with the first embodiment, a plate-like protrusion is smoothly connected with the side wall 30*c* using a fillet portion.

Next, a sixth embodiment of the present invention will be described with reference to FIGS. 22A and 22B.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

Figure 22A:
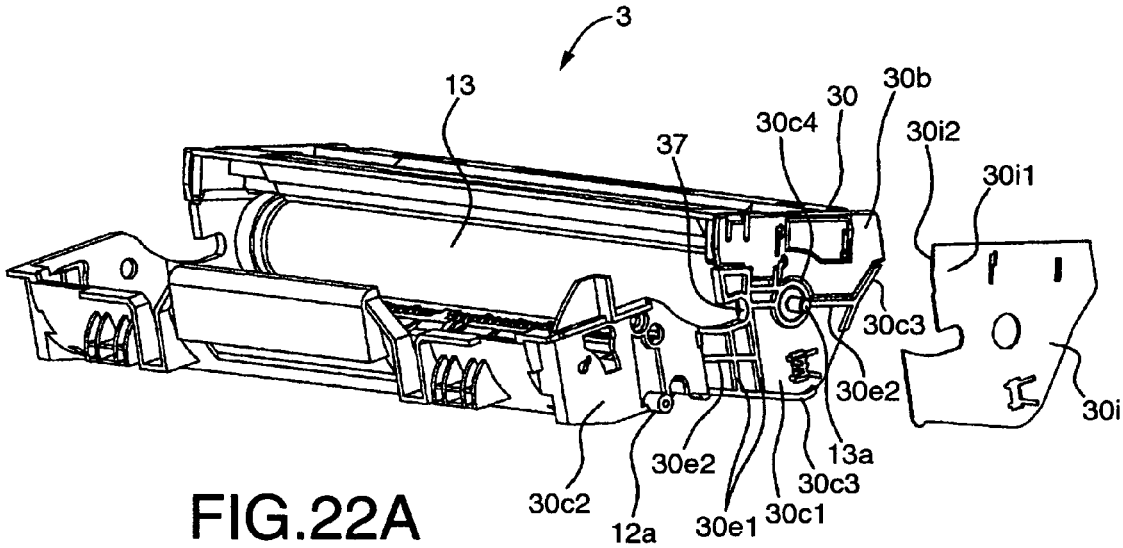
FIG. 22A is a perspective view illustrating a process cartridge constructed according to a sixth embodiment of the present invention, with a cover member not being attached.

As illustrated in FIG. 22A, the photosensitive cartridge 3 in the process cartridge 2 according to the present embodiment includes a separable cover member 30*i* in the rear portion 30*c*1 of the side wall 30*c* of the photosensitive cartridge 3.

Figure 22B:
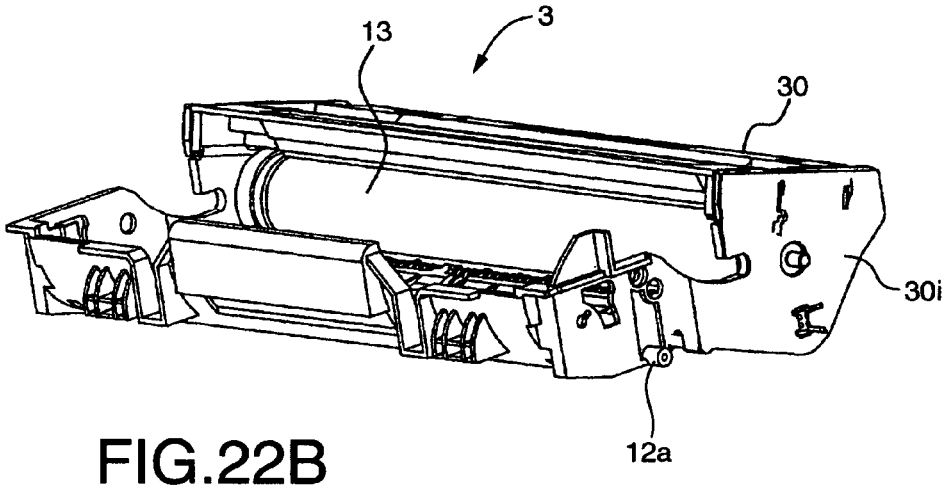
FIG. 22B is a perspective view illustrating the process cartridge, with the cover member being attached.

The cover member 30*i* is a two-layer structure comprised of a body layer 30*i*1 in the form of a resin thin film, and an adhesive layer 30*i*2 containing an adhesive, and is adhered to the rear portion 30*c*1 using the adhesive layer 30*i*2 so as to cover the entire region of the rear portion 30*c*1, as illustrated in FIG. 22B.

Therefore, with the cover member 30*i* being adhered to the rear portion 30*c*1 of the side wall 30*c*, the rib set 30*e* and the ridge 30*c*3 and 30*c*4 are covered with the cover member 30*i*.

As illustrated in FIG. 22A, the cover member 30*i* is cut away at positions through which elements projecting from the side of the case 30, such as the photosensitive drum shaft 13*a*, pass. This allows the cover member 30*i* to be adhered to the rear portion 30*c*1 without interference with these projecting elements.

Because the process cartridge 2 according to the present embodiment employs the cover member 30*i* on the side of the case 30, dirt such as toner is attached not on the rib set 30*e* covered with the cover member 30*i*, but on the cover member 30*i*. Therefore, for recycling the process cartridge 2, a mere action of peeling away the cover member 30*i* allows a removal of dirt such as toner from the case 30.

For this reason, the process cartridge 2 according to the present embodiment is allowed to be more easily cleaned. In addition, after peeling away the used cover member 30*i* from the case 30, an unused cover member 30*i* is allowed to be adhered to the case 30.

As will be evident from the above explanation, in the present embodiment, the cover member 30*i* constitutes an example of the "structure" set forth in the above mode (1), and an example of the "cover member" set forth in the above mode (12).

Next, a seventh embodiment of the present invention will be described with reference to FIG. 23.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

Figure 23:
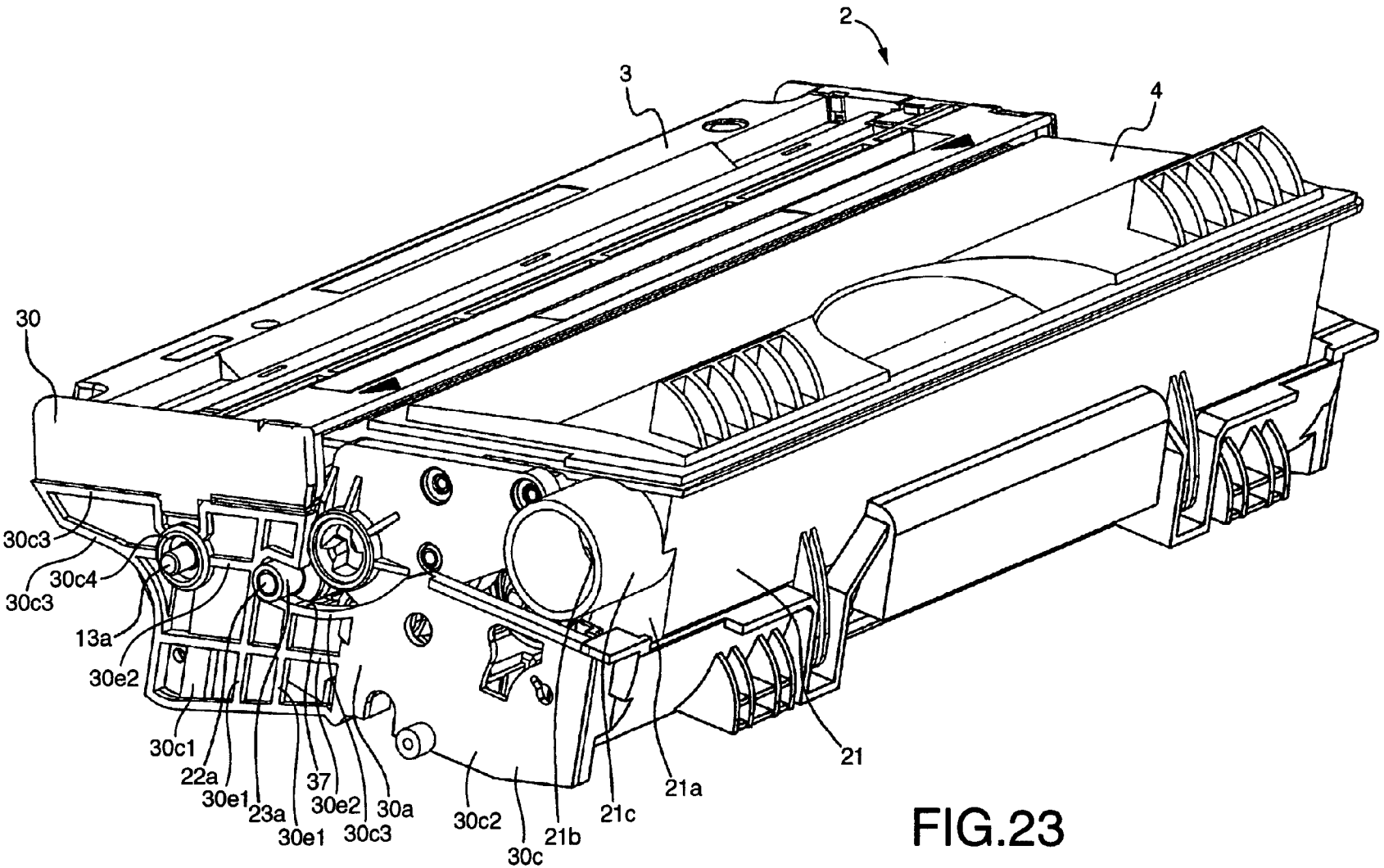
FIG. 23 is a perspective view illustrating a process cartridge constructed according to a seventh embodiment of the present invention.

As illustrated in FIG. 23, similarly with the first embodiment, the process cartridge 3 according to the present embodiment is constructed by assembling the photosensitive cartridge 3 and the developer cartridge 4.

As illustrated in FIG. 23, similarly with the first embodiment, a plurality of ribs 30*e*1 and 30*e*2 are formed on the rear portion 30*c*1 of the side wall 30*c* of the case 30 of the photosensitive cartridge 3, so as to have the cross sectional profile of the ribs 30*e*1 and 30*e*2 which is designed as illustrated in FIG. 16C, similarly with the first embodiment. More specifically, the protruding portion 30*e*3 is formed on the outer side face of the side wall 30*c*, such that the protruding portion 30*e*3 is continuously connected with the outer side face, using the fillet portions 30*e*4 and 30*e*4.

Then, the construction of the developer cartridge 4 in the present embodiment will be described with reference to FIGS. 24-29.

Figure 24:
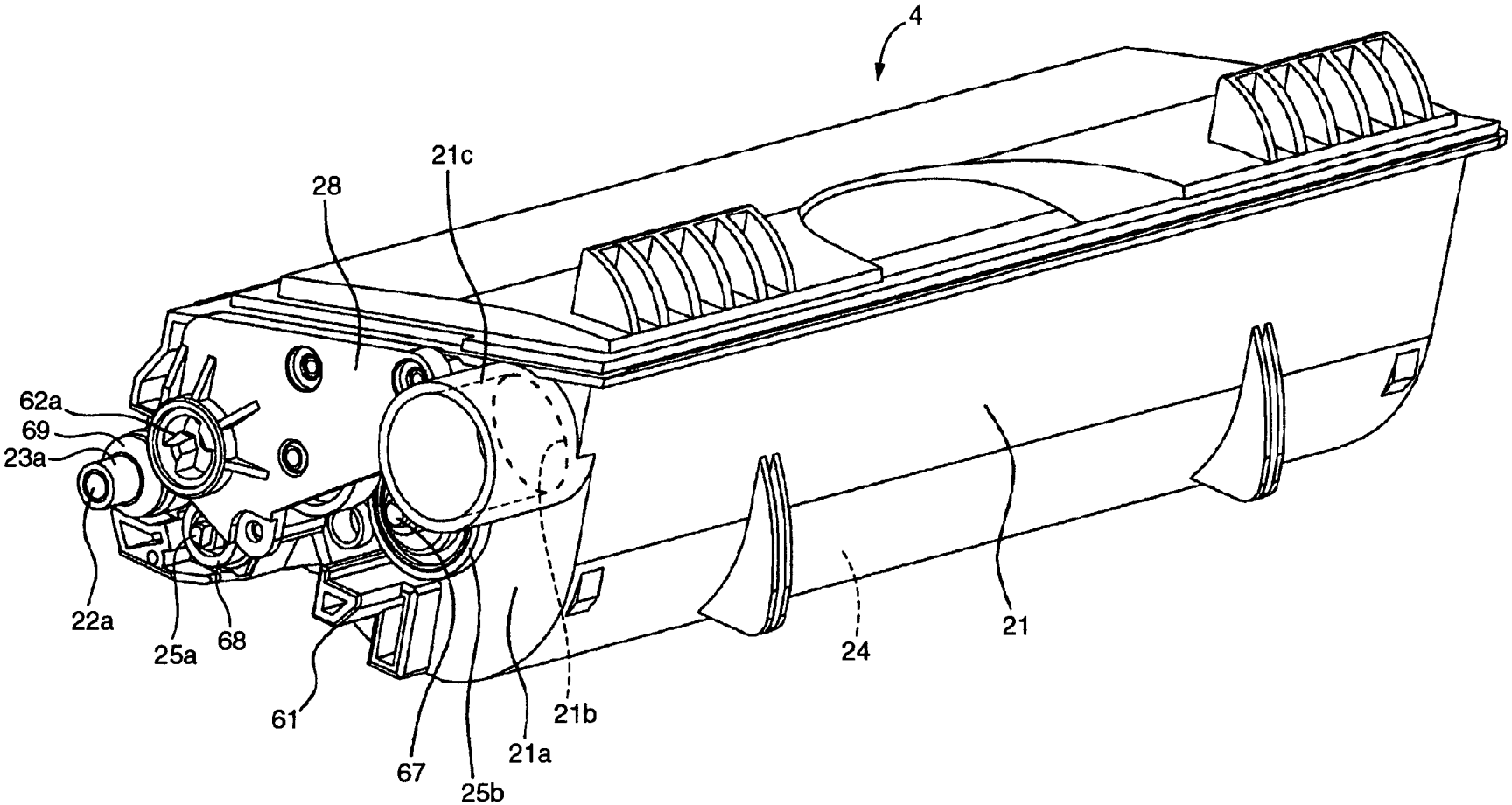
FIG. 24 is a perspective view illustrating a developer cartridge indicated in FIG. 23.
Figure 25:
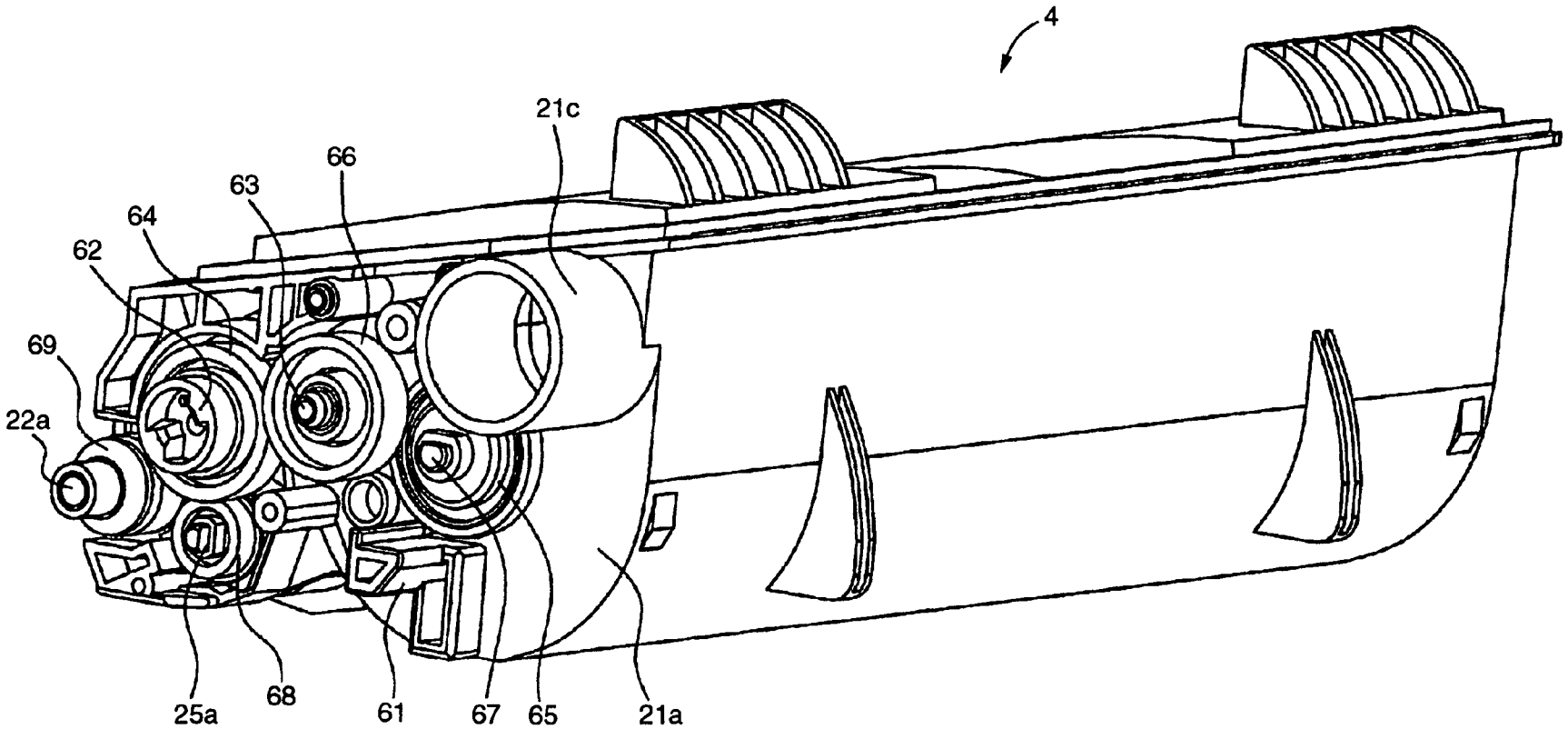
FIG. 25 is a perspective view illustrating the developer cartridge indicated in FIG. 23, with a gear case being removed.
Figure 26:
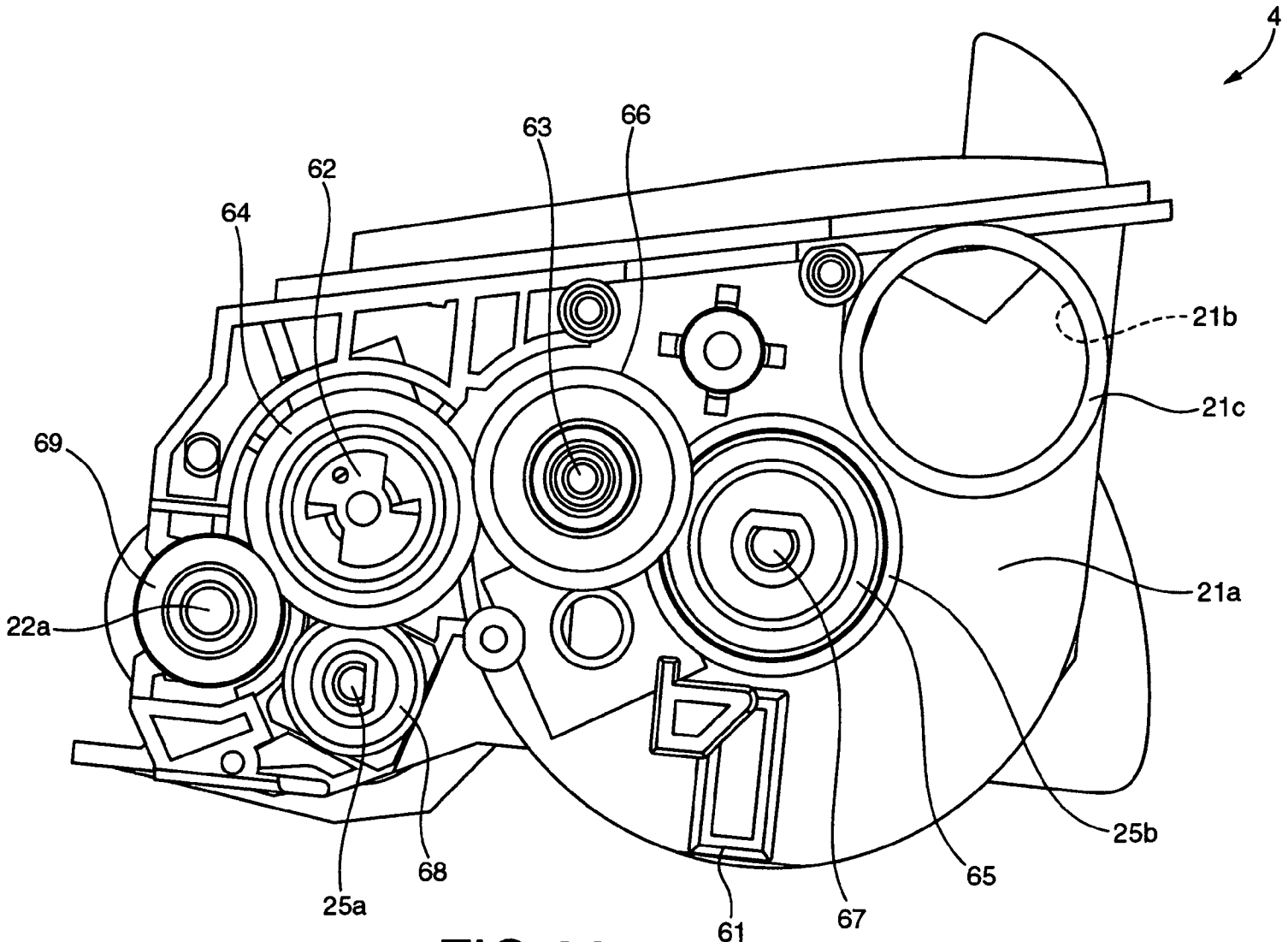
FIG. 26 is a left-hand side view illustrating the developer cartridge indicated in FIG. 23, with the gear case being removed.

FIG. 24 is a perspective view illustrating the developer cartridge 4, FIG. 25 is a perspective view illustrating the developer cartridge 4 with a gear case 28 described later being removed, and FIG. 26 is a left-hand side view illustrating the developer cartridge 4 with the gear case 28 being removed.

Figure 27:
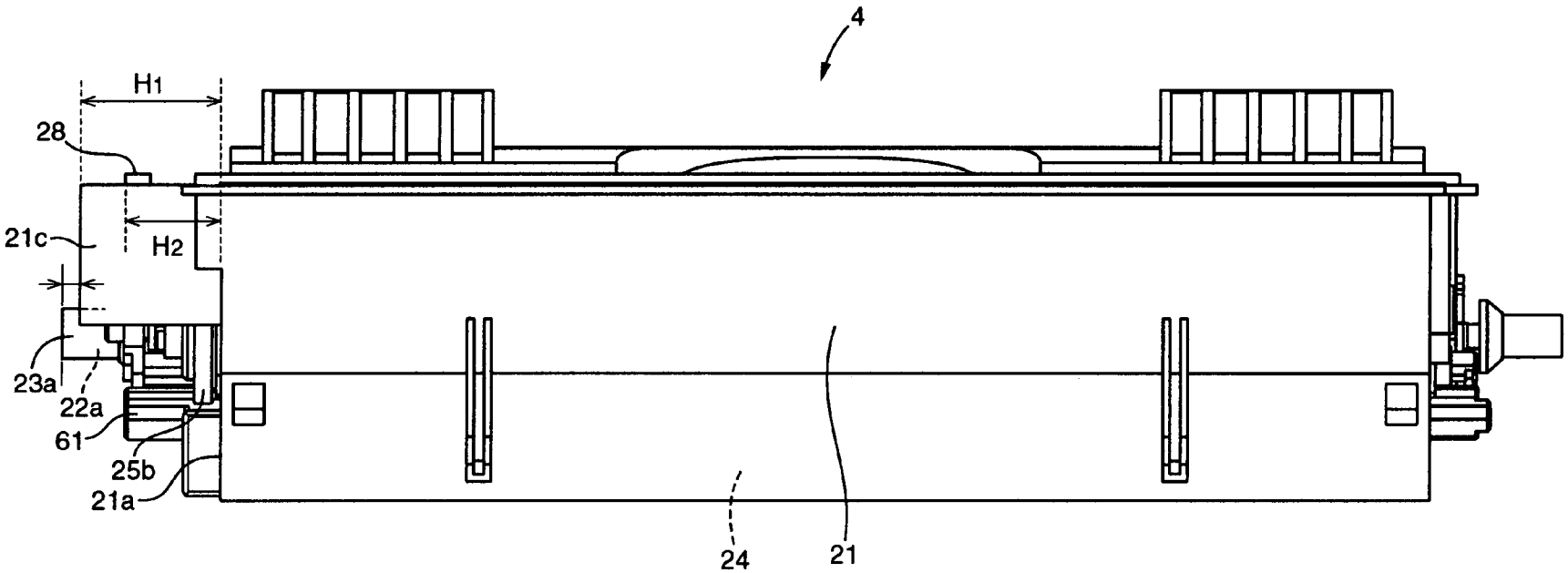
FIG. 27 is a front view illustrating the developer cartridge indicated in FIG. 23.
Figure 28A:
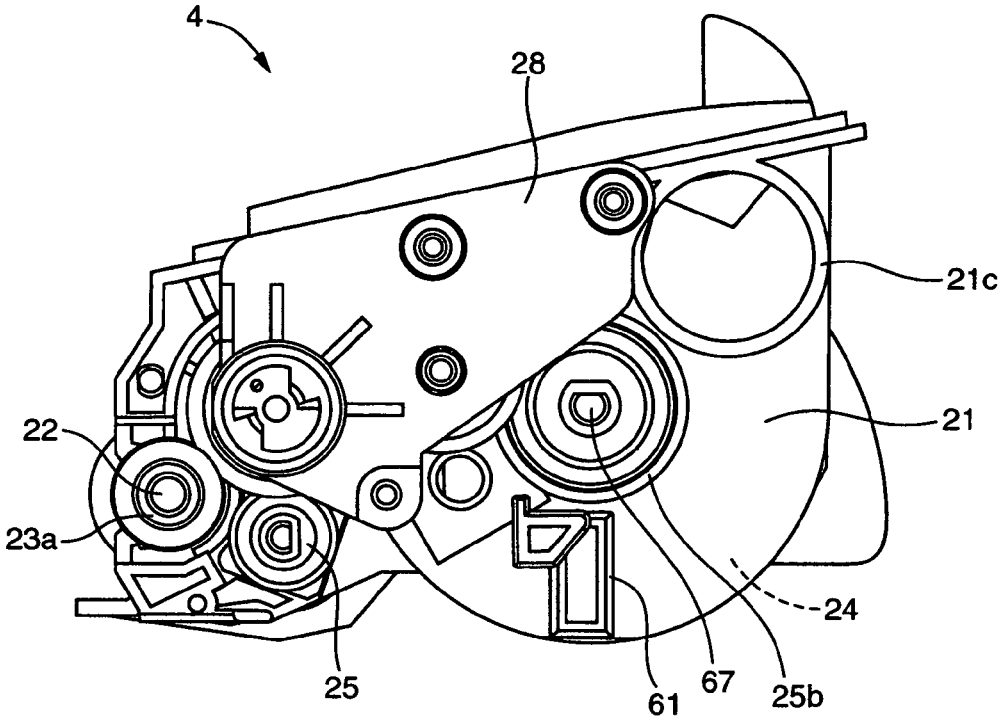
FIG. 28A is a left-hand side view illustrating the developer cartridge indicated in FIG. 23.
Figure 28B:
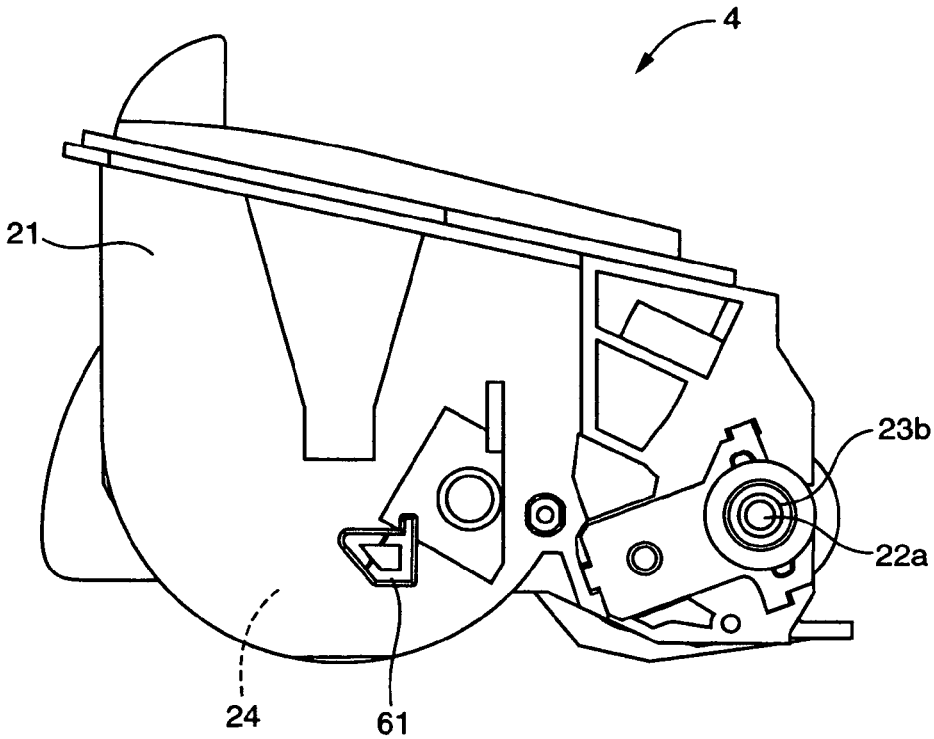
FIG. 28B is a right-hand side view illustrating the developer cartridge indicated in FIG. 23.

FIG. 27 is a front view illustrating the developer cartridge 4, FIG. 28A is a left-hand side view illustrating the developer cartridge 4, FIG. 28B is a right-hand side view illustrating the developer cartridge 4, and FIG. 29 is an enlarged sectional view illustrating the developer cartridge 4 in the neighborhood of a tubular portion 21*c* protruding from the case 21 of the developer cartridge 4.

As illustrated in FIG. 24, the developer cartridge 4 includes the case 21 (developer cartridge housing). Within the case 21, the toner storage chamber 24 (see FIG. 4) is formed to include a downwardly convex curved area.

In the present embodiment, similarly with the first embodiment as illustrated in FIG. 1, the toner is agitated within the toner storage chamber 24 using the agitator 27 driven for rotation (a member for agitating the toner), and is delivered out from the toner storage chamber 24. The toner is subsequently supplied by means of the supply roller 25 to the outer circumference of the developing roller 22 and is carried thereon, so as to be a layer having a thickness regulated by the blade 26.

As illustrated in FIG. 24, an opening (in the form of a through hole) 21*b* is formed in a left-hand side 21*a* of the case 21 (which is a selected one of opposite sides of the case 21), so as to pierce the case 21 for allowing communication of the toner storage chamber 24 to an external space. Further, the tubular portion 21*c* is formed on the left-hand side 21*a*, so as to surround the opening 21*b* in the shape of an outward projection. The tubular portion 21*c* is in the form of a hollow cylinder extending perpendicularly to the left-hand side 21*a*.

As illustrated in FIG. 27, the tubular portion 21*c* is projected from the left-hand side 21*a* so as to have a height of H1. As illustrated in FIG. 24, the tubular portion 21*c* is disposed at a position corresponding to an end of the toner storage chamber 24 which is deviated in position from the middle of the toner storage chamber 24 in the width direction thereof.

As illustrated in FIG. 24, further, the gear case (gear cover) 28 is provided outside the left-hand side 21*a* of the case 21. In an area of the gear case 28, as illustrated in FIGS. 25 and 26, a DS idle shaft (movable member) 62; a DS idle gear (gear member) 64; an agitator idle gear (gear member) 66; an agitator idle gear shaft (movable member) 63; an agitator gear 65; and an agitator gear shaft 67 are arranged.

The DS idle shaft 62, supported at the left-hand side 21*a*, is imparted a driving force from the outside. The DS idle gear 64 is coaxially mounted on the DS idle shaft 62 at its circumferential periphery. The agitator idle gear 66 is mated with the DS idle gear 64 for transmission of the driving force. The agitator idle gear shaft 63, supported at the left-hand side 21*a*, supports the agitator idle gear 66. The agitator gear 65 is mated with the agitator idle gear 66 for transmission of the driving force. Driving the agitator gear shaft 67 for rotation allows the agitator 27 fixed to the agitator gear shaft 67, to agitate the toner within the toner storage chamber 24.

As illustrated in FIG. 24, once the gear case 28 is attached to the case 21 at a given position, the DS idle gear 64; the agitator idle gear 66; the agitator idle gear shaft 63; the agitator gear 65; and the agitator gear shaft 67 are accommodated within the gear case 28. A top end 62*a* of the DS idle shaft 62 which is coupled with the body of the printer penetrates through the gear case 28 and protruded outwardly therefrom.

As illustrated in FIG. 24, a supply roller shaft (movable member) 25*a* in support of the supply roller 25, and the developing roller shaft (movable member) 22*a* is support of the developing roller 22 are disposed in the left-hand side 21*a* of the case 21 leftward from the gear case 28. As illustrated in FIG. 25, the supply roller shaft 25*a* is coaxially provided with a supply roller gear (gear member) 68 in mating relationship with the DS idle gear 64 for reception of a driving force therefrom. As illustrated in FIG. 25, the developing roller shaft 22*a* is coaxially provided with a developing roller gear (gear member) 69 in mating relationship with the DS idle gear 64 for reception of a driving force therefrom.

As illustrated in FIG. 24, the bearing 23*a* rotatably mounted on the developing roller shaft 22*a* at a corresponding one of opposite ends thereof, respectively; an annular ridge 25*b* formed around the agitator gear shaft 67; and the engaging portions 61 and 61 used for fixing the developer cartridge 4 to the photosensitive cartridge 3 are disposed at the left-hand side 21*a* of the case 21, so as to be each projected outwardly from the left-hand side 21*a*.

As illustrated in FIG. 27, the gear case 28 is the largest in the height or lift measured from the outer surface of the left-hand side 21*a*, among members or elements located outside the left-hand side 21*a* within an area having distances of not longer than 30 mm radially away from an outer circumference of the tubular portion 21*c* (see FIG. 28A). The height of the gear case 28 from the left-hand side 21*a* is represented as H2. The height H1 of the tubular portion 21*c* from the left-hand side 21*a* is preset to be greater than that of the height H2. As illustrated in FIG. 27, the height H1 of the tubular portion 21*c* is greater than that of the gear members accommodated within the gear case 28 (the DS idle gear 64, the agitator idle gear 66, the agitator gear 65).

On the other hand, as illustrated in FIG. 27, a portion of the gear case 28; a portion of the ridge 25*b*; the engaging portion 61, and the gearing 23*a* are disposed within an area having distances of longer than 30 mm radially away from the outer circumference of the tubular portion 21*c*, with the respective heights from the left-hand side 21*a* being smaller than the height H1.

Therefore, the height H1 of the tubular portion 21*c* from the left-hand side 21*a* is longer than any other members located outside the left-side 21*a* within a neighboring area having radial distances of not longer than 30 mm away from the tubular portion 21*c*. That is to say, the tubular portion 21*c* is the highest in the neighboring area.

As illustrated in FIG. 27, the height H1 of the tubular portion 21*c* from the left-hand side 21*a* is greater than those of the DS idle gear 64; the agitator idle gear 66; the agitator gear 65; and the supply roller gear 68, each mating directly or indirectly with the developing roller gear 69. However, the height H1 of the tubular portion 21*c* from the left-hand side 21*a* is preset to be less than that of the developing roller shaft 22*a*.

Figure 29A:
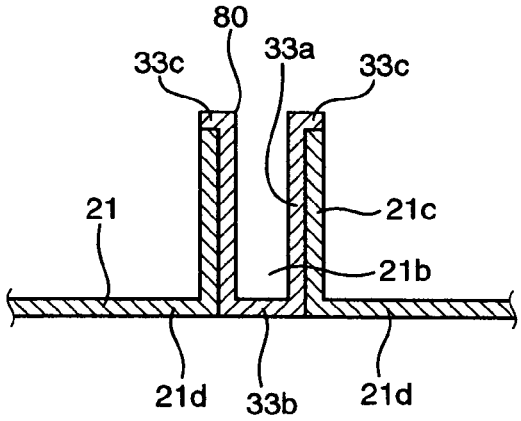
FIG. 29A is a cross section illustrating a tubular portion indicated in FIG. 24 and a cap to be attached to the tubular portion.

As illustrated in FIG. 29A, a cap 80 is used to be fitted into the tubular portion 21*c* at times other than replenishment and evacuation of toner. The cap 80 is comprised of a tubular body portion 33*a*; a bottom portion 33*b* provided for tightly closing one of opposite open ends of the body portion 33*a*; and an outwardly-projecting flange portion 33*c* formed at the opposite open end of the body portion 33*a*.

The body portion 33*a* is dimensioned in diameter to allow the cap 80 to be smoothly fitted into the tubular portion 21*c* without an unneeded radial clearance between an outer surface of the body portion 33*a* and an inner surface of the tubular portion 21*c*.

For the usage, the cap 80 is inserted into the tubular portion 21*c* from the outside, with the bottom portion 33*b* leading, and the cap 80 is pressed into the tubular portion 21*c* until the flange portion 33*c* is brought into abutment with an outer end of the tubular portion 21*c*. In the abutment state, an outer face of the bottom portion 33*b* is flush with an inner face of a portion 21*d* of the case 21 located around the opening 21*b*.

Figure 30:
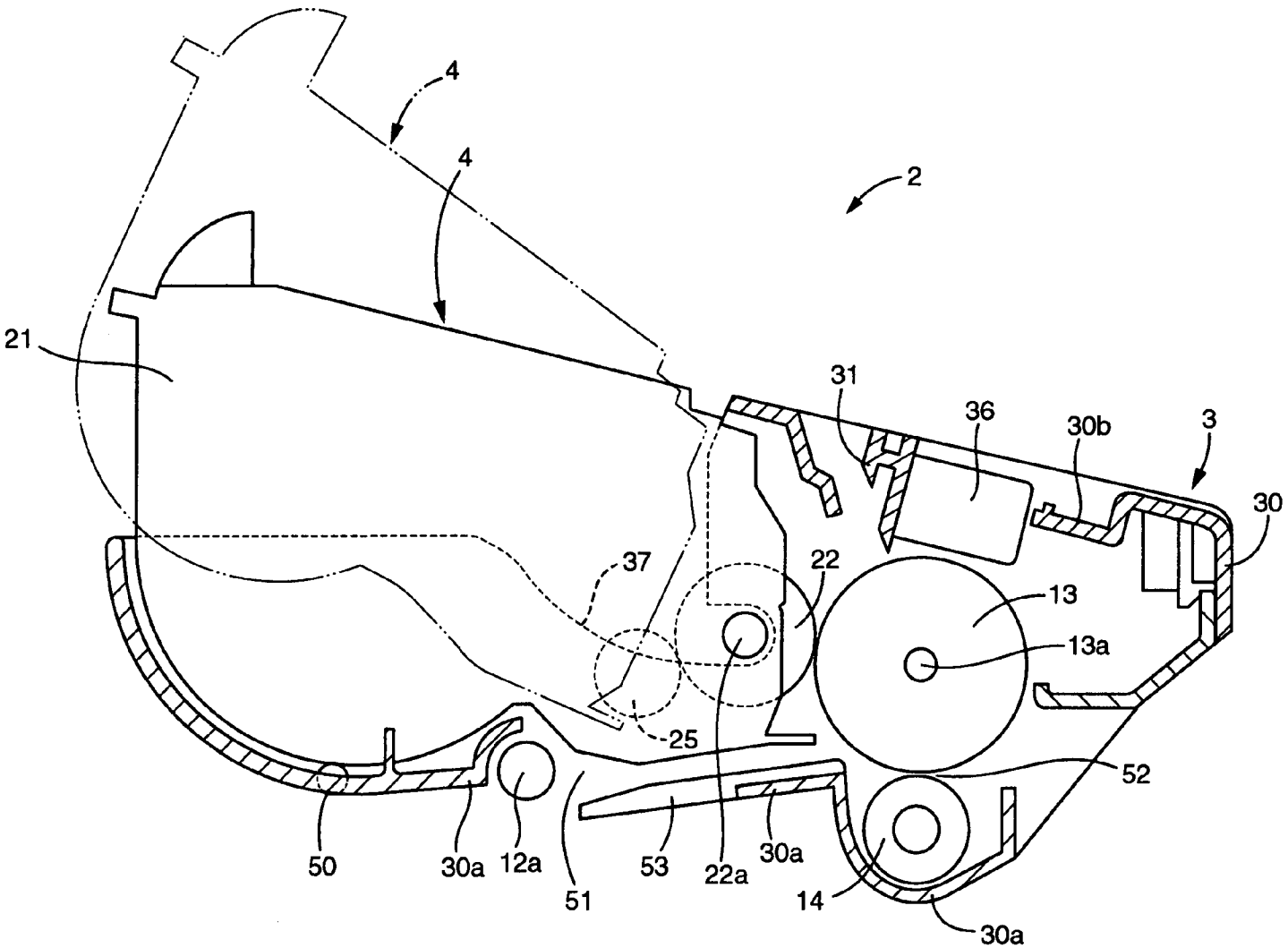
FIG. 30 is a cross section illustrating a photosensitive cartridge indicated in FIG. 23, with the developer cartridge being attached to the photosensitive cartridge.
Figure 31:
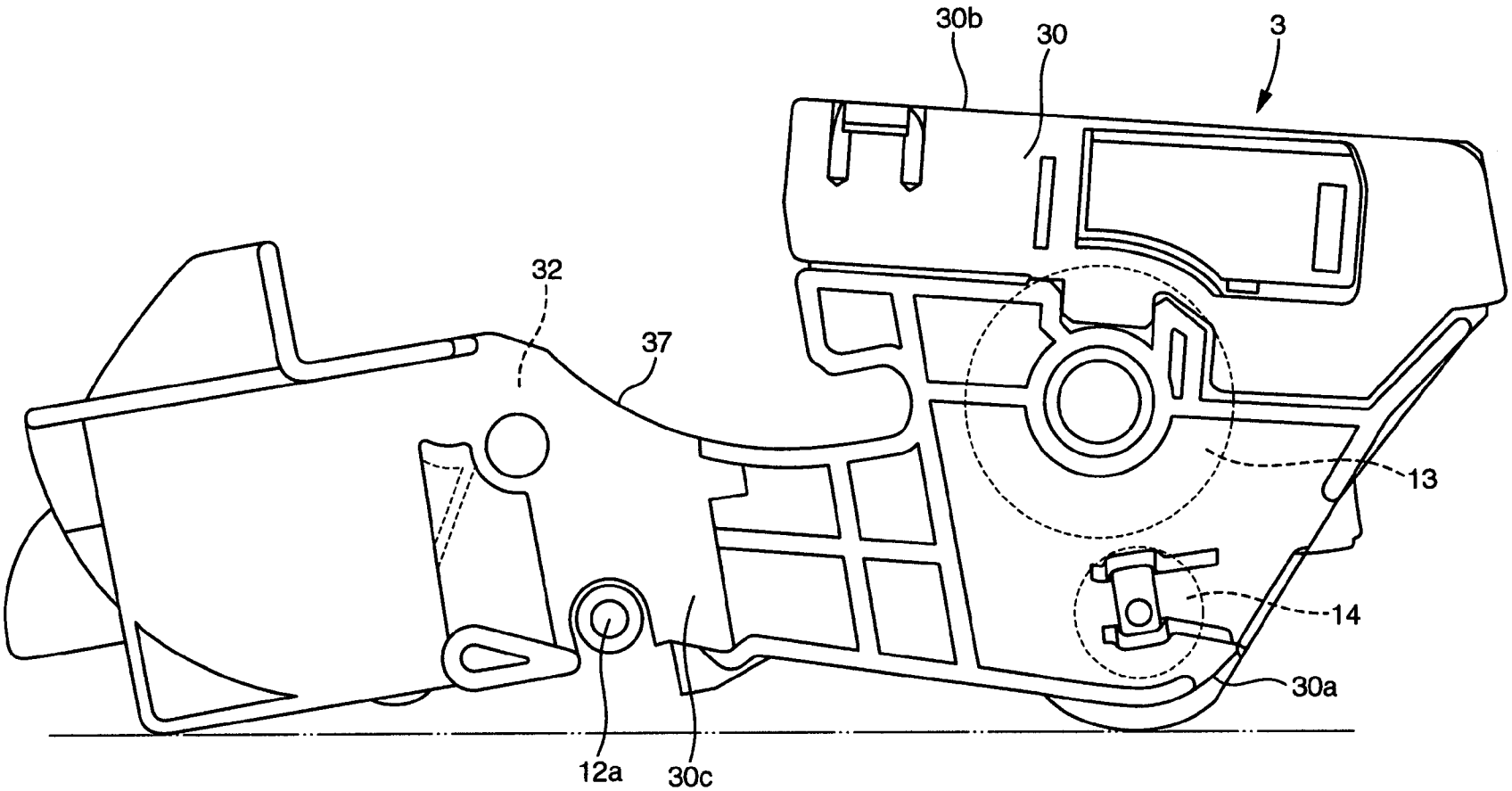
FIG. 31 is a right-hand side view illustrating the photosensitive cartridge indicated in FIG. 23.

FIG. 3 illustrates in top plan view the photosensitive cartridge 3 constructed according to the present embodiment, FIG. 30 illustrates the photosensitive cartridge 3 in cross section with the developer cartridge 4 being attached to the photosensitive cartridge 3, and FIG. 31 illustrates the photosensitive cartridge 3 in right-hand side view.

The developer cartridge 4 and the process cartridge 2 according to the present embodiment provide the following effects:

1. The extent to which toner is scattered and attached to the neighboring components when the toner is removed out through the tubular portion 21*a* is reduced.

As illustrated in FIG. 27, in the present embodiment, the height H1 of the tubular portion 21*c* located outside the left-hand side 21*a* of the case 21 forming the developer cartridge 4, as measured from the left-hand side 21*a*, is greater than that of any other component within an area having radial distances of not longer than 30 mm from the tubular portion 21*c*.

Therefore, the present embodiment results in reduction in the possibility that toner, once discharged from the developer cartridge 4 through the tubular portion 21*c*, is attached to the neighborhood of the tubular portion 21*c* in the developer cartridge 4.

For verifying the above findings, the following experiment was conducted:

Initially, for observing with the naked eye the size of an area over which toner is scattered upon discharge from the tubular portion 21*c*, there was prepared a white flat plastic sheet with a hole in conformity in dimension with the tubular portion 21*c*. The tubular portion 21*c* is 21.5 mm in inner diameter, and 30 mm in length.

The plastic sheet was attached to the developer cartridge 4 which has been filled with toner within the toner storage chamber 24, with the tubular portion 21*c* penetrating through the hole of the plastic sheet. The toner was used approximately 100 g in weight.

For the orientation and the position of the plastic sheet attached to the tubular portion 21*c*, the plastic sheet was attached to the tubular portion 21*c* in parallel to the left-hand side 21*a*, at a position 10 mm higher than the gear case 28. In this layout, the tubular portion 21*c* is protruded at its top end from the hole of the plastic sheet.

Next, the cap 80 was detached from the tubular portion 21*c*, with the toner storage chamber 24 being filled with toner, and the developer cartridge 4 was tilted until the opening 21*b* was directed downwardly. Then, the toner dropped due to its weight, resulting in discharge from the toner storage chamber 24 through the opening 21*b* and the tubular portion 21*c* in the description order.

Upon completion of the discharge, how far the toner was scattered over the plastic sheet was perceived with the naked eye, and then, the scatter conditions of the toner were assessed. The results are represented in table in FIG. 32. In the table, the symbols "○," "Δ," "×," and "××" are defined to indicate that the scatter of the toner was getting larger in the description order.

The table demonstrates that the toner was more easily scattered in an area having radial distances shorter than 30 mm from the tubular portion 21*c* than an area having radial distances not shorter than 30 mm.

In the present embodiment, the height H1 of the tubular portion 21*c* is preset to be greater than that of any other component in an area in which toner is easily scattered, that is, an area having radial distances shorter than 30 mm from the tubular portion 21*c*, and therefore, there is reduced the possibility that toner discharged from the tubular portion 21*c* is attached to otherwise components.

The table further demonstrates that the toner was more easily scattered in an area having radial distances shorter than 20 mm from the tubular portion 21*c* than an area having radial distances not shorter than 20 mm.

Therefore, if the height H1 of the tubular portion 21*c* is preset to be greater than that of any other component in an area having radial distances shorter than 20 mm from the tubular portion 21*c*, then there is reduced the possibility that toner discharged from the tubular portion 21*c* is attached to otherwise components.

The table still further demonstrates that the toner was more easily scattered in an area having radial distances shorter than 5 mm from the tubular portion 21*c* than an area having radial distances not shorter than 5 mm.

Therefore, if the height H1 of the tubular portion 21*c* is preset to be greater than that of any other component in an area having radial distances shorter than 5 mm from the tubular portion 21*c*, then there is reduced the possibility that toner discharged from the tubular portion 21*c* is attached to otherwise components.

2. The toner is removed from the developer cartridge 4 with a suction pipe of a vacuum cleaner being attached to the tubular portion 21*c*, without scatter of the toner.

In the present embodiment, the tubular portion 21*c* is higher than the neighboring components, and therefore, the suction pipe of the vacuum cleaner is capable of being inserted into an area of the tubular portion 21*c* higher than the neighboring components, without interference therewith.

If the toner is removed from the developer cartridge 4 by suction, with the suction pipe of the vacuum cleaner being inserted into the tubular portion 21*c*, then the toner is avoided from being scattered and attached to the neighboring components at the time of discharge of the toner.

3. A cover for preventing scatter of toner is capable of being attached to the tubular portion 21*c*.

Figure 33:
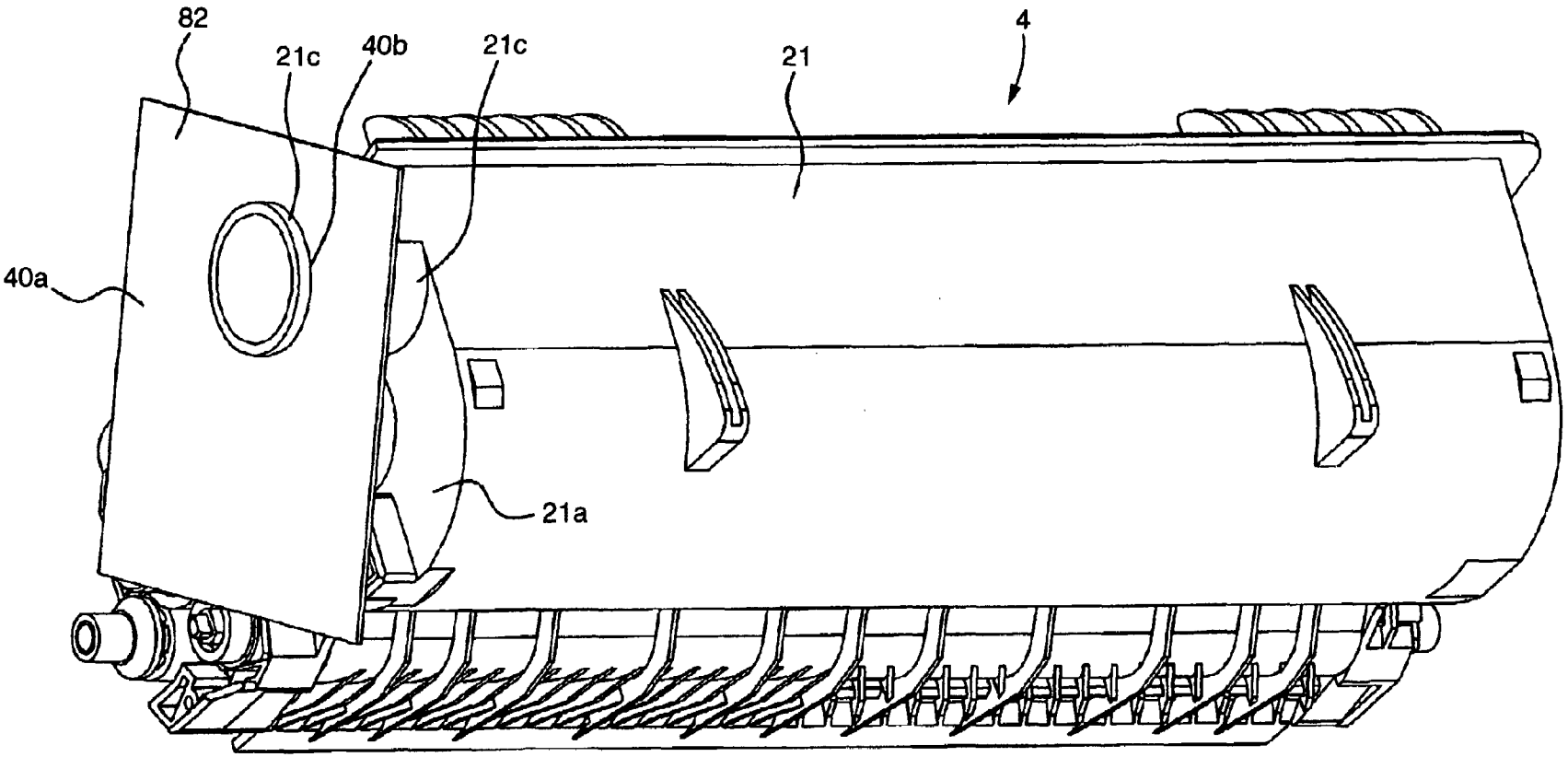
FIG. 33 is a perspective view for explaining an application of the process cartridge indicated in FIG. 23.

In the present embodiment, the tubular portion 21*c* is higher than the neighboring components, and therefore, as illustrated in FIG. 33, a cover 82 for preventing scatter of toner can be employed.

The cover 82 includes a flat-plate-like body 40*a*, and a circular hole portion 40*b* having a diameter in conformity with the exterior of the tubular portion 21*c*. Prior to the replenishment and discharge of toner to the developer cartridge 4, the cover 82 is attached in a manner that the tubular portion 21*c* is inserted into the hole portion 40*b* and the left-hand side 21*a* is covered with the body 40*a*.

The tubular portion 21*c* is higher than otherwise components in the neighborhood of the left-hand side 21*a*. As a result, only a part of the tubular portion 21 is resided within one of two sub-spaces partitioned by the cover 82 located on the same side as the top (entry/exit for toner) of the tubular portion 21*c*.

Therefore, even though toner is scattered from the tubular portion 21*c*, the body 40*a* of the cover 82 prevents the toner from reaching the neighboring components, without attachment of the toner to the left-hand side 21*a*.

4. The bottom face of the cap 80 and the inner surface of the case 21 are flush with each other, in the absence of a clearance gap allowing toner to be resided.

As illustrated in FIG. 29A, in the present embodiment, the outer surface of the bottom portion 33*b* of the cap 80 is flush with the portion 21*d* of the case 21 adjacent to the opening 21*b*, with the cap 80 being inserted into the tubular portion 21*c*. Therefore, there is no creating a stepped portion between the outer surface of the bottom portion 33*b* of the cap 80 and the inner face of the case 21, resulting in no toner resided at the bottom portion 33*b* of the cap 80.

Figure 29B:
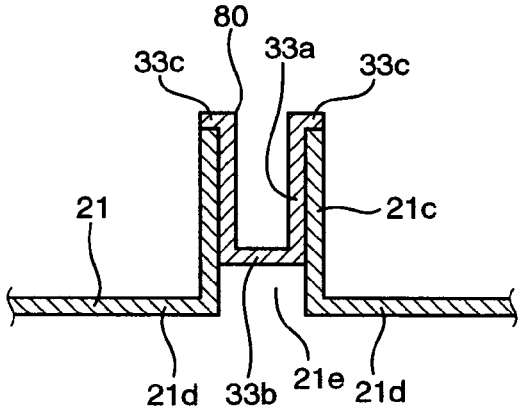
FIG. 29B is a cross section illustrating a comparative example for the cap.

As illustrated in FIG. 29B, if the outer surface of the bottom portion 33*b* fails to reach the inner surface of the portion 21*d* of the case 21 adjacent to the opening 21*b*, then a recess 21*e* is provided between the bottom portion 33*b* and the tubular portion 21*c*, allowing toner to be resided.

Figure 29C:
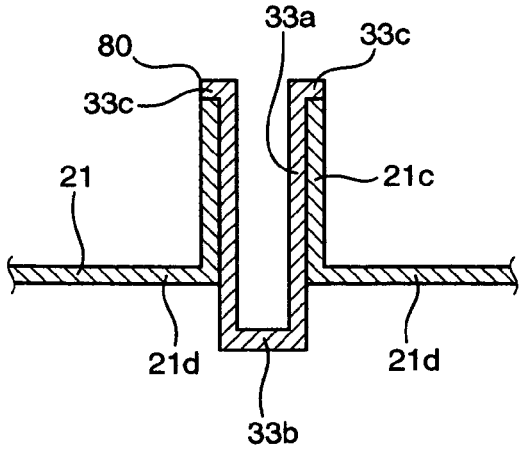
FIG. 29C is a cross section illustrating another comparative example for the cap.

As illustrated in FIG. 29C, if the bottom portion 33*b* is projected from the portion 21*d* of the case 21 adjacent to the opening 21*b*, then there is increased the possibility that the bottom portion 33*b* and the agitator 27 (see FIG. 1) for agitating the toner within the toner storage chamber 24 are interfered with each other.

Next, an eighth embodiment of the present invention will be described with reference to FIGS. 34A, 34B, 35A, and 35B.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

As illustrated in FIGS. 34A, 34B, 35A, and 35B, a plate-like selectively-interfering member 30*j* is protruded upwardly from an upper end of the side wall 30*c* of the photosensitive cartridge 3 according to the present embodiment. The selectively-interfering member 30*j* is provided for physically selecting a fit type of the developer cartridge 4 fitted with the photosensitive cartridge 3, and for automatically avoiding an unfit type of the developer cartridge 4 from being erroneously attached to the photosensitive cartridge 3.

Figure 34A:
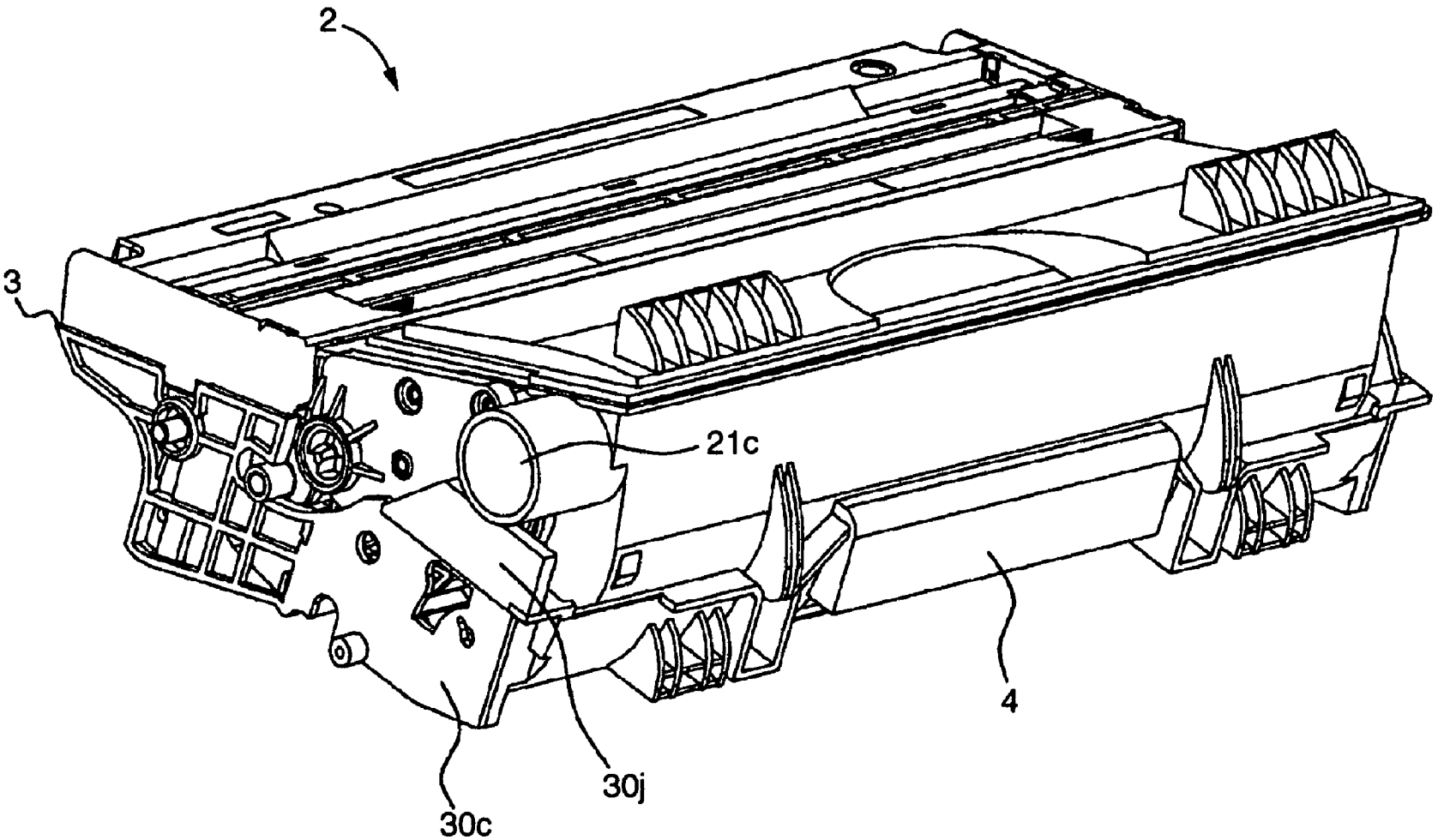
FIG. 34A is a perspective view illustrating a process cartridge constructed according to an eighth embodiment of the present invention, together with a developer cartridge unfitting the process cartridge.
Figure 34B:
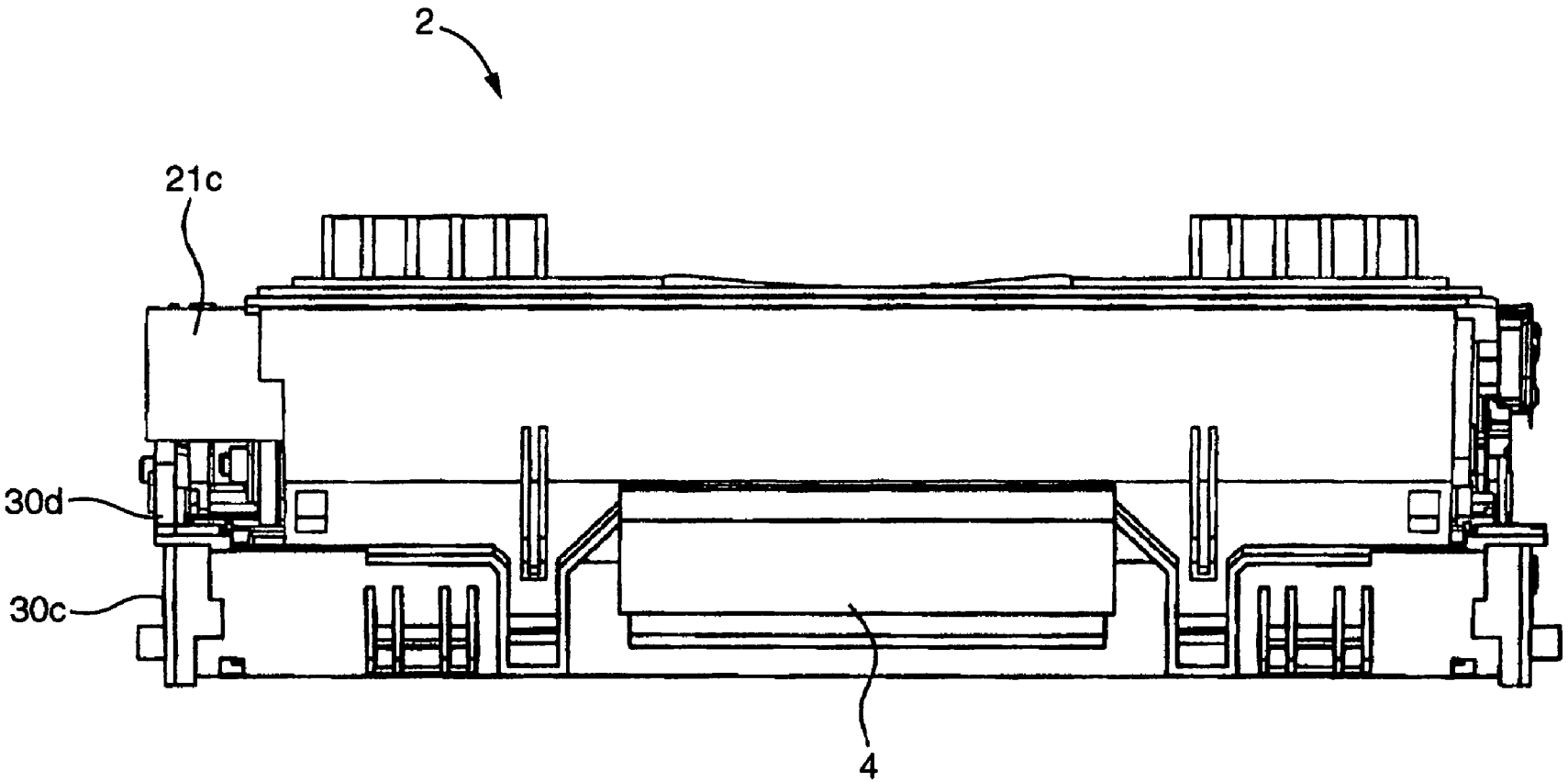
FIG. 34B is a front view illustrating the process cartridge indicated in FIG. 34A.

More specifically, as illustrated in FIGS. 34A and 34B, if the length of the tubular portion 21*c* is larger than a given length, then the tubular portion 21*c*, in an attempt of the attachment of the developer cartridge 4 to the photosensitive cartridge 3, is interfered with the selectively-interfering member 30*j*, thereby preventing the attachment of the developer cartridge 4 to the photosensitive cartridge 3.

Figure 35A:
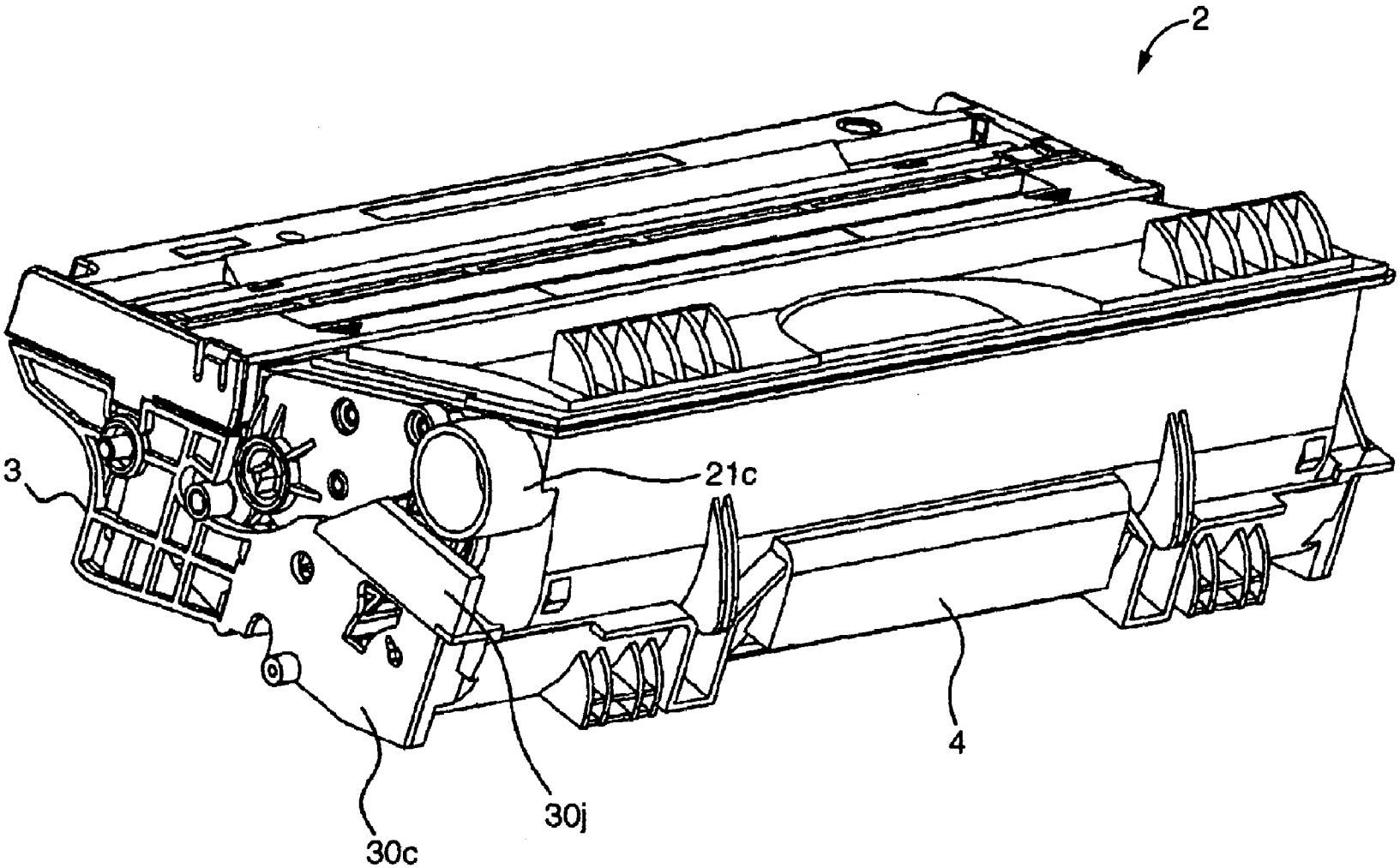
FIG. 35A is a perspective view illustrating the process cartridge constructed according to the eighth embodiment, together with a developer cartridge fitting the process cartridge.
Figure 35B:
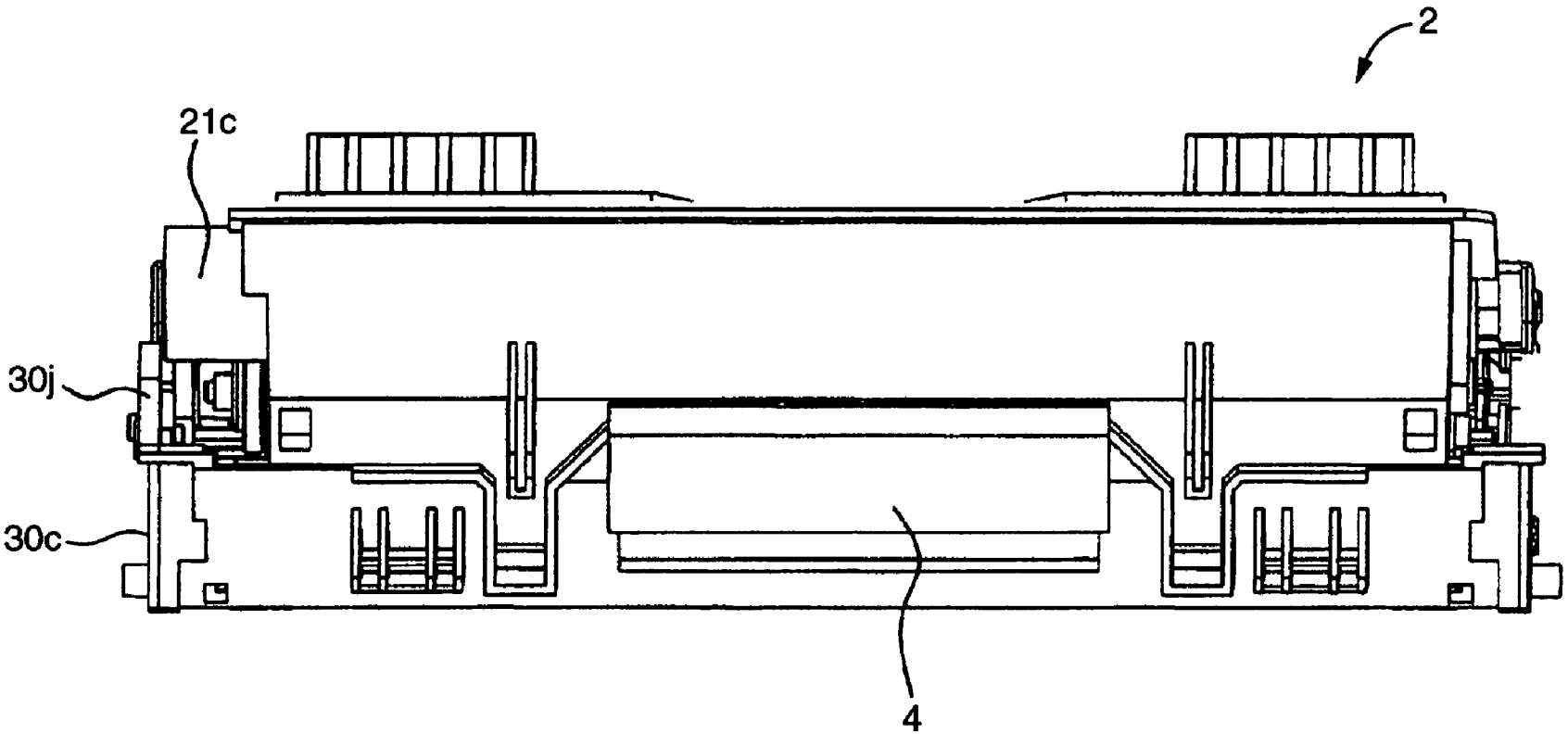
FIG. 35B is a front view illustrating the process cartridge indicated in FIG. 35A.

On the other hand, as illustrated in FIGS. 35A and 35B, if the length of the tubular portion 21*c* is not larger than a given length, then the tubular portion 21*c* is not interfered with the selectively-interfering member 30*j*, and is accommodated inside the selectively-interfering member 30*j*, thereby allowing the attachment of the developer cartridge 4 to the photosensitive cartridge 3.

The process cartridge 2 according to the present embodiment, owing to the selectively-interfering member 30*j* provided in the photosensitive cartridge 3, prevents a wrong type of the developer cartridge 4 from being erroneously attached to the photosensitive cartridge 3, provided that the length of the tubular portion 21*c* is variably preset, on a type-by-type basis, depending on the dimension of a corresponding type of the developer cartridge 4.

Therefore, the process cartridge 2 avoids troubles from occurring due to the developer cartridge 4 actually attached to the photosensitive cartridge 3 being inappropriate in type.

As will be evident from the above explanation, in the present embodiment, the selectively-interfering member 30*j* constitutes an example of the "selectively-abutting member" set forth in the above mode (30).

Next, a ninth embodiment of the present invention will be described with reference to FIGS. 36A and 36B.

In view of the fact that the present embodiment includes many elements common to those of the first embodiment, these common elements of the present embodiment will be referenced the same reference numerals or names as those in the description and illustration of the first embodiment, without a redundant description and illustration, and only distinct elements of the present embodiment from those of the first embodiment will be described in more detail.

Figure 36A:
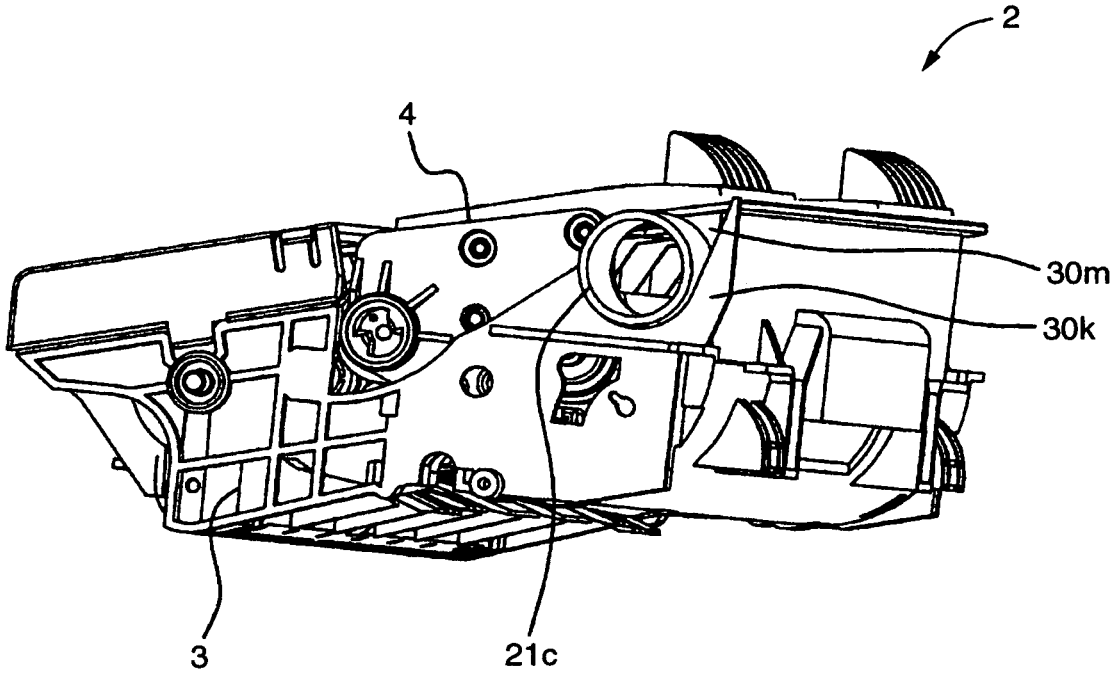
FIG. 36A is a perspective view illustrating a process cartridge constructed according to a ninth embodiment of the present invention.
Figure 36B:
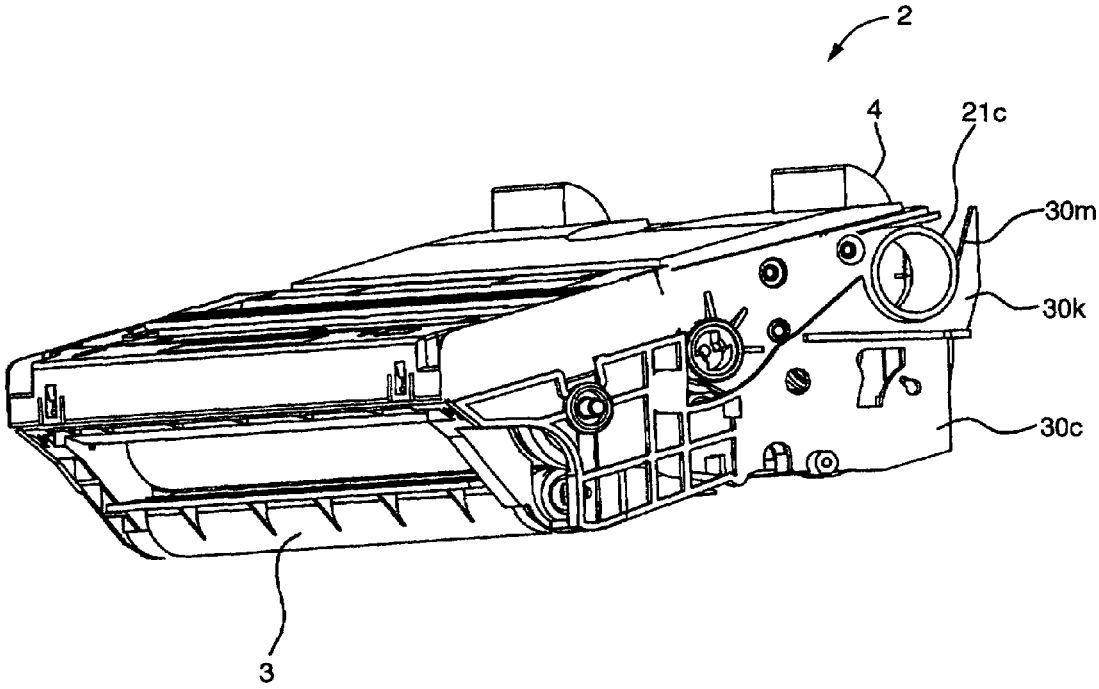
FIG. 36B is another perspective view illustrating the process cartridge.

As illustrated in FIGS. 36A and 36B, a plate-like receiving member 30*k* is protruded upwardly from an upper end of the side wall 30*c* of the photosensitive cartridge 3 according to the present embodiment. An engaging recess 30*m* is formed in the receiving member 30*k*, by notching the receiving member 30*k*. The engaging recess 30*m* is generally U-shaped so as to be open at an upper end of the receiving member 30*k*, and the upper end is shaped so as to fit the outer circumference of the tubular portion 21*c*.

In an attempt to attach the developer cartridge 4 to the photosensitive cartridge 3, the tubular portion 21*c* is inserted and fitted into the bottom of the engaging recess 30*m*, while being guided by a slanted surface of the engaging recess 30*m*. As a result, the position of the developer cartridge 4 relative to the photosensitive cartridge 3 is fixed because of the fit between the tubular portion 21*c* and the engaging recess 30*m*.

The process cartridge 2 according to the present embodiment, because of the fact that the tubular portion 21*c* included in the developer cartridge 4 is utilized for location and fixing of the developer cartridge 4 relative to the photosensitive cartridge 3, does not require a member exclusively used for these location and fixing. Therefore, the process cartridge 2 allows the construction of the developer cartridge 4 to be simplified.

It is added that, in the seventh to ninth embodiments, although the gear case 28 and the tubular portion 21*c* are both disposed on the same one of opposite side faces of the case 21, the gear case 28 may be alternatively disposed on the opposite one of the side faces of the case 21 to that of the tubular portion 21*c*. This alternative arrangement allows a further reduction in the possibility that scattered toner is attached to the gear case 28.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A process cartridge detachably mounted on an apparatus for forming an image using toner, having a process cartridge housing comprising:

a smoothed surface portion including an inner face and an outer face;

at least one protruding portion formed on the smoothed surface portion so as to protrude therefrom;

a fillet portion connecting the smoothed surface portion and the protruding portion with each other, and wherein the fillet portion extends from the smoothed surface portion up to a position higher than the smoothed surface portion by a distance not shorter than one-third times a total height of the protruding portion measured from the smoothed surface portion.

2. A process cartridge detachably mounted on an apparatus for forming an image using toner, having a process cartridge housing comprising:

a smoothed surface portion including an inner face and an outer face;

at least one protruding portion formed on the smoothed surface portion so as to protrude therefrom; and a fillet portion connecting the smoothed surface portion and the protruding portion with each other, wherein the fillet portion has a radius of curvature of not smaller than 2 mm.

3. A process cartridge detachably mounted on an apparatus for forming an image using toner, having a process cartridge housing comprising:

a smoothed surface portion including an inner face and an outer face;

at least one protruding portion formed on the smoothed surface portion so as to protrude therefrom; and a structure having a surface configured for physically facilitating removal of dirt from the process cartridge housing, once attached thereto, wherein the at least one protruding portion comprises a plurality of ridges each extending along the smoothed surface portion, and wherein the structure is adapted to locate the plurality of ridges on the smoothed surface portion so as not to intersect each other.

4. The process cartridge according to claim 3, wherein the structure is adapted to locate the plurality of ridges on the smoothed surface portion such that the plurality of ridges do not cooperatively form a closed area on the smoothed surface portion.

5. The process cartridge according to claim 3, wherein the structure is adapted to locate the plurality of ridges on the smoothed surface portion so as to coextend generally in parallel to each other.

6. The process cartridge according to claim 3, further comprising a rotating member disposed within the process cartridge housing, wherein the process cartridge housing further comprises opposite side walls supporting the rotating member at opposite ends thereof, respectively, at least one of the opposite side walls including the smoothed surface portion, and wherein the protruding portion is formed on the smoothed surface portion of the at least one side wall.

7. The process cartridge according to claim 3, further comprising a rotating member disposed within the process cartridge housing, wherein the process cartridge housing further comprises opposite side walls supporting the rotating member at opposite ends thereof, respectively, wherein the process cartridge housing is constructed by combining a plurality of members including two adjacent members cooperatively forming at least one of the opposite side walls, and wherein the structure is adapted to locate the two adjacent members on the at least one side wall, such that a substantially straight seam is formed on the at least one side wall between the two adjacent members, so as to cross edge-to-edge the at least one side wall along a surface thereof, and such that respective surfaces of the two adjacent members are substantially flush with each other at the formed seam.

8. The process cartridge according to claim 3, further comprising a rotating member disposed within the process cartridge housing, wherein the process cartridge housing further comprises opposite side walls supporting the rotating member at opposite ends thereof, respectively, wherein the process cartridge housing is constructed by combining a plurality of members including members A and B adjacent to each other on at least one of the opposite side walls, and wherein the structure comprises a cover member externally covering at least one of opposite ends of the member A, one of ends of the cover member being located on or above an outwardly-facing flat plane portion of the member B.

9. The process cartridge according to claim 3, further comprising a rotating member disposed within the process cartridge housing, wherein the process cartridge housing further comprises opposite side walls supporting the rotating member at opposite ends thereof, respectively, at least one of the opposite side walls including the smoothed surface portion, wherein the at least one protruding portion comprises at least one ridge extending along the smoothed surface portion of the at least one side wall, and wherein the structure is adapted to locate the at least one ridge on an inner face of the at least one side wall.

10. The process cartridge according to claim 3, further comprising a photosensitive roller and a transfer roller both disposed within the process cartridge housing, wherein the process cartridge housing further comprises opposite side walls supporting the photosensitive roller and the transfer roller at opposite ends thereof, respectively, at least one of the opposite side walls including the smoothed surface portion, wherein the at least one protruding portion comprises at least one ridge extending along the smoothed surface portion of the at least one side wall, and wherein the structure is adapted to locate the at least one ridge on an inner face of the at least one side wall within an area with which the photosensitive roller and the transfer roller are overlapped when projected in axial directions thereof onto the inner face, the structure including a smoothed surface formed on an outer face of the at least one side wall.

11. The process cartridge according to claim 3, further comprising a photosensitive roller and a transfer roller both disposed within the process cartridge housing, wherein the process cartridge housing further comprises opposite side walls supporting the photosensitive roller and the transfer roller at opposite ends thereof, respectively, and wherein the structure comprises a cover member displaced on an outer face of at least one of the opposite side walls, within an area with which the photosensitive roller and the transfer roller are overlapped when projected in axial directions thereof onto the outer face, the structure including a smoothed surface formed on an outer face of the at least one side wall, the cover member being separable from the outer face.

12. The process cartridge according to claim 1, wherein the process cartridge housing comprises a transport path section, wherein the transport path section forms a transport path in which a recording medium for recording the image is transported, with the process cartridge being mounted on the apparatus, in cooperation with the apparatus, and wherein the transport path section comprises the smoothed surface portion, the protruding portion, and the fillet portion, each formed in the transport path section.

13. The process cartridge according to claim 2, wherein the process cartridge housing comprises a transport path section, wherein the transport path section forms a transport path in which a recording medium for recording the image is transported, with the process cartridge being mounted on the apparatus, in cooperation with the apparatus, and wherein the transport path section comprises the smoothed surface portion, the protruding portion, and the fillet portion, each formed in the transport path section.

14. An apparatus for forming an image on a recording medium using toner, on which the process cartridge according to claim 3 is detachably mounted.

* * * * *